US009907731B2

(12) United States Patent
Lau et al.

(10) Patent No.: US 9,907,731 B2
(45) Date of Patent: Mar. 6, 2018

(54) SELF-PACED ERGONOMIC INFANT FEEDING BOTTLE

(71) Applicants: Chantal Lau, Santa Fe, NM (US); Joseph E. Newman, Santa Fe, NM (US); Brian Wadsworth, Santa Fe, NM (US)

(72) Inventors: Chantal Lau, Santa Fe, NM (US); Joseph E. Newman, Santa Fe, NM (US); Brian Wadsworth, Santa Fe, NM (US)

( * ) Notice: Subject to any disclaimer, the term of this patent is extended or adjusted under 35 U.S.C. 154(b) by 0 days.

(21) Appl. No.: 14/549,519

(22) Filed: Nov. 20, 2014

(65) Prior Publication Data

US 2016/0143814 A1 May 26, 2016

(51) Int. Cl.

| | |
|---|---|
| ***A61J 9/00*** | (2006.01) |
| ***A61J 9/04*** | (2006.01) |
| *A61J 11/04* | (2006.01) |
| *A61J 9/06* | (2006.01) |

(52) U.S. Cl.

CPC . *A61J 9/04* (2013.01); *A61J 9/00* (2013.01); *A61J 9/0623* (2015.05); *A61J 11/04* (2013.01)

(58) Field of Classification Search

CPC ..... A61J 9/00; A61J 9/04; A61J 9/0623
USPC ..... 215/11.1, 398, 383; D24/197, 198
See application file for complete search history.

(56) References Cited

U.S. PATENT DOCUMENTS

| | | | | |
|---|---|---|---|---|
| D1,049 | S * | 9/1858 | Kern | D24/198 |
| 484,811 | A | 10/1892 | Newell | |
| 1,056,113 | A | 1/1913 | Morgan | |
| 1,669,892 | A | 5/1928 | Beck | |
| 1,972,895 | A | 9/1934 | Maccoy | |
| 2,372,281 | A | 1/1945 | Jordan | |
| 2,744,646 | A | 1/1956 | Blackstone | |
| 3,028,983 | A | 1/1962 | Barr | |
| 3,092,276 | A | 1/1963 | Schaar | |
| 3,139,064 | A | 1/1964 | Harle | |
| 3,145,867 | A | 9/1964 | Roberts et al. | |
| 3,532,242 | A | 1/1970 | Tibbs | |
| 3,768,682 | A | 1/1973 | Meyers et al. | |
| D226,688 | S | 4/1973 | Thornton | |
| 3,924,620 | A | 1/1975 | Seunevel | |

(Continued)

FOREIGN PATENT DOCUMENTS

| | | |
|---|---|---|
| DE | 10102997 A1 | 7/2002 |
| EP | 0555165 A1 | 8/1993 |

(Continued)

OTHER PUBLICATIONS

Lau C, Schanler RJ. Oral feeding in premature infants: advantage of a self-paced milk flow. Acta Paediatr. 2000;89:453-9.

*Primary Examiner* — Sue A Weaver
(74) *Attorney, Agent, or Firm* — Robert D. Watson

(57) ABSTRACT

A self-paced, ergonomic feeding bottle with a substantially-straight back sidewall and an "S"-shaped curved front sidewall; where the curved front sidewall comprises two sections: (1) a convex chest section near the top, and (2) a concave handle section near the bottom, comprising a concave crook and a thin waist. The top-heavy bottle has a single plane of symmetry located between the right and left hand sides of the bottle. An anti-vacuum valve can be inserted into a vent hole. Side positioning markers can be used to achieve zero hydrostatic pressure during use. Anti-roll pads are part of the front sidewall.

10 Claims, 57 Drawing Sheets

(56) References Cited

U.S. PATENT DOCUMENTS

| | | | | |
|---|---|---|---|---|
| 4,548,157 | A | 10/1985 | Hevoyan | |
| 4,676,387 | A * | 6/1987 | Stephenson | A61J 9/00 215/11.1 |
| 4,685,577 | A | 8/1987 | Chen | |
| 4,728,006 | A | 3/1988 | Drobish et al. | |
| 5,117,994 | A | 1/1992 | Leblanc et al. | |
| 5,263,599 | A | 1/1993 | Sklar | |
| 5,531,338 | A | 1/1996 | Sklar | |
| 5,544,766 | A | 1/1996 | Dunn et al. | |
| 5,499,729 | A | 3/1996 | Greenwood et al. | |
| 5,553,726 | A | 9/1996 | Park | |
| 5,570,796 | A | 11/1996 | Brown et al. | |
| 5,716,347 | A | 2/1998 | Gibbs et al. | |
| 5,779,071 | A | 7/1998 | Brown et al. | |
| 5,944,205 | A | 8/1999 | LaJoie et al. | |
| 6,003,698 | A | 12/1999 | Morano | |
| 6,053,342 | A | 4/2000 | Chomik | |
| 6,073,788 | A | 6/2000 | Stroud | |
| 6,138,710 | A | 10/2000 | Chomik et al. | |
| RE37,016 | E | 1/2001 | Morano | |
| 6,173,850 | B1 | 1/2001 | Scheetz, Jr. et al. | |
| 6,305,562 | B1 | 10/2001 | Chan et al. | |
| 6,321,931 | B1 | 11/2001 | Hakin et al. | |
| D464,434 | S | 10/2002 | Morano | |
| 6,786,344 | B2 | 9/2004 | Kipperman et al. | |
| RE38,692 | E | 2/2005 | Wong | |
| D502,404 | S | 3/2005 | Hunt et al. | |
| 6,991,122 | B2 | 1/2006 | Holley, Jr. | |
| 6,994,225 | B2 | 2/2006 | Hakim | |
| 7,134,564 | B2 | 11/2006 | Verbovszky | |
| 7,185,784 | B2 | 3/2007 | Conners, Jr. et al. | |
| 7,503,461 | B1 | 3/2009 | Hoffman et al. | |
| 7,537,128 | B2 | 5/2009 | Nachumi | |
| 7,556,172 | B2 | 7/2009 | Lane | |
| 7,828,165 | B2 | 11/2010 | Brown et al. | |
| 7,837,056 | B2 | 11/2010 | Stribling et al. | |
| D716,461 | S | 10/2014 | Lau et al. | |
| 8,863,969 | B2 | 10/2014 | Lau | |
| 2002/0104815 | A1 * | 8/2002 | Richards | A61J 9/001 215/11.1 |
| 2004/0144744 | A1 | 7/2004 | Holley, Jr. | |
| 2004/0256345 | A1 | 12/2004 | Lundquist | |
| 2005/0023239 | A1 | 2/2005 | Lin | |
| 2005/0184022 | A1 | 8/2005 | Dunn et al. | |
| 2005/0205589 | A1 | 9/2005 | Davis et al. | |
| 2006/0260651 | A1 | 11/2006 | Holley, Jr. | |
| 2006/0261064 | A1 | 11/2006 | Holley, Jr. | |
| 2006/0278597 | A1 | 12/2006 | Daugherty et al. | |
| 2007/0051727 | A1 | 3/2007 | Holley, Jr. | |
| 2008/0099422 | A1 | 5/2008 | Rees | |
| 2008/0128647 | A1 | 6/2008 | Clawson | |
| 2008/0173612 | A1 | 7/2008 | Renz | |
| 2008/0237176 | A1 | 10/2008 | Pillado | |
| 2010/0032039 | A1 | 2/2010 | Nemoto et al. | |
| 2010/0147862 | A1 | 6/2010 | Keefe et al. | |
| 2010/0308003 | A1 | 12/2010 | Morril et al. | |
| 2010/0314347 | A1 | 12/2010 | Haberman et al. | |
| 2011/0000867 | A1 | 1/2011 | Lau et al. | |
| 2011/0011819 | A1 | 1/2011 | Lee | |
| 2011/0056968 | A1 | 3/2011 | McNamara et al. | |
| 2011/0068078 | A1 | 3/2011 | Brown et al. | |
| 2011/0079570 | A1 | 4/2011 | Brown et al. | |

FOREIGN PATENT DOCUMENTS

| | | | |
|---|---|---|---|
| EP | 1121923 | A1 * | 8/2001 |
| GB | 29063 | * | 4/1911 |
| GB | 2139903 | A1 | 11/1984 |

* cited by examiner

Sec. A-A

Sec. B-B

Sec. C-C

Sec. C-C

Sec. D-D

Sec. E-E

SELF-PACED ERGONOMIC INFANT FEEDING BOTTLE

STATEMENT REGARDING FEDERALLY SPONSORED RESEARCH OR DEVELOPMENT

This invention was made, in part, with U.S. government support under NIH Grant No. HD028140 and NIH Grant No. R43HD072847 awarded by the National Institutes of Health. The US government has certain rights in the invention.

CROSS-REFERENCE TO RELATED APPLICATIONS

This application is related to pending U.S. application Ser. No. 14/479,311, "Feeding Bottle System with Marks on Body, Neck or Nipple", filed Sep. 6, 2014 by C. Lau, which is incorporated herein by reference. This application is also related to recently issued U.S. Pat. No. 8,863,969 to C. Lau, issued Oct. 21, 2014, "Feeding Bottle System"; and to recently issued U.S. design Pat. D716,461, "Baby Bottle" by C. Lau et. al., issued Oct. 28, 2014, both of which are incorporated herein by reference.

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention pertains to the oral feeding of infants when they are bottle fed.

Description of Related Art

Feeding with a feeding bottle has for the infant risks of suffocating, choking or liquid going down the wrong way, when the rate or the pressure of the liquid flowing through the teat is too high. The goal of this invention is to optimize infant safety, efficiency, and comfort. Safe and efficient oral feeding relates to the proper transport of food from the mouth to the stomach. For infants, this requires appropriate suck, swallow, and respiratory functions and implies proper neuromotor coordination of the different musculatures implicated in these three functions and, very importantly, their ability to "work together" in a temporal synchrony to avoid adverse events, e.g., risks of suffocating, choking, and liquid going down to the lungs.

For the majority of infants born term with mature neurophysiologic and neuromotor functions, nutritive sucking is a natural reflexive behavior. Unfortunately, for those whose skills are not sufficiently developed to engage in such activity, e.g., some term infants, infants born prematurely, or infants with congenital or medical anomalies, bottle feeding is not without risks. This not only puts infants at risk of adverse events as mentioned above, but also raises the risk for failure to thrive and/or prolonged oral feeding aversion.

The capacity of an infant to feed effectively and without risk depends on its ability to coordinate the steps of sucking, deglutition and respiration, as well as its sucking force.

Although the majority of full-term babies are able to control and adjust the force and the duration of their sucking in order to maintain an acceptable rate of liquid transfer as a function of their capacity to coordinate the three aforementioned steps, this is not the case for a few of them, in particular in the event of fatigue, and for the majority of premature babies or infants with chronic conditions.

Bottle feeding is unsafe when the flow rate out of the bottle through the teat (nipple) is too fast for infants to handle because they cannot suck, swallow, and breathe safely at the same time. The development of nutritive sucking in infants is poorly understood, and, consequently, so are the causes of their oral feeding difficulties. If we do not understand the causes of such issues, can we, as caregivers, know how best to feed them? Nevertheless, bottle feeding is traditionally controlled by the caregiver (e.g., by controlling the angle of bottle inclination). Unfortunately, caregivers have no way of knowing the flow rate that a baby can handle, or the maturity of his/her nutritive sucking skills, and any difficulty can only be detected if the baby demonstrates overt signs such as choking, coughing, pulling away from the bottle, and/or turning blue due to lack of oxygen.

A person giving the feeding bottle has no way of knowing the flow rate that a baby is able to support and the sucking force that he/she is able to generate. However, this person is the only one in a position to control the rate of the liquid and not the infant. This flow rate depends in fact substantially on the hydrostatic pressure of the liquid at the outlet orifice of the teat of the feeding bottle, and therefore on the inclination of the feeding bottle in relation to the horizontal and to its level of filling. Faced with the uncontrolled flow of liquid flowing from a tilted feeding bottle, the infant can have difficulties getting his/her breath back or for resting, and as such runs the risk of suffocation, coughing, spitting, aspiration of liquid into the lungs and/or fatigue as his/her mouth is filling up with milk. Over time, the infant can develop an aversion for orality, or develop aspiration pneumonia due to the frequent penetration of liquid in the lungs. The higher the column of liquid over the nipple hole, the faster milk will drip out of a tilted bottle whether the infant is sucking or not. Therefore, to prevent passive milk drip, maintaining a substantially zero hydrostatic pressure over the nipple hole during feeding would be best.

Bottle feeding is also unsafe if it unnecessarily increases fatigue for the baby. With fatigue, an infant's oral feeding skills worsen. Also, coordination of sucking, swallowing, and respiration deteriorates, further increasing risks for adverse events. As the bottle empties during a feeding session, the internal negative pressure within the bottle or vacuum naturally increases, thereby hindering liquid outflow from the bottle as babies are sucking. Indeed, they must generate a greater sucking force to first overcome such resistance before they can get milk. This unnecessarily increases their energy expenditure and fatigue.

Finally, bottle feeding can put undue hand and wrist strain onto caregivers who need to frequently feed babies, such as mothers and hospital caregivers. Based on the poor shapes of many bottles, caregivers often need to maintain a tight grip on the device to ensure a good hold of the bottle and control of the feeding. This often leads to caregivers' discomfort, hand/wrist strain, and fatigue at feeding sessions.

Conventional feeding bottles often have a wider base and a narrower top, so that they are stable when resting in a vertical position on the table, full of liquid. To minimize milk drip with such a "bottom heavy" shaped bottle, a caregiver has to tilt the bottle at larger angles to achieve a substantially zero hydrostatic pressure (0 HP) than a bottle that is optimized to minimize the amount of tilting required to achieve 0 HP.

Also, in conventional bottles, the wider base concentrates more of the liquid at the rear of the bottle, which requires the caregiver to hold more tightly onto the bottle, creating more hand fatigue. For example, those conventional bottles cannot rest stably unaided on an open palm of a hand, even when full of liquid.

Also, many common bottles have recesses in the bottle's sidewall that are designed and optimized for a baby's grip. These recesses are generally not optimized for a caregiver's hand, which can lead to greater hand fatigue.

Finally, in some conventional bottles the angle that the nipple's centerline makes with the longitudinal central axis of the bottle is sometimes made greater than zero (e.g.)+25°. As infants are customarily fed in a semi-reclined position (approximately 30° from the horizontal plane), positioning the nipple at 90° to the plane of the lips (which is optimal for feeding) places the bottle in a nearly vertical position. This results in a large hydrostatic pressure because of the large height of the liquid's free surface above the nipple's outlet orifice, leading to greater dripping.

In summary, conventional feeding bottles have numerous problems that can significantly impair infants' bottle feeding performance; namely, (1) the presence of a positive hydrostatic pressure over the nipple opening that leads to inappropriate and unsafe milk dripping, (2) the creation of an internal vacuum build-up within the bottle as it empties that hinders milk outflow when babies are sucking, (3) caregivers' discomfort resulting from the sustained grasp they must have on the bottle in order to maintain control over the baby's feeding, and (4) inappropriate angling of the nipple relative to the bottle's centerline leading to high hydrostatic pressures at the outlet orifice. These problems impair the ability of infants to control and self-pace their own feeding.

It is therefore desirable to give control of a feeding to the baby as he/she knows the rate of liquid flow that they can tolerate. It is therefore desirable to give infants control over the liquid flow rate through the teat using an ergonomic bottle that is comfortable for the caregiver. Against this background, the present invention was developed.

SUMMARY OF THE INVENTION

It has for an object a feeding bottle of which the hydrostatic pressure can be maintained at the outlet orifice of the teat at a substantially zero value, in such a way that the rate of liquid flowing through the teat can be controlled without difficulty by the infant who is feeding and that the liquid flows only if the baby is feeding.

This invention relates to self-paced, ergonomic infant feeding bottles that offer benefits to both infant and caregivers; specifically giving control of the feeding to the baby and offering comfort to caregivers, respectively. Firstly, milk flows only if the baby is sucking. If he/she is pausing (not sucking) to rest or breathe, milk will not drip into his/her mouth because the hydrostatic pressure of the liquid over the teat is maintained substantially at zero. This increases safety. Additionally, the simultaneous elimination of the vacuum build-up occurring in conventional bottles helps infants conserve energy for growing as they do not have to suck harder to get milk. This increases efficiency and reduces infant fatigue.

Secondly, the optimized ergonomic shape of the bottle offers two benefits for caregivers. There is no need for the caregiver to use a firm grip on the bottle when feeding a baby because the combination of a top-heavy center of gravity and a unique, asymmetric S-shaped curve that creates a recessed crook in the sidewall creates an optimized bottle that rests comfortably and securely in the palm of a hand. Additionally, as the bottle empties during a feeding, the oversized surface area created by its oversized, front forward belly (chest) minimizes the need to tilt the bottle in order to maintain a substantially zero hydrostatic pressure of the liquid over the teat (nipple). These features increase caregivers' comfort and reduce hand/wrist strain or fatigue when bottle feeding babies.

The prevention of vacuum buildup is achieved through the use of an unidirectional anti-vacuum valve inserted in a vent hole. Additionally, anti-drip zero hydrostatic pressure visual and/or tactile positioning markers can be used to guide the caregiver in selecting the proper inclination to give the bottle so that the liquid level passes through the nipple's outlet orifice, thereby guaranteeing substantially zero hydrostatic pressure of the liquid at the nipple. Additional details of the anti-drip markers and anti-vacuum valve can be found in U.S. Pat. No. 8,308,001 (Nov. 13, 2012) to Lau and Nahmias, and in US Patent Application Publication US2011/0266245 A1 to Lau and Nahmias, both of which are incorporated herein by reference. The feeding bottle may additionally comprise anti-roll pads, which allow the bottle to rest horizontally, full of liquid, without rolling off of a table top. The bottle can further comprise a pair of opposed, recessed nooks for securely positioning a finger or thumb while gripping the bottle. The feeding system can additionally comprise a unique, fluted cap that serves double-duty as a protective cover and a drying stand for holding the bottle, nipple, and nipple crown ring vertically in an upside-down position during drying after washing.

BRIEF DESCRIPTION OF THE SEVERAL VIEWS OF THE DRAWING(S)

Figure 25A:
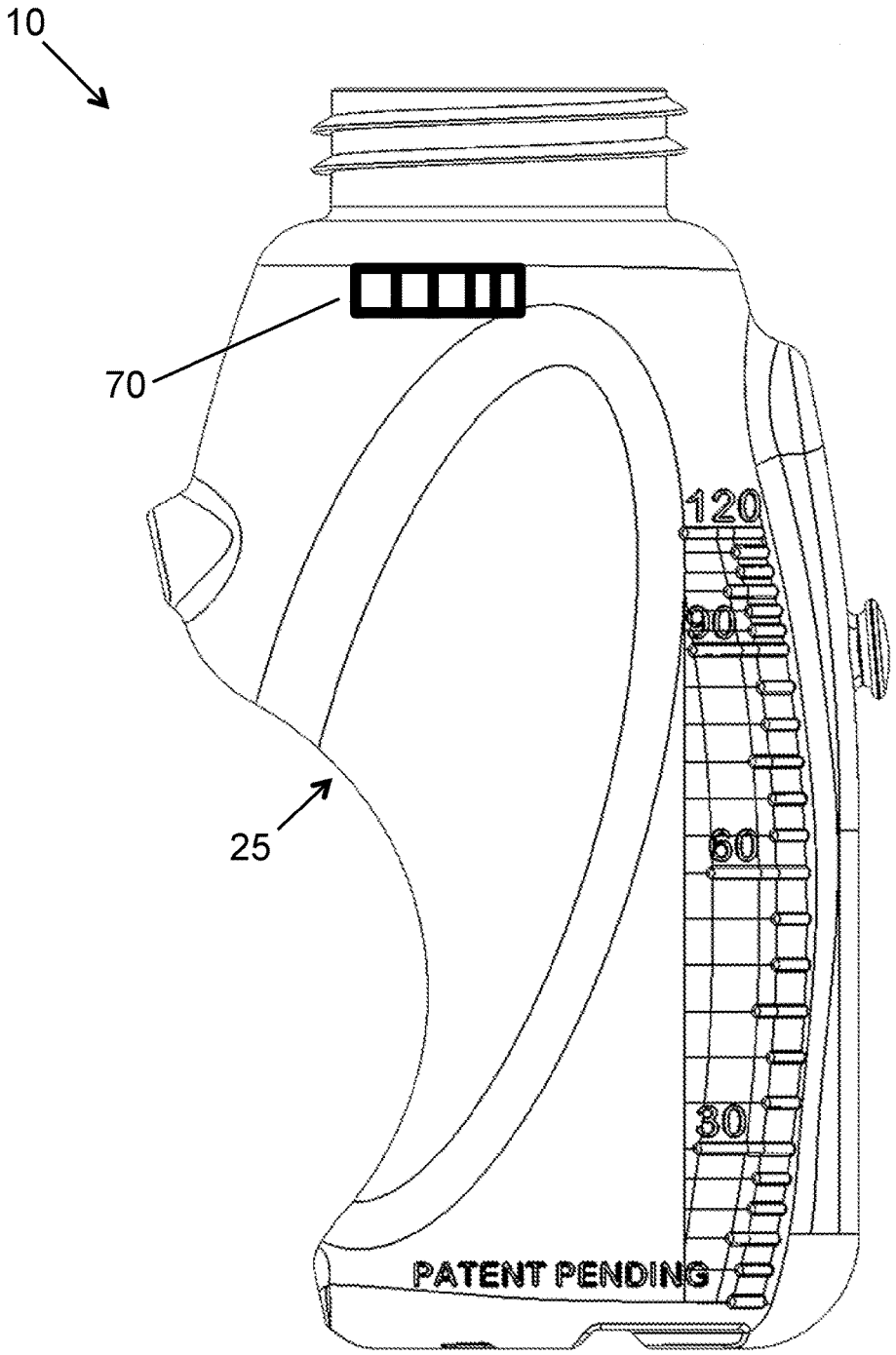

FIGS. 25A, B, and C show right-sided views of the prototype feeding bottle in a vertical position, with examples of 0 HP Zone Markers, according to the present invention.

Figure 26:
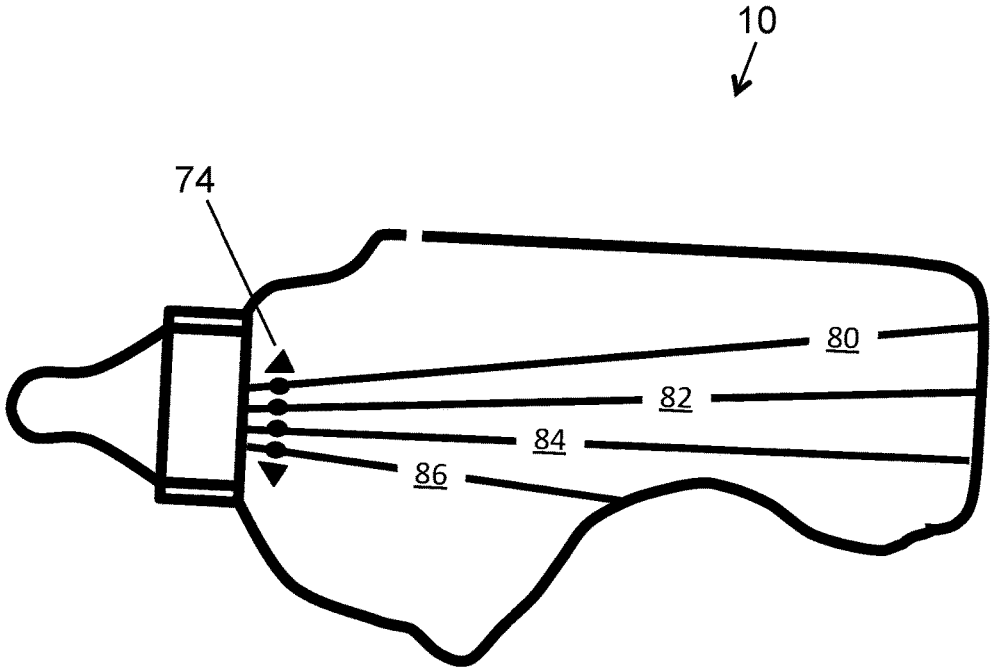

FIG. 26 shows a side view of the prototype feeding bottle in a horizontal position, illustrating examples of four different, zero hydrostatic pressure line markers that wrap around the bottle corresponding to four different volumetric amounts of fluid, according to the present invention.

Figure 27A:
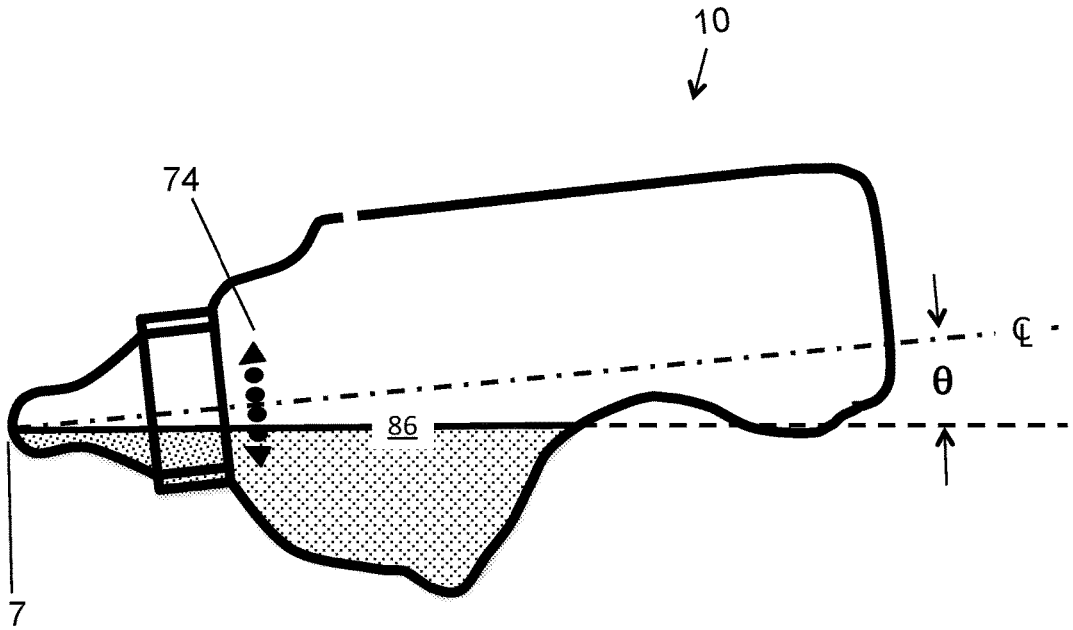

FIG. 27A shows a side view of the prototype feeding bottle in a horizontal position, illustrating a zero hydrostatic pressure line marker that wraps around the bottle corresponding to 1 Oz of liquid, according to the present invention.

Figure 27B:
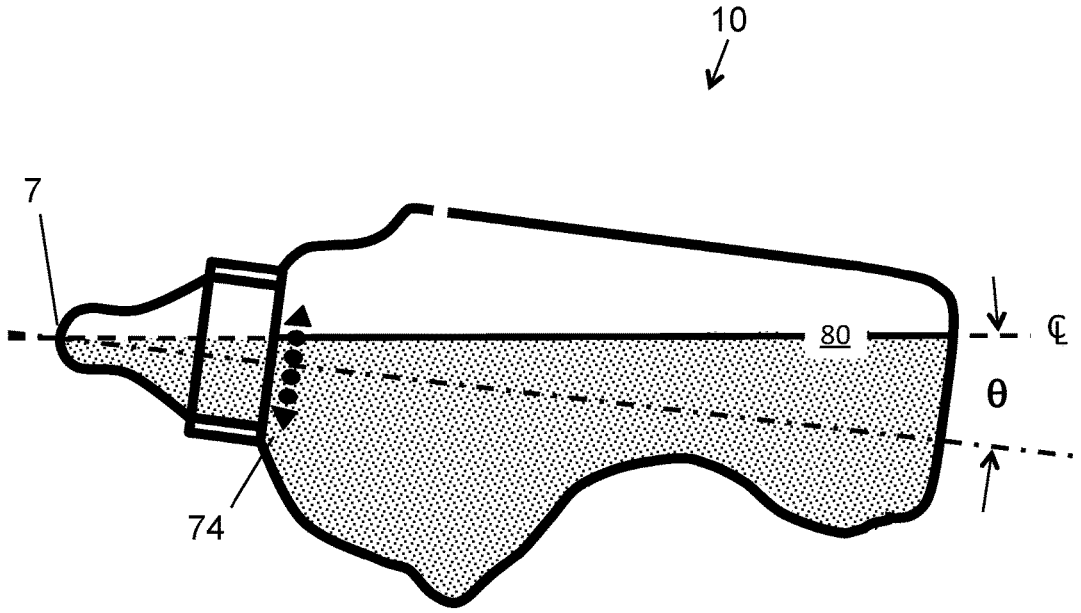

FIG. 27B shows a side view of the prototype feeding bottle in a horizontal position, illustrating a zero hydrostatic pressure line marker that wraps around the bottle corresponding to 4 Oz of liquid, according to the present invention.

Figure 28:
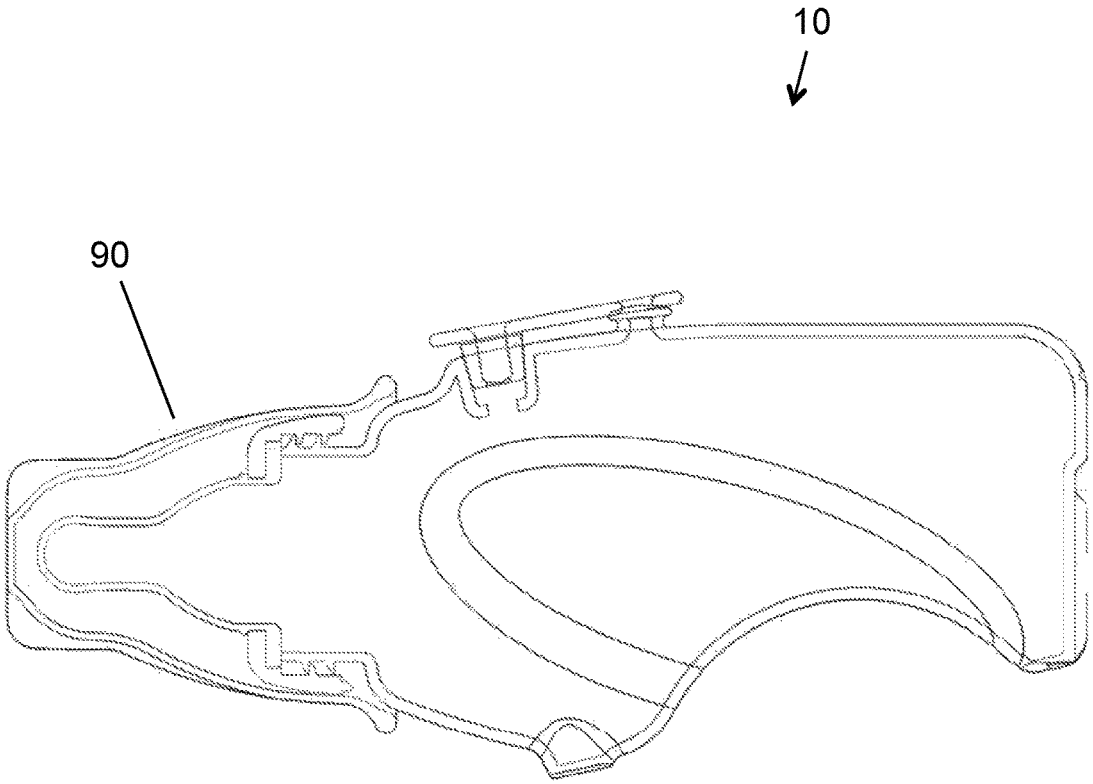

FIG. 28 shows an enlarged, side cross-section view of the prototype feeding bottle in a horizontal position, and with a nipple held by a nipple crown ring, and with a cap covering the nipple and nipple crown ring, according to the present invention.

Figure 29:
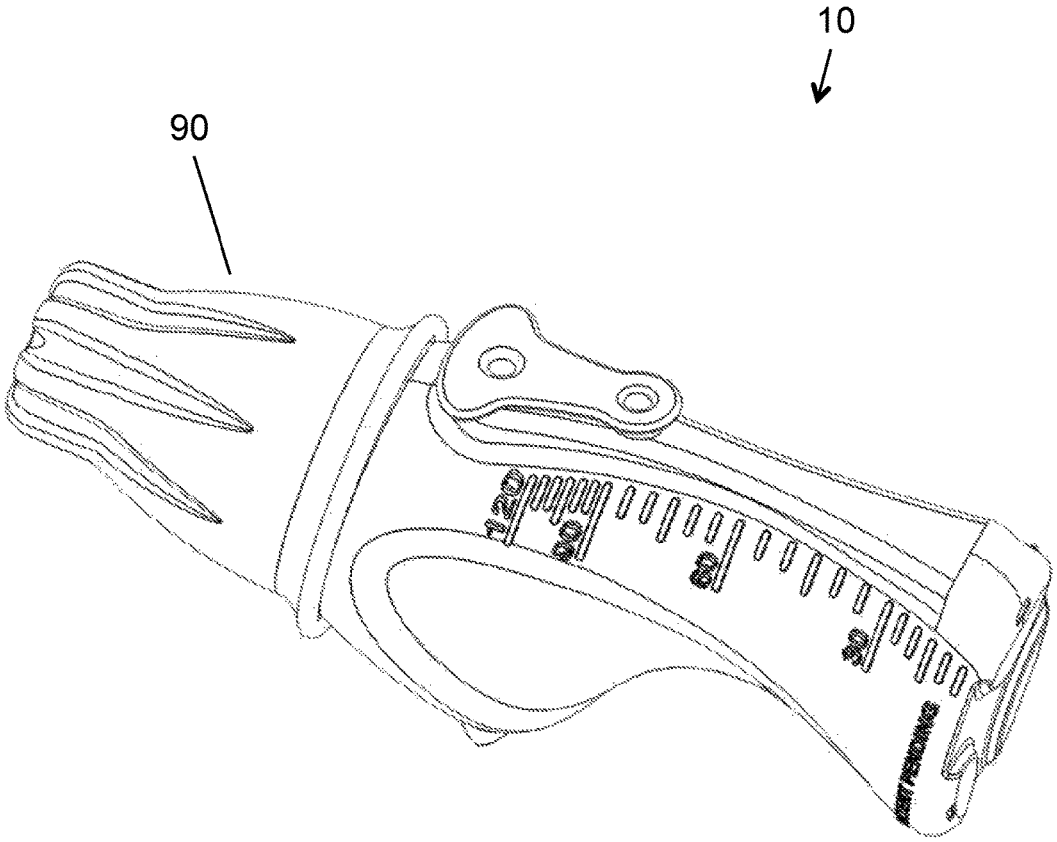

FIG. 29 shows an isometric, solid-shaded side/end view of the prototype feeding bottle in a horizontal position, with the anti-vacuum valve part inserted into the receiving hole, and with a nipple held by a nipple crown ring, and with a cap covering the nipple and nipple crown ring, according to the present invention.

Figure 30:
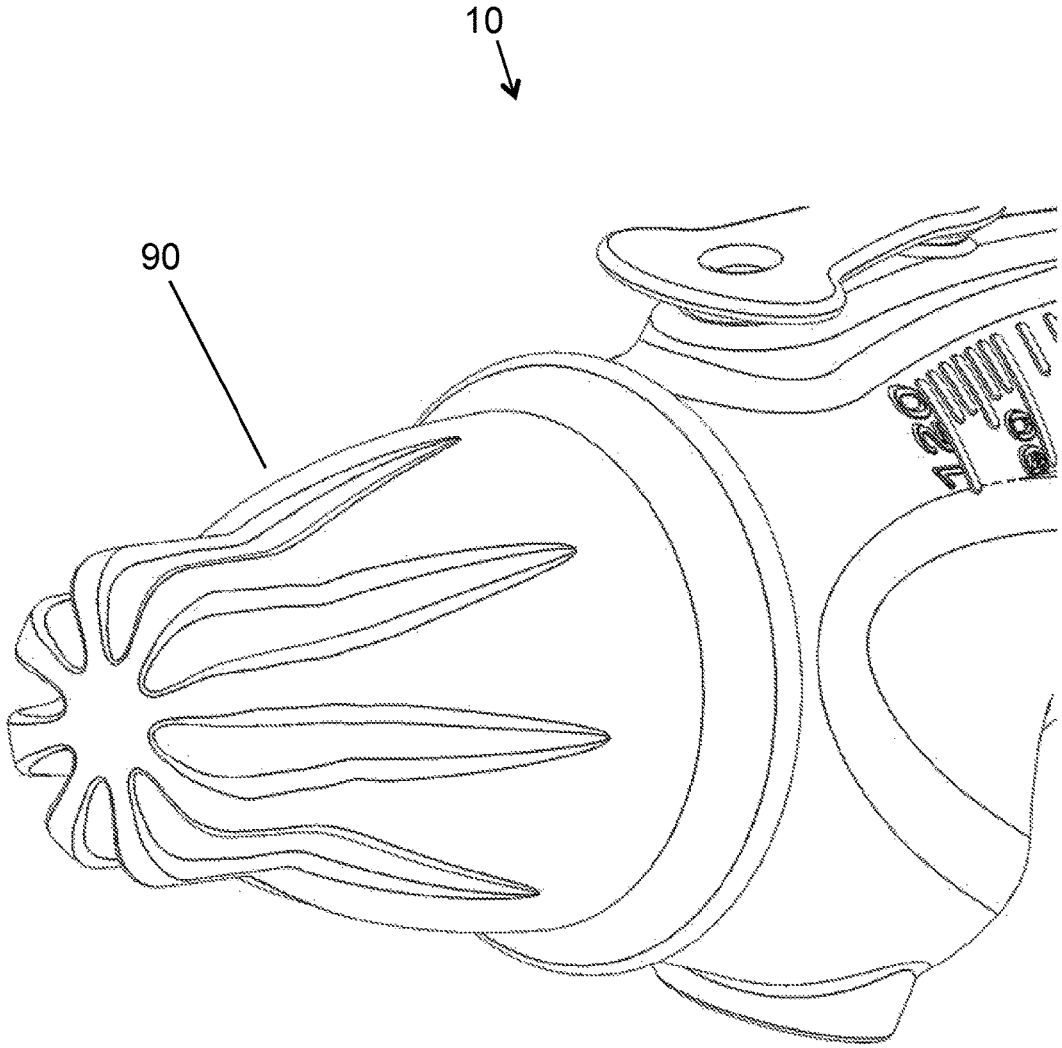

FIG. 30 shows an enlarged, isometric, solid-shaded side/end view of the prototype feeding bottle in a horizontal position, with the anti-vacuum valve part inserted into the receiving hole, and with a nipple held by a nipple crown ring, and with a cap covering the nipple and nipple crown ring, according to the present invention.

Figure 31:
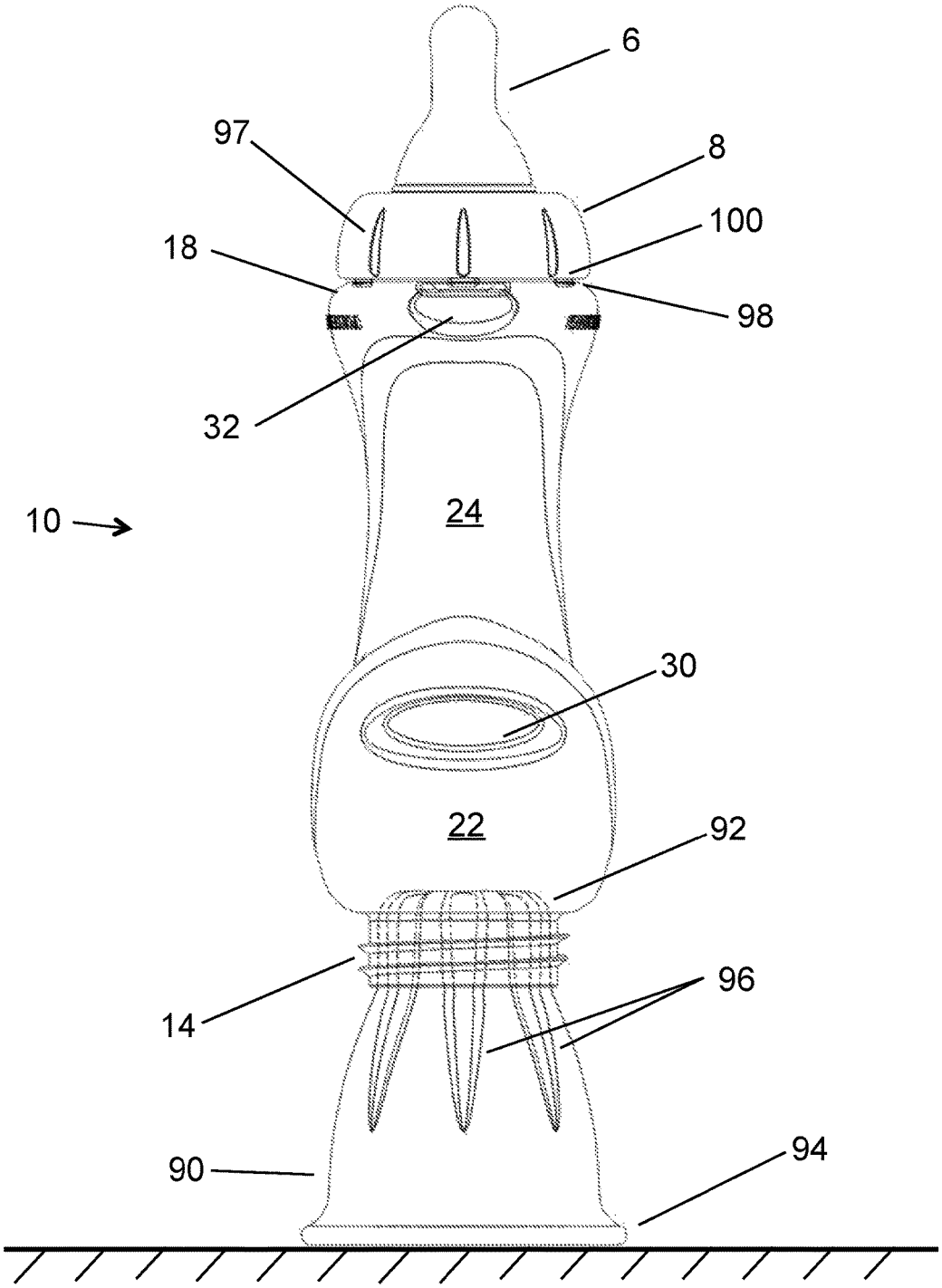

FIG. 31 shows a front elevation view of the prototype feeding bottle in a reversed/upside-down vertical position, with the cap acting as a drying base holding the neck of the bottle in an upside-down position, and with the nipple/crown ring assembly resting on the top (i.e., bottom/rear end 18) of the bottle, for purposes of drying after washing, according to the present invention.

Figure 32:
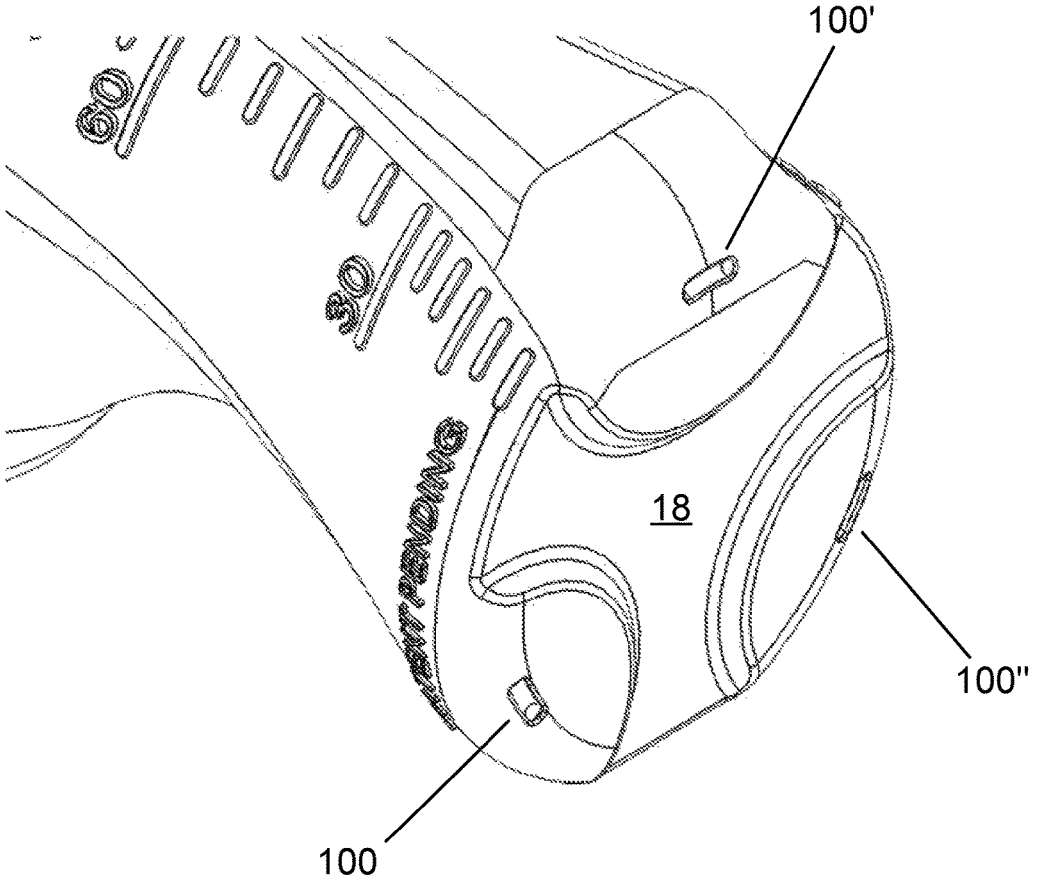

FIG. 32 shows a bottom (rear) end view of the prototype feeding bottle in a horizontal position, according to the present invention.

Figure 33:
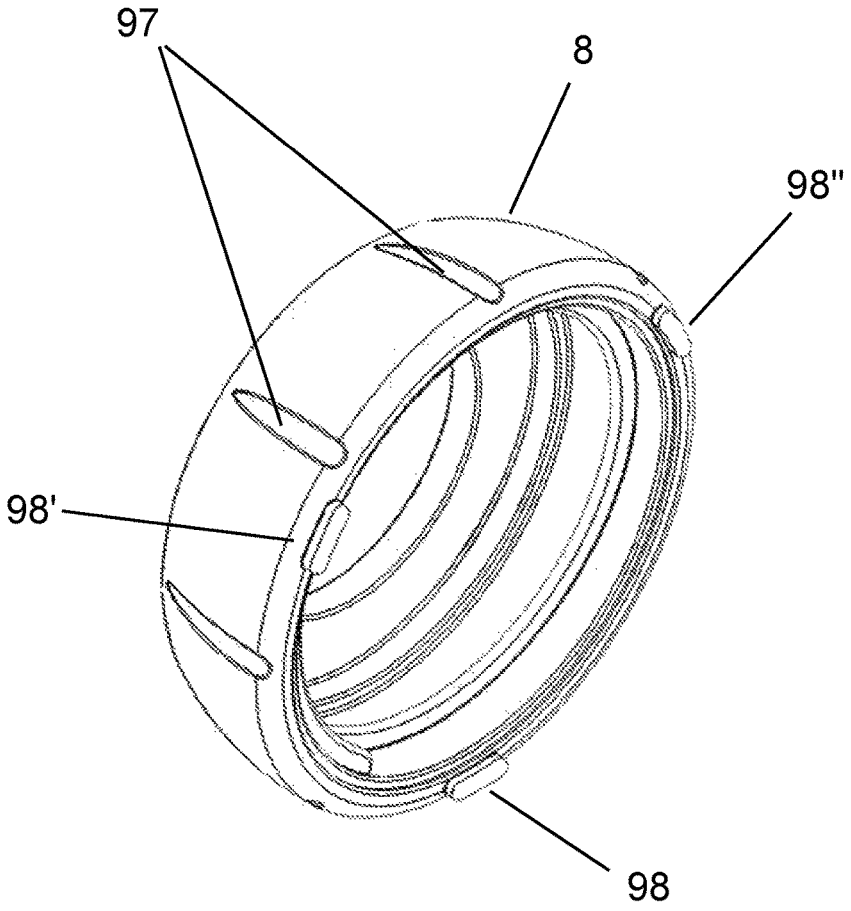

FIG. 33 shows an isometric view of an example of a nipple crown ring for use with the prototype feeding bottle, according to the present invention.

Figure 34:
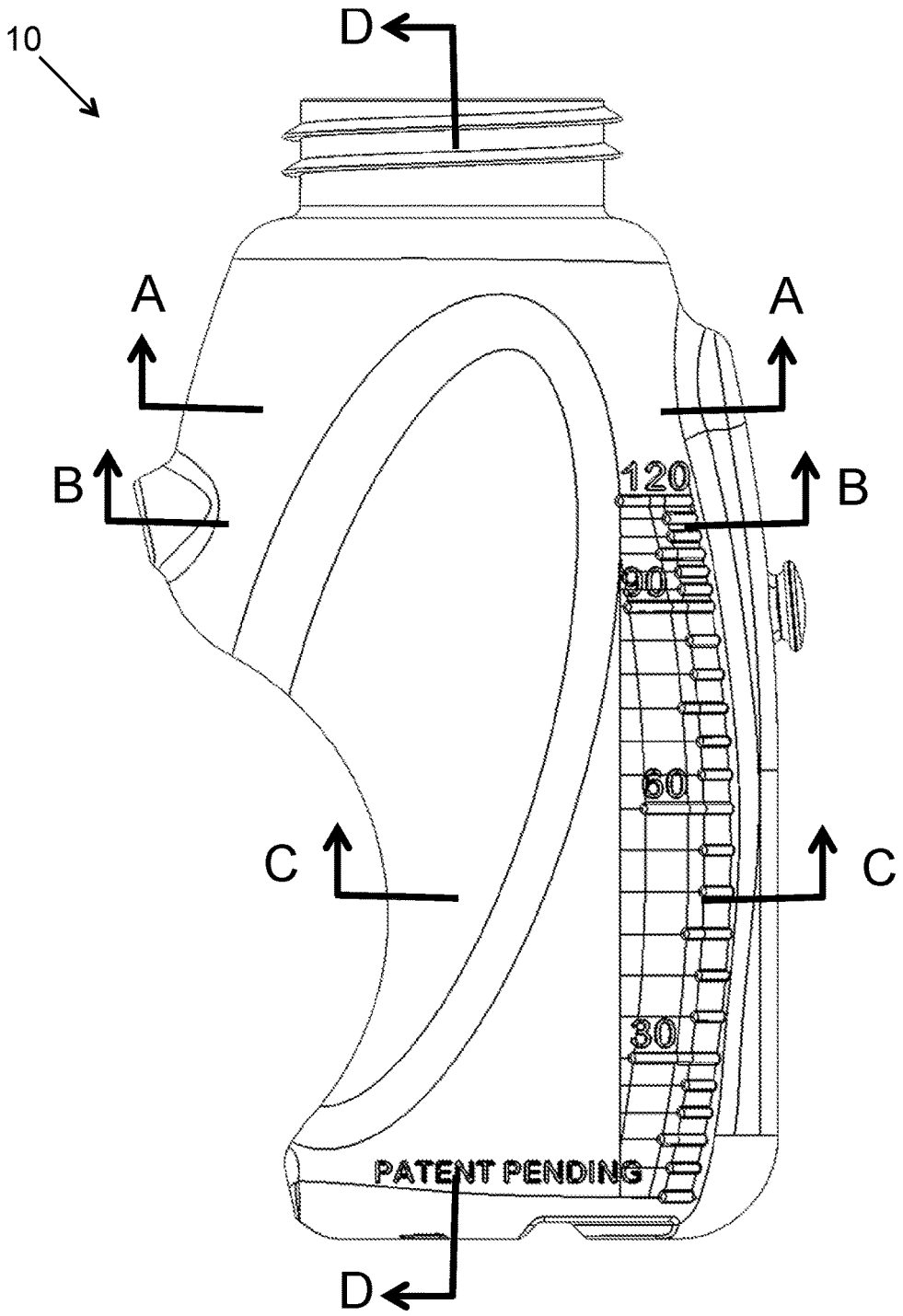

FIG. 34 shows a side view of the prototype feeding bottle, with indications for cross-section cuts, according to the present invention.

Figure 35:
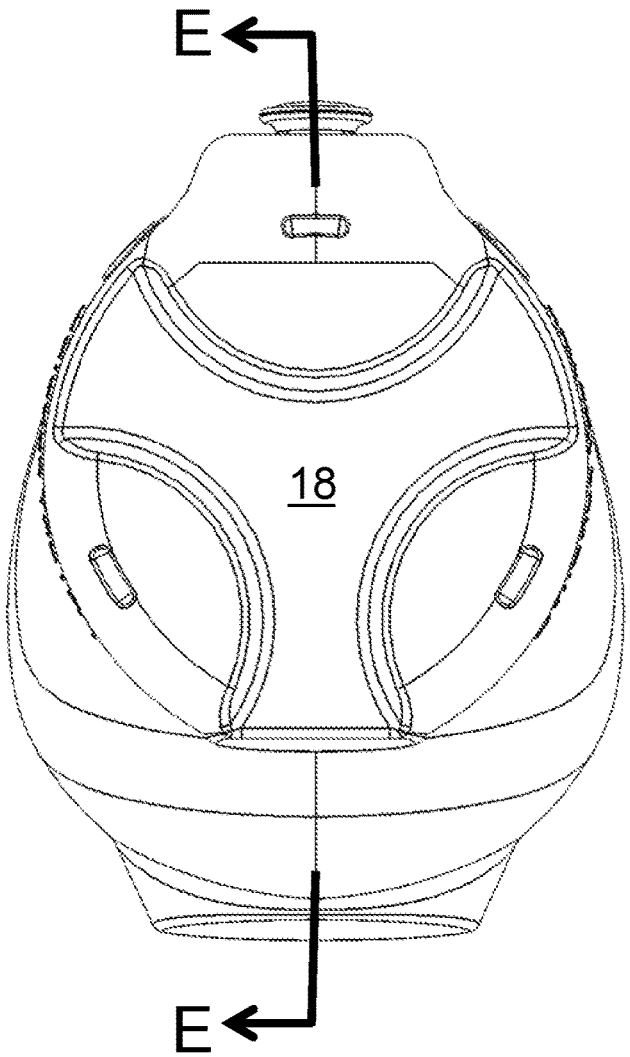

FIG. 35 shows a bottom (rear) end view of the prototype feeding bottle in a horizontal position, with indication for cross-section cut according to the present invention.

Figure 36:
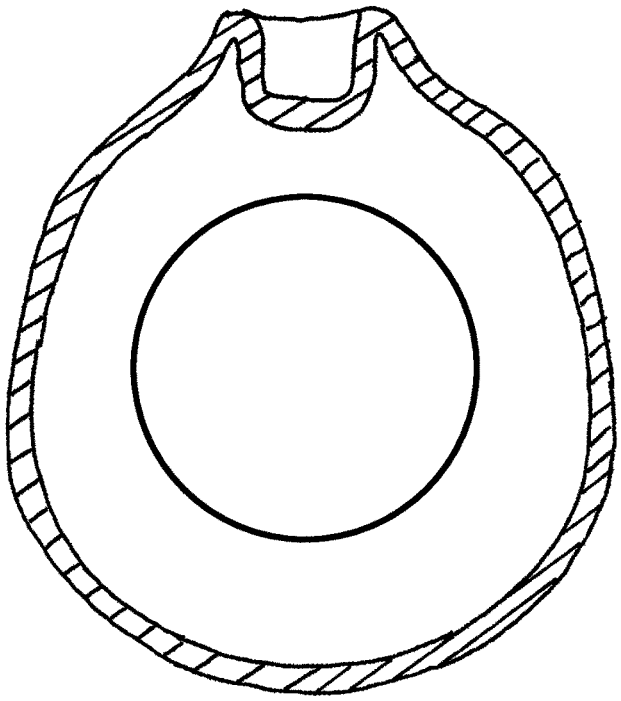

FIG. 36 shows a standard cross-section A-A bottom (rear) end view of the prototype feeding bottle in a horizontal position, according to the present invention.

Figure 37:
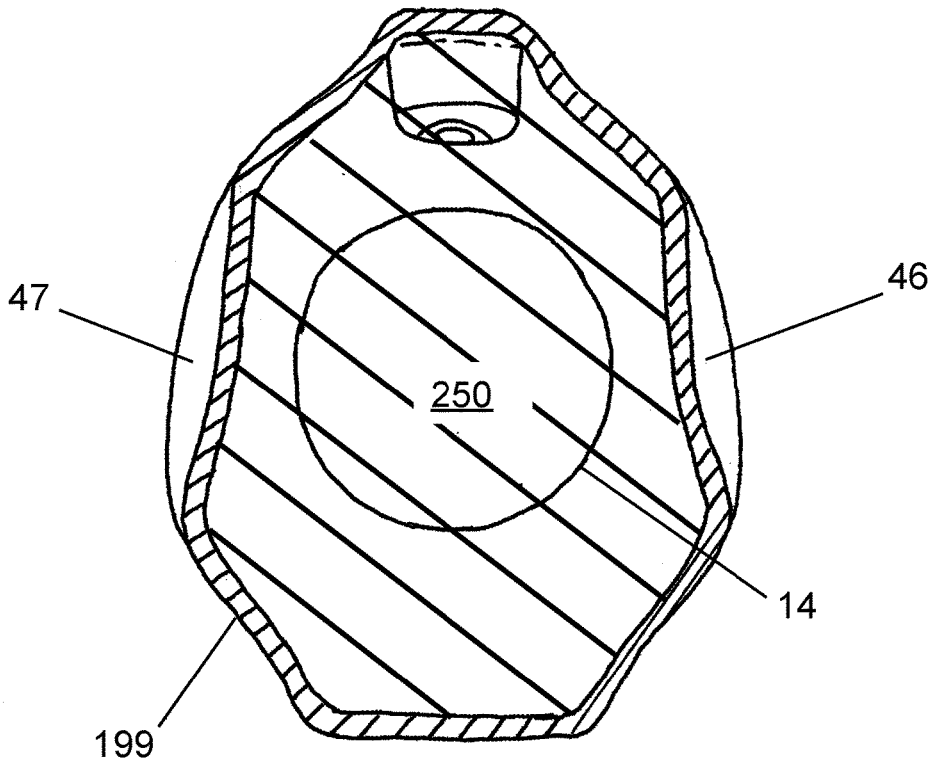

FIG. 37 shows a standard cross-section B-B bottom (rear) end view of the prototype feeding bottle in a horizontal position, according to the present invention.

Figure 38:
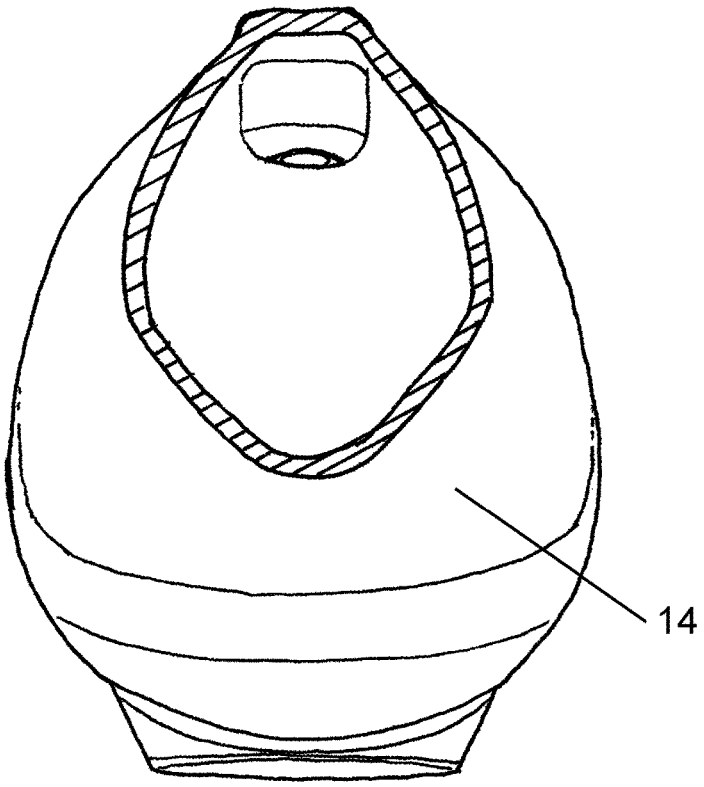

FIG. 38 shows a standard cross-section C-C bottom (rear) end view of the prototype feeding bottle in a horizontal position, according to the present invention.

Figure 39:
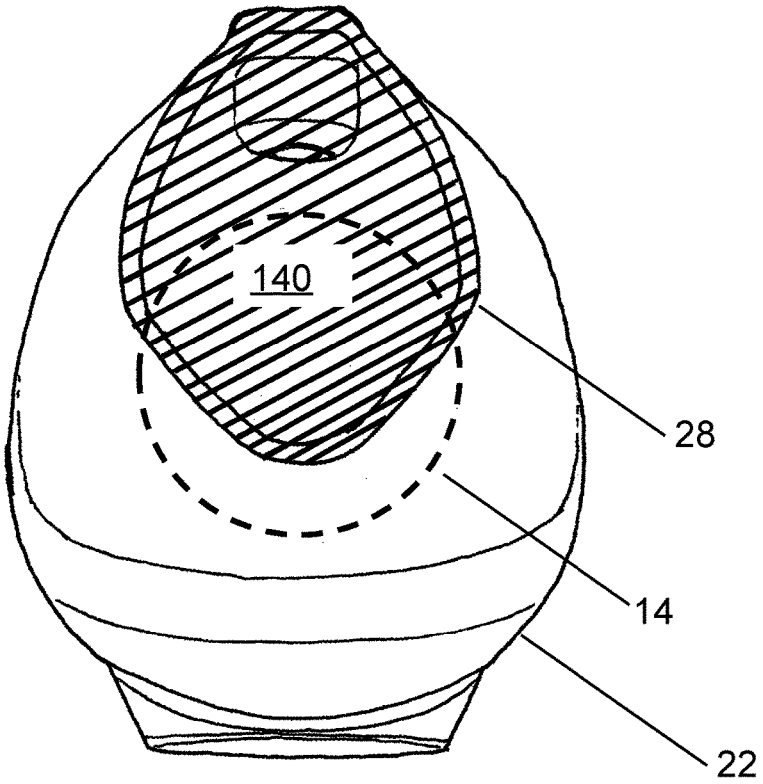

FIG. 39 shows a cross-section bottom (rear) end view of the prototype feeding bottle in a horizontal position, according to the present invention, where the entire cross-section of the bottle is cross-hatched at the location of Section C-C.

Figure 40:
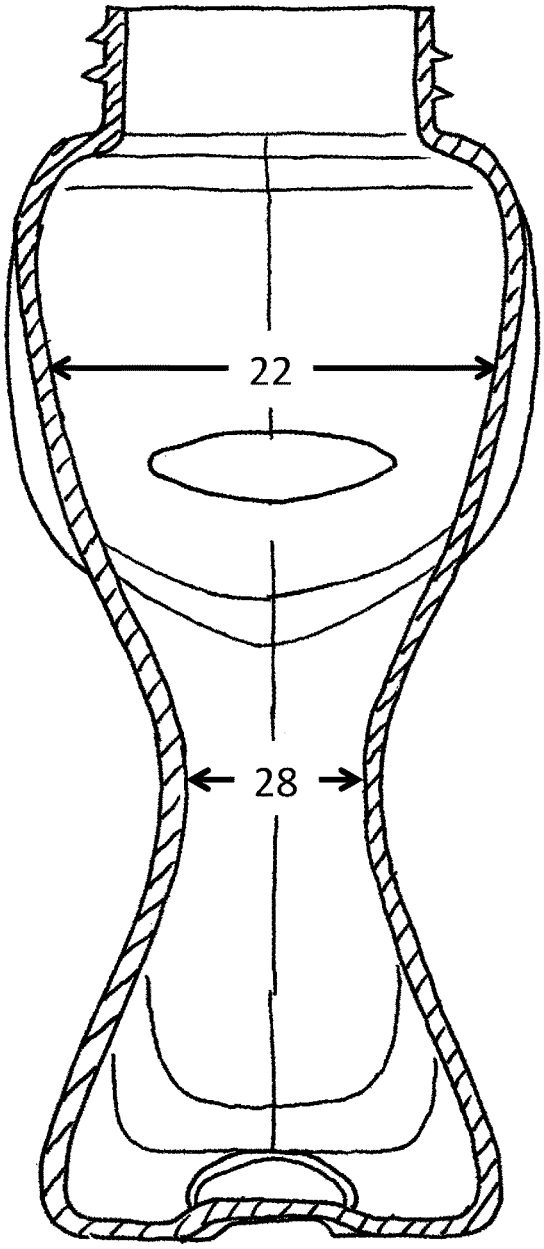

FIG. 40 shows a standard cross-section D-D back side view of the prototype feeding bottle in a horizontal position, according to the present invention.

Figure 41:
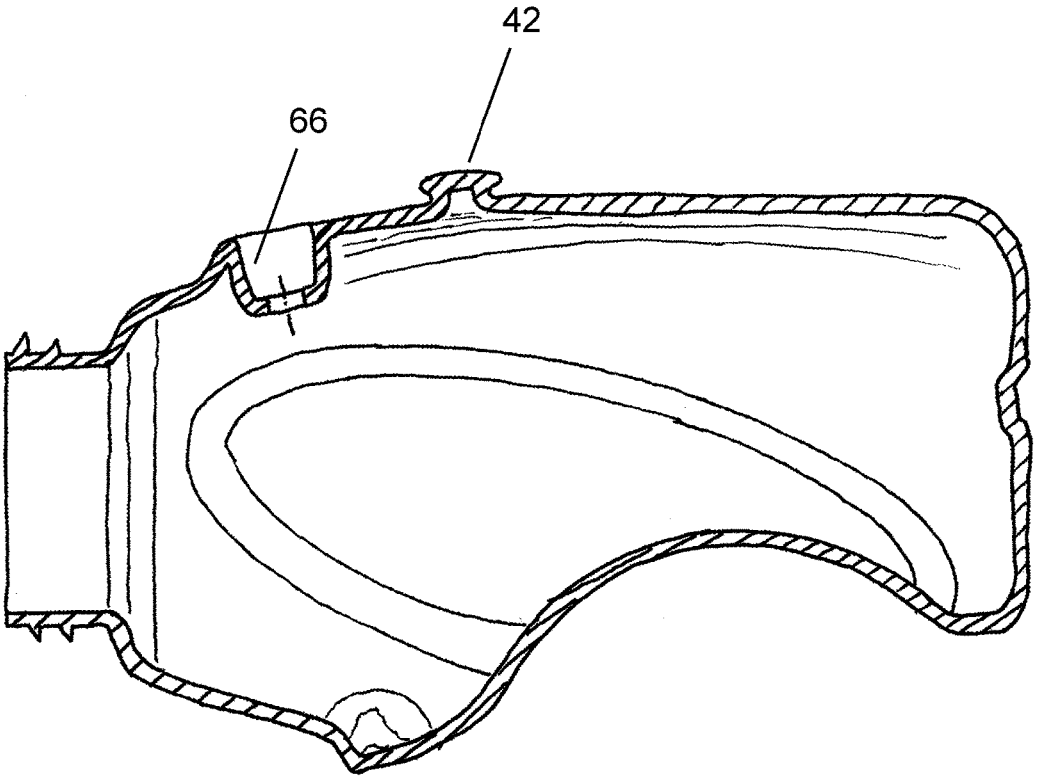

FIG. 41 shows a standard cross-section E-E left side view of the prototype feeding bottle in a horizontal position, according to the present invention.

Figure 42:
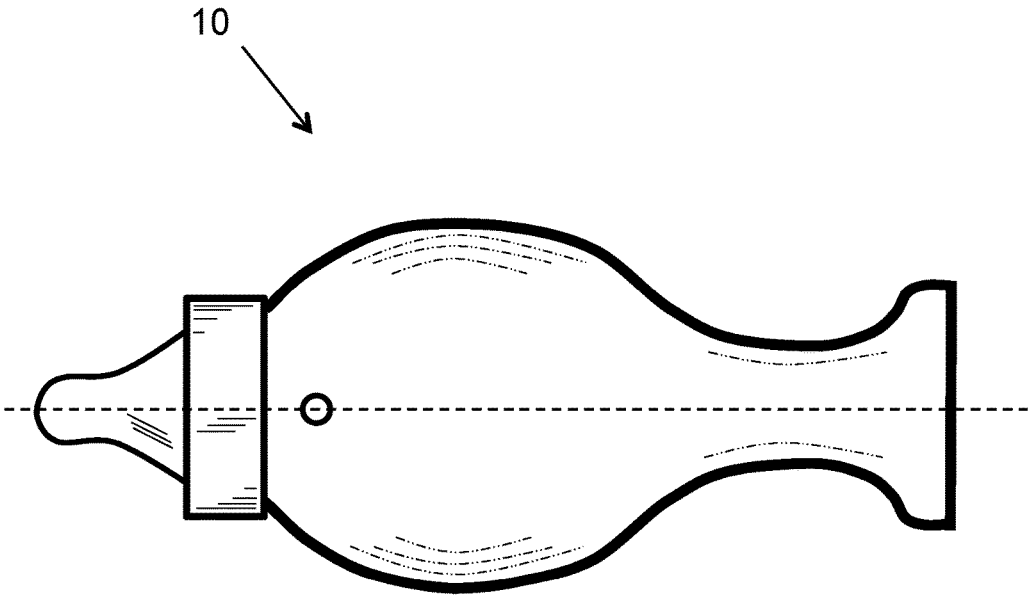

FIG. 42 shows a cross-section view of an example of an axisymmetric feeding bottle, according to the present invention.

Figure 43:
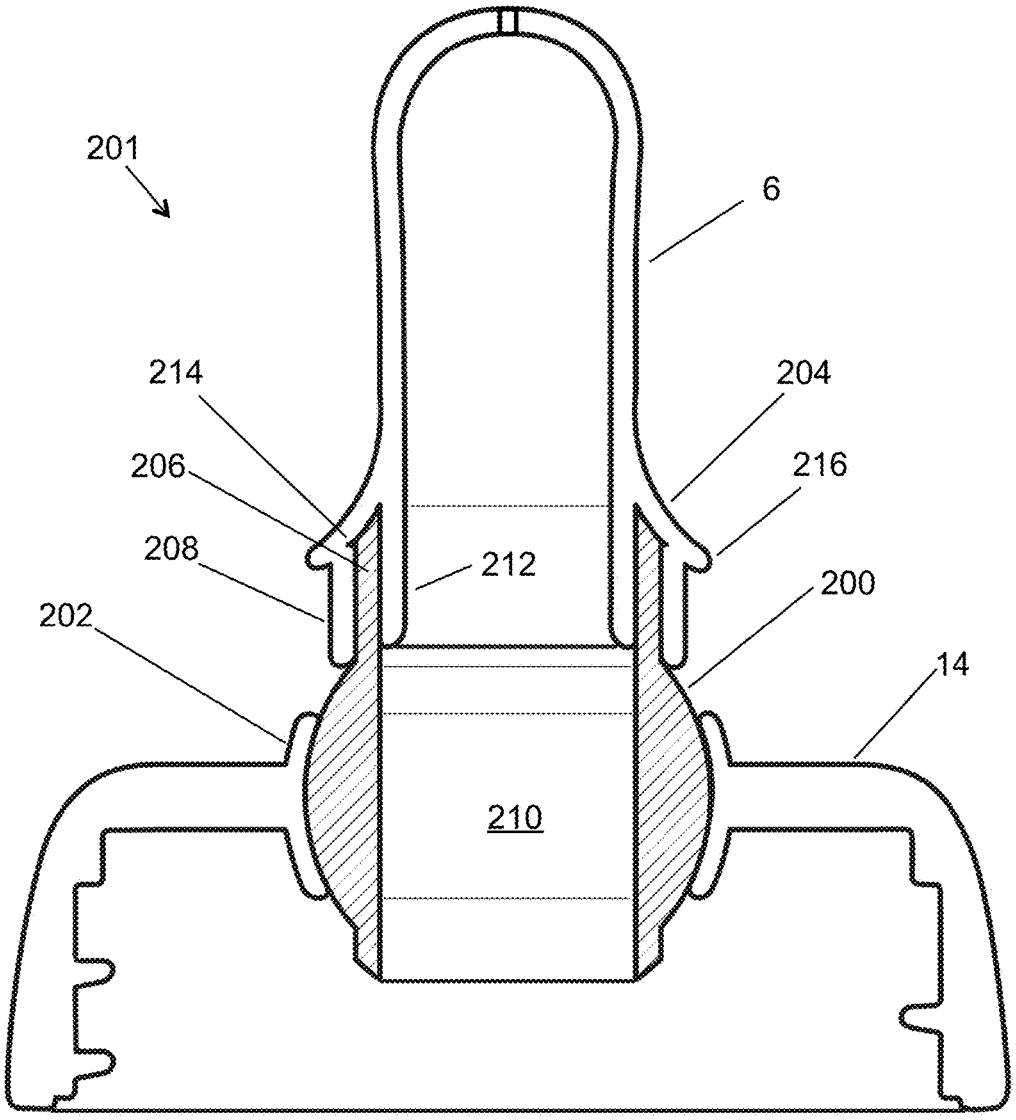

FIG. 43 shows a cross-section view of an example of an articulating nipple, according to the present invention.

Figure 44:
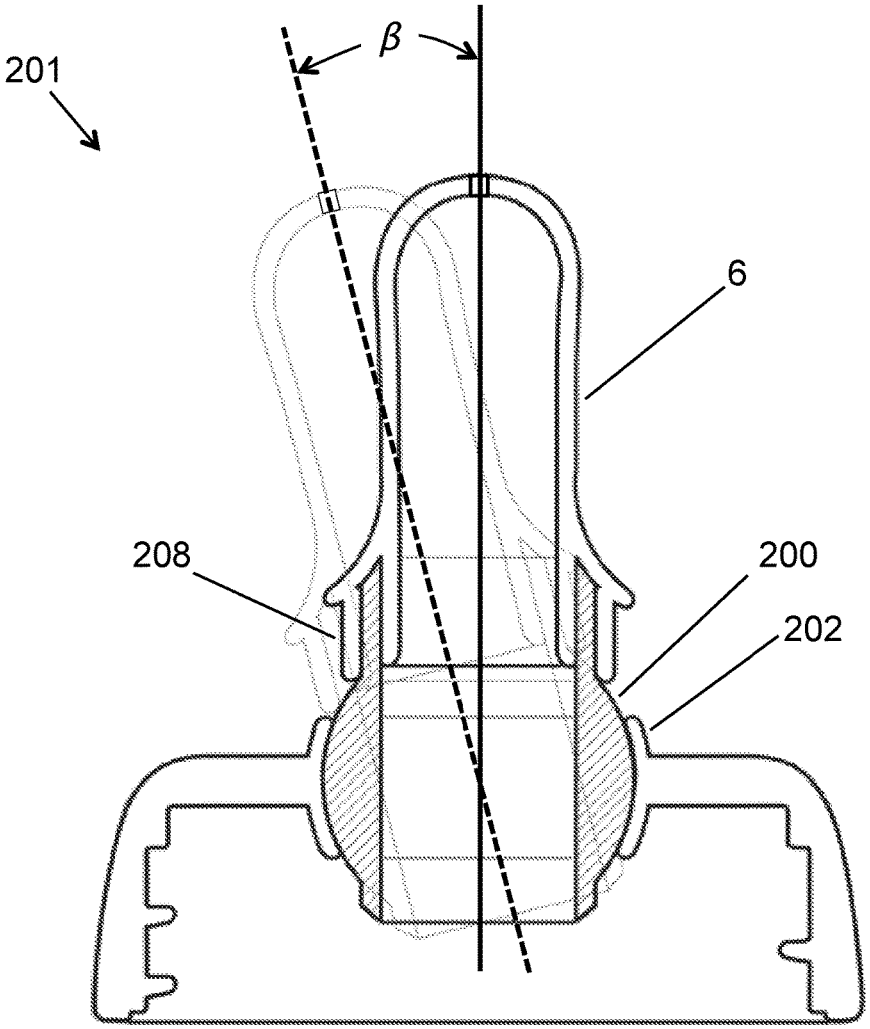

FIG. 44 shows a cross-section view of an example of an articulating nipple in a rotated position, according to the present invention.

DETAILED DESCRIPTION OF THE INVENTION

FIGS. 1-44 show examples of various embodiments of the present invention.

Figure 1:
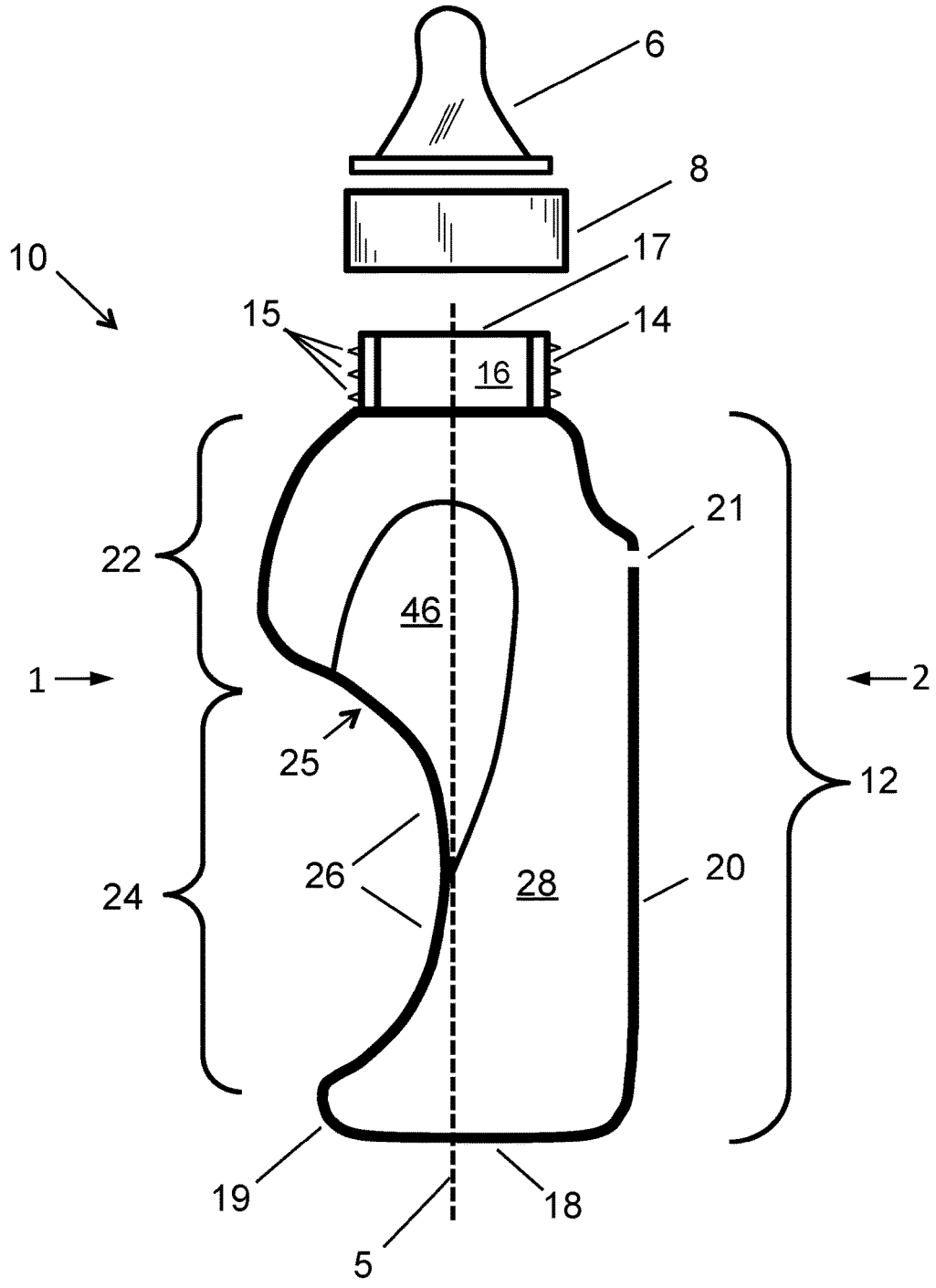
FIG. 1 shows a side view of a first example of a feeding bottle in a vertical position, according to the present invention.

FIG. 1 shows a side view of a first example of a feeding bottle in a vertical position, according to the present invention. Bottle 10 comprises an elongated body 12 (container, reservoir) with a closed bottom end (base) 18, a central longitudinal axis, an open neck 14, a substantially-straight back sidewall 20 and an "S"-shaped curved front sidewall 25; wherein the curved front sidewall 25 comprises two sections: (1) a convex chest section 22 near the neck 14, and (2) a concave handle 24 section near the bottom end 18 comprising a concave crook 26 and a thin waist 28; and further wherein the bottle 10 has a shape comprising a single plane of symmetry located between left and right hand sides of the bottle. Neck 14 can comprise screw threads 15 for attaching a nipple crown ring 8 that holds nipple 6 to neck 14. Optionally, nipple crown 8 can snap onto neck 14, or be attached via a bayonet-type attachment. Note: the terms "convex" and "concave" refer to a point of view that is located outside of the bottle, and is looking towards the front side of the bottle. In other words, applied to bottle 10, a viewer holding the bottle in his/her hand would say that the convex chest region 22 bulges out towards the viewer to form an enlarged or oversized surface (i.e., belly); while the concave handle region 24 curves away from the viewer to form a recessed surface (i.e., crook). The following directions are labeled by the following reference numbers (indicia): bottle top=17, bottle bottom=18, bottle front side=1, bottle back side=2, bottle right side=3 and bottle left side=4. The longitudinal axis, labeled as item 5, runs along the long direction of bottle 10.

Optionally, body 12 can comprise one or more lateral finger recesses (nooks, recessed indentations) 46 useful for locating and securing a finger(s) or thumb in a stable position. Also, the recessed part 26 of the S-shaped curve 25 forms a crook 26 segment that fits comfortably into the mating crook of a caregiver's hand, between the thumb and index finger, as will be shown in later Figures. Handle section 24 can also comprise an overhanging "hook" segment 19 that aids the caregiver in comfortably holding bottle 10. The back spine 20 can optionally comprise a vent hole 21, up front near neck 14, for equalizing the internal pressure inside bottle 10 with the external (atmospheric) pressure. Vent hole 21 prevents the buildup of undesirable vacuum pressure inside of bottle 10 during feeding as the bottle empties. Vent hole 21 can be, for example, approximately 1-2 mm in diameter. Optionally, vent hole 21 can be sufficiently small in diameter (e.g., less than 1 mm) so as to prevent leakage (spillage) of liquid contents outwards due to surface tension effects of the contained fluid (e.g., milk, formula).

Figure 2:
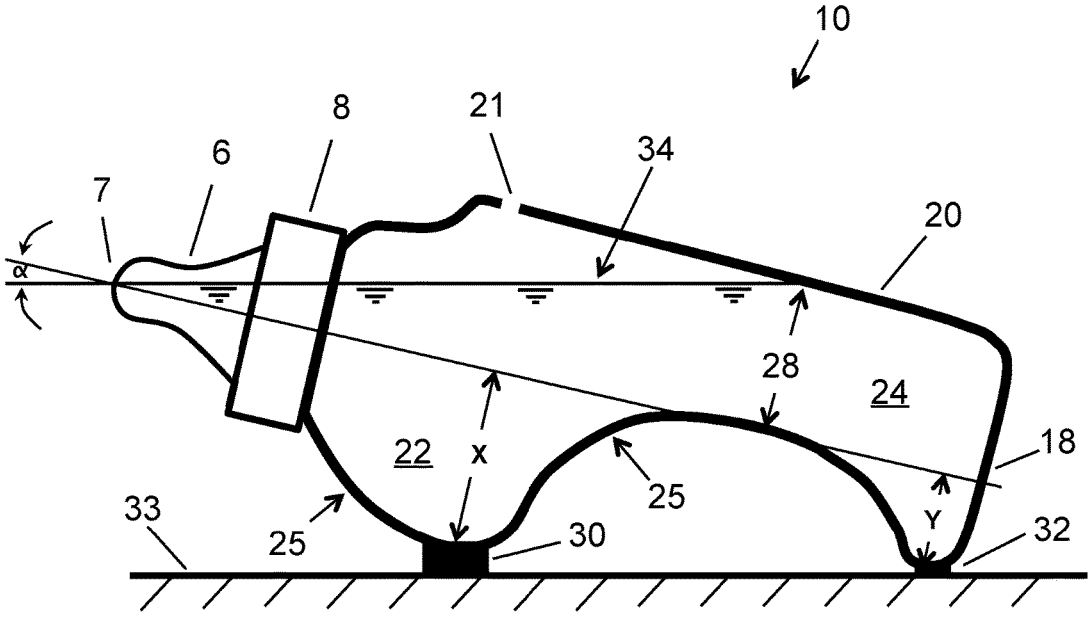
FIG. 2 shows a side view of the first example of a feeding bottle in a tilted position resting stably on a horizontal surface (e.g., table top), according to the present invention.

FIG. 2 shows a side view of the first example of a feeding bottle in a tilted preferred horizontal orientation position resting stably on a horizontal surface (e.g., a table-top), according to the present invention. Bottle 10 rests stably on two or more anti-roll pads ("feet"), which comprise bumps (protrusions) sticking out from the bottle's S-shaped sidewall 25. Near the neck 14, front foot 30 supports the top (forward) half of the bottle; while at base 18 the rear foot 32 supports the rear (bottom) half of the bottle. Front and rear feet 30, 32 are also illustrated in FIGS. 4, 5 and 6.

FIG. 2 also shows liquid level 34 for a nearly full bottle. The distance "X" from the longitudinal central axis to front foot 30 is approximately twice as long as distance "Y" from the centerline to rear foot 32. This difference in distances ($X \geq 2 \times Y$) tips the neck 14 of the bottle 10 up at an angle of repose, $\alpha$, at approximately 15 degrees (range: 10 to 25 degrees) from the horizontal. Since the bottle rests tipped up at this angle, $\alpha$, liquid in the bottle doesn't drip (even when the bottle is nearly full of liquid) because there is zero hydrostatic pressure at the nipple's outlet orifice 7 (this condition is reached when the liquid level substantially passes horizontally through the nipple's outlet orifice 7). Note that small variations in the vertical height of the liquid level by +/−1 mm gives rise to a negligible amount of positive hydrostatic pressure at the outlet orifice 7 (i.e., the fluid pressure remains at substantially zero).

Figure 3A:
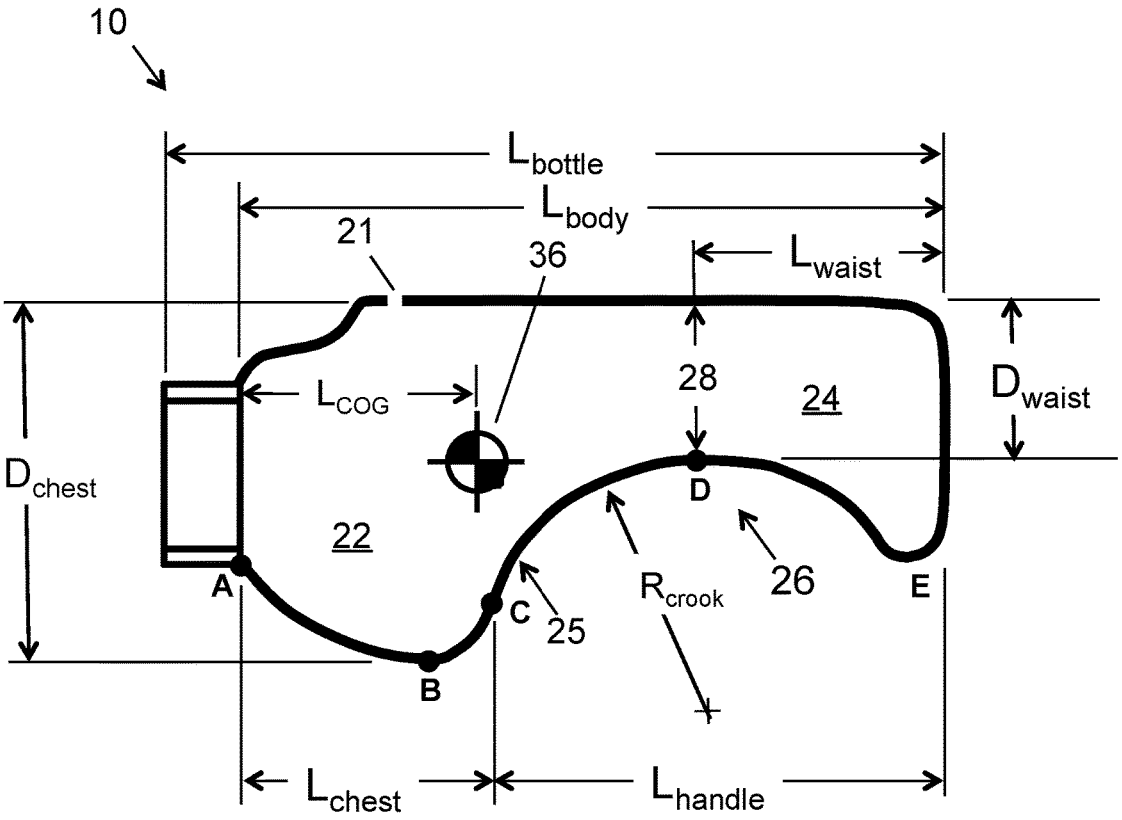
FIG. 3A shows a side view of the first example of a feeding bottle in a horizontal position, according to the present invention.

FIG. 3A shows a side view of the first example of a feeding bottle in a horizontal position, according to the present invention. The S-shaped curve, 25, defining the front side of bottle 10, comprises the collection of control points labeled A, B, C, D, and E. The enlarged (oversized) front chest 22 section of curve 25 is defined by the convex curve segment: A-B-C, whereas the front handle 24 section of curve 25 is defined by the concave curve segment: C-D-E. The point labeled "A" indicates the intersection between the S-shaped curve 25 and the neck 14 of bottle 10. The point labeled "B" indicated the proudest part of the chest section 22 (i.e., the part with the largest radial extent, as measured from the central longitudinal axis). The point labeled "C" is located at the inflection point of the S-shaped curve 25, defining the transition between convex and concave segments. The concave segment C-D-E also defines the recessed "crook" 26 of handle 24. The point labeled "D" indicates the thinnest cross-section of the bottle, i.e., at the "waist" 28. The point labeled "E" indicates the intersection of the S-shaped curve 25 with the base 18 of bottle 10.

FIG. 3A also shows the location of the Center of Gravity (COG) 36, which is located in the top (upper) ⅓ of the bottle's length, $L_{body}$, near neck 14. This makes the bottle "top heavy". Being "top heavy" makes for a more comfortable hand grip when holding the bottle, because the concentration of weight around the Center of Gravity causes the bottle to rest securely and comfortably in the palm of a hand. FIG. 3A also defines a number of important dimensions: $L_{COG}$ (length to Center of Gravity) $D_{chest}$ (diameter of chest section), $L_{body}$ (length of body), $L_{waist}$ (length to the waist), $D_{waist}$ (diameter of the waist), $L_{chest}$ (length of chest section), and $L_{handle}$ (length of handle section).

Figure 3B:
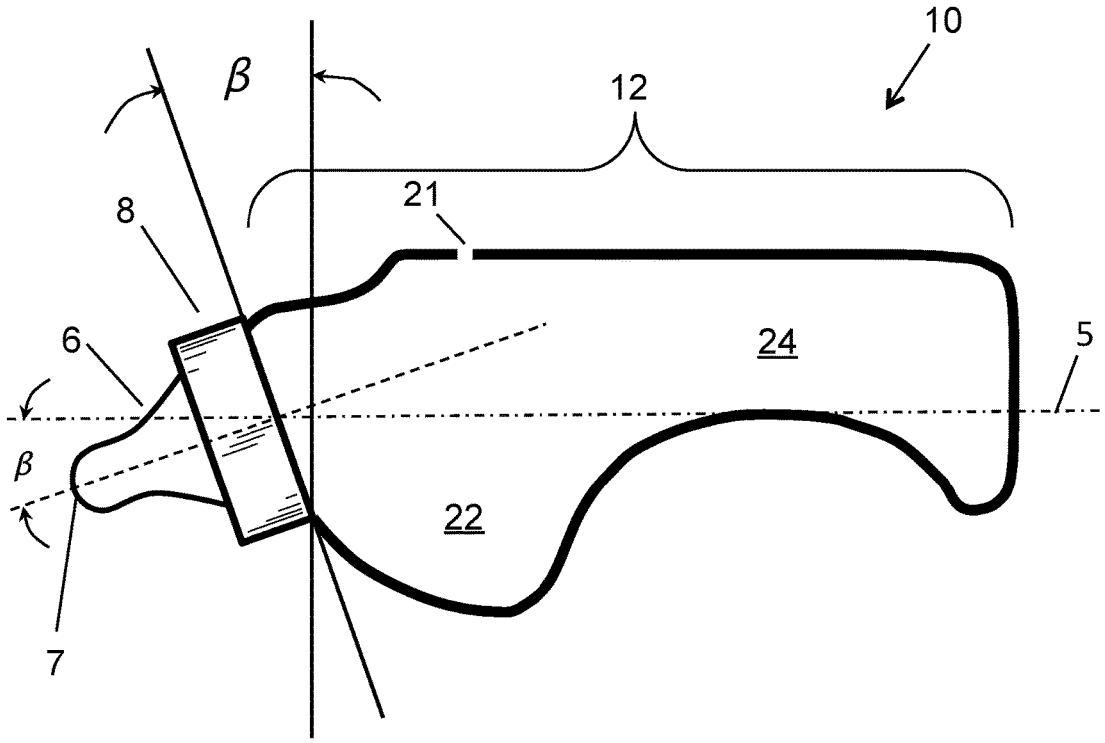
FIG. 3B shows a side view of another example of a feeding bottle in a horizontal position, according to the present invention.

FIG. 3B shows a side view of another example of a feeding bottle in a horizontal position, according to the present invention. In this example, the nipple 6 and nipple crown ring 8 are tilted down at an angle, β, with respect the longitudinal centerline. In the example shown in FIG. 3B, the angle β=−20°, but it can range from −0° to −90° (negative angles are used to indicate that the nipple is tilted downwards, not upwards as in some commercially available bottle). The purpose of tilting the nipple downwards is to help insure that the nipple resides in the infant's mouth at 90 degrees to the plane of the baby's lips. The angled nipple 6 and nipple crown 8 helps insure that an optimum feeding position will be obtained, because when using a nipple with a negative tilt angle, β, the body 12 of bottle 10 is optimally inclined at a smaller angle to the horizontal, which advantageously reduces the hydrostatic pressure at the nipple outlet.

Figure 3C:
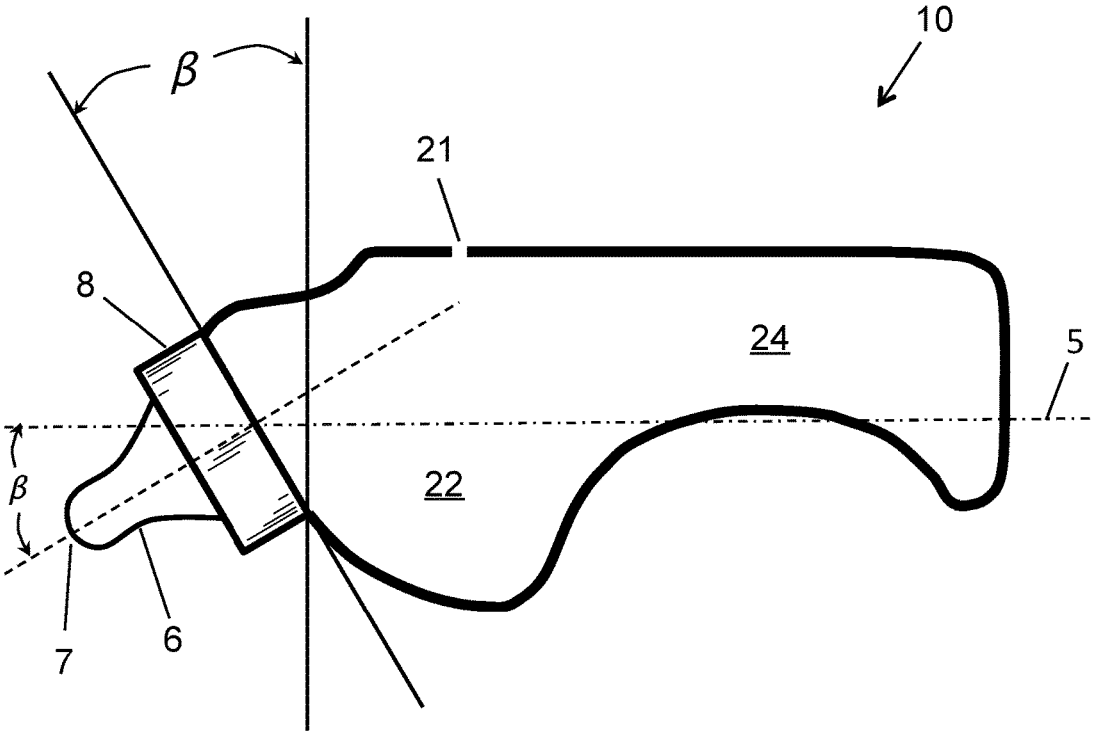
FIG. 3C shows a side view of another example of a feeding bottle in a horizontal position, according to the present invention.

FIG. 3C shows a side view of another example of a feeding bottle in a horizontal position, according to the present invention. In this example, the nipple angle β=−30°. A nipple angle of β=−30° would match a desirable angle for positioning the infant's head with respect to the horizontal (i.e. head/torso propped up at +30°), because the longitudinal axis of bottle 10 would then be horizontal in this case, and the nipple would be perpendicular to the plane of the lips.

Figure 3D:
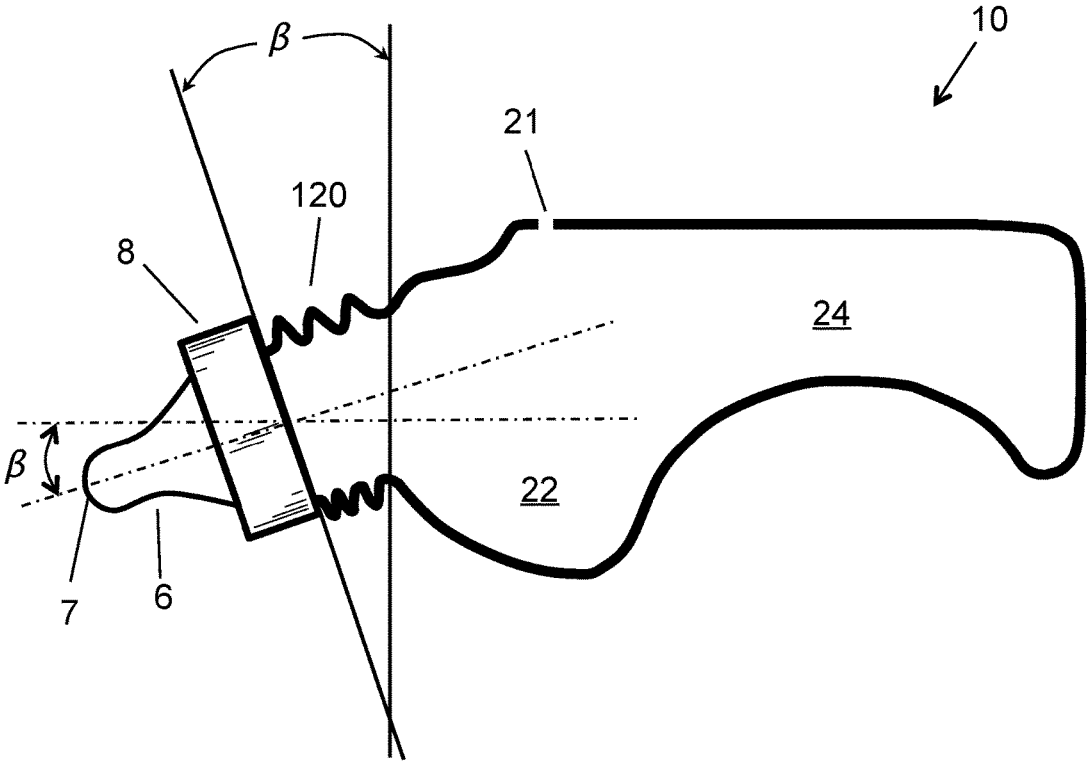
FIG. 3D shows a side view of another example of a feeding bottle in a horizontal position, according to the present invention.

FIG. 3D shows a side view of another example of a feeding bottle in a horizontal position, according to the present invention. In this example the neck section is corrugated with a bellows-type (accordion) of construction 120 that allows for the nipple 7 and nipple crown 8 to extend and rotate (i.e., articulate) as a spherical joint (i.e., 360°). The corrugations 120 can be made integral with the rest of the bottle 10, or, alternatively, corrugations 120 can be made as separate part (not illustrated) that screws or snaps onto rigid neck 14. Alternatively (not illustrated), the connection between the nipple 7 and bottle 10 can be made with an articulated ball-and-socket spherical joint, for example as used in the Loc-Line® type of articulated snap-fit-swivel fluid connection.

Figure 4A:
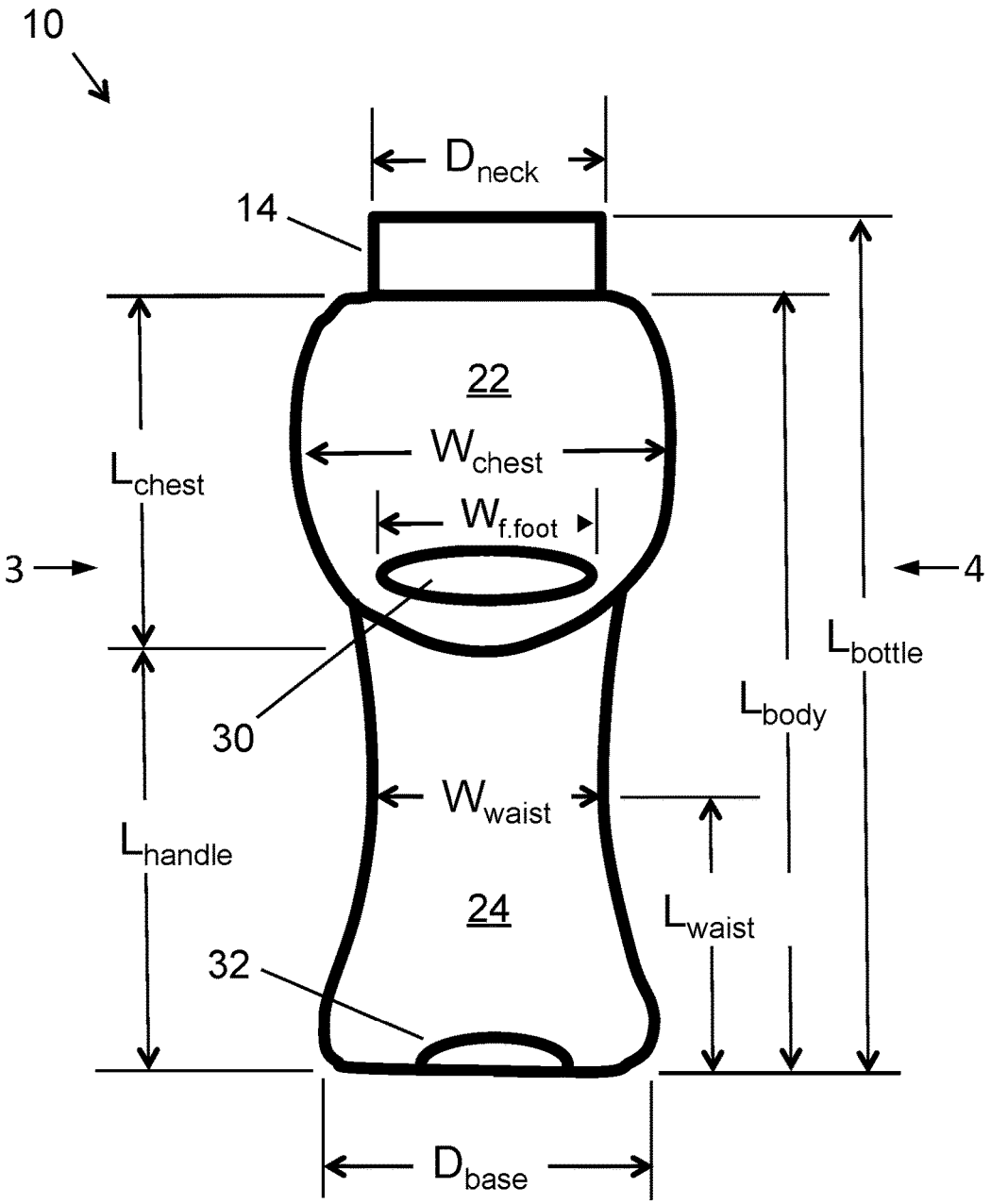
FIG. 4A shows a front view of the first example of a feeding bottle in a vertical position, according to the present invention.
Figure 5:
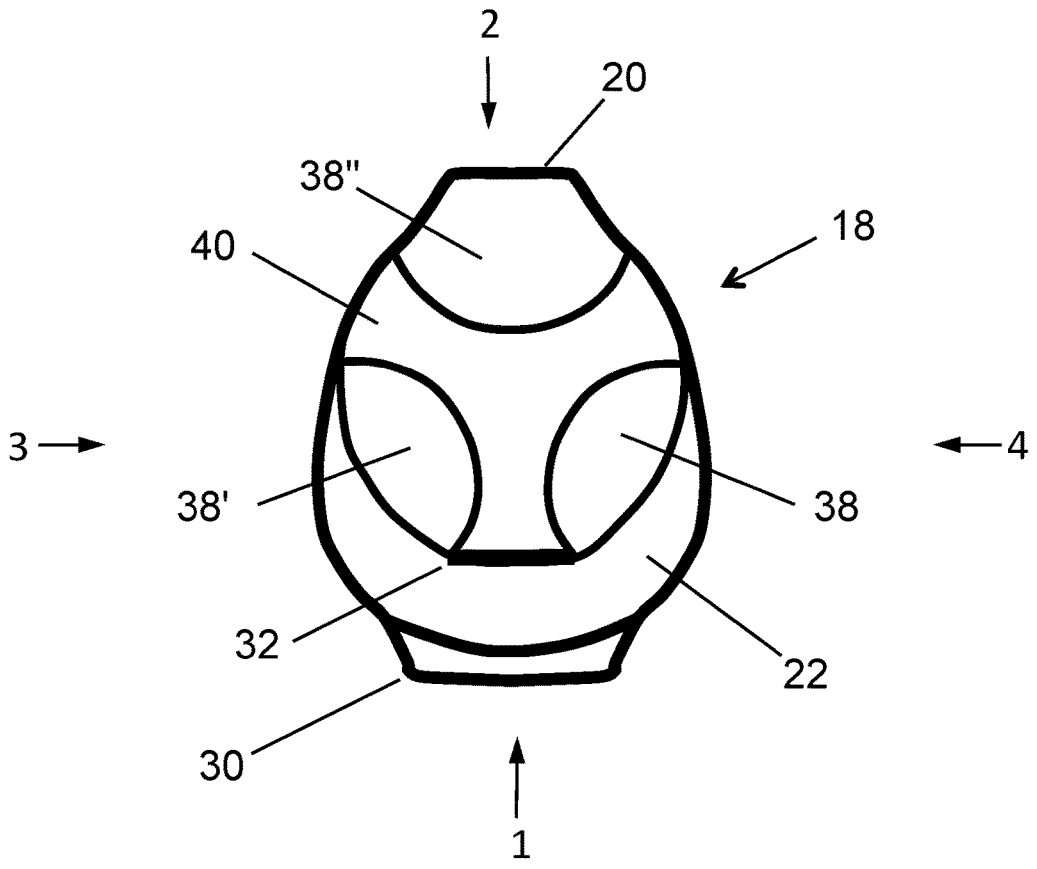
FIG. 5 shows a bottom end view of the first example of a feeding bottle in a horizontal position, according to the present invention.

FIG. 4A shows a front view of the first example of a feeding bottle in a vertical position, according to the present invention. Body 12 is divided into two sections: upper chest 22 and lower handle 24. Additional dimensions are defined as follows: $D_{neck}$ (diameter of circular neck), $W_{chest}$ (width of chest), $W_{f.foot}$ (width of front foot), $W_{waist}$ (width of waist). The chest and waist/handle cross-sections are non-circular, as will be shown later. Since the width of the waist, $W_{waist}$, is smaller than the width of the chest, $W_{chest}$, the bottle is top heavy, as mentioned before. Note: the width of the front foot, $W_{f.foot}$, needs to be sufficiently wide so as to provide two of the three points of contact spaced-apart sufficiently to make a stable tripod (three-point) support platform.

Figure 4B:
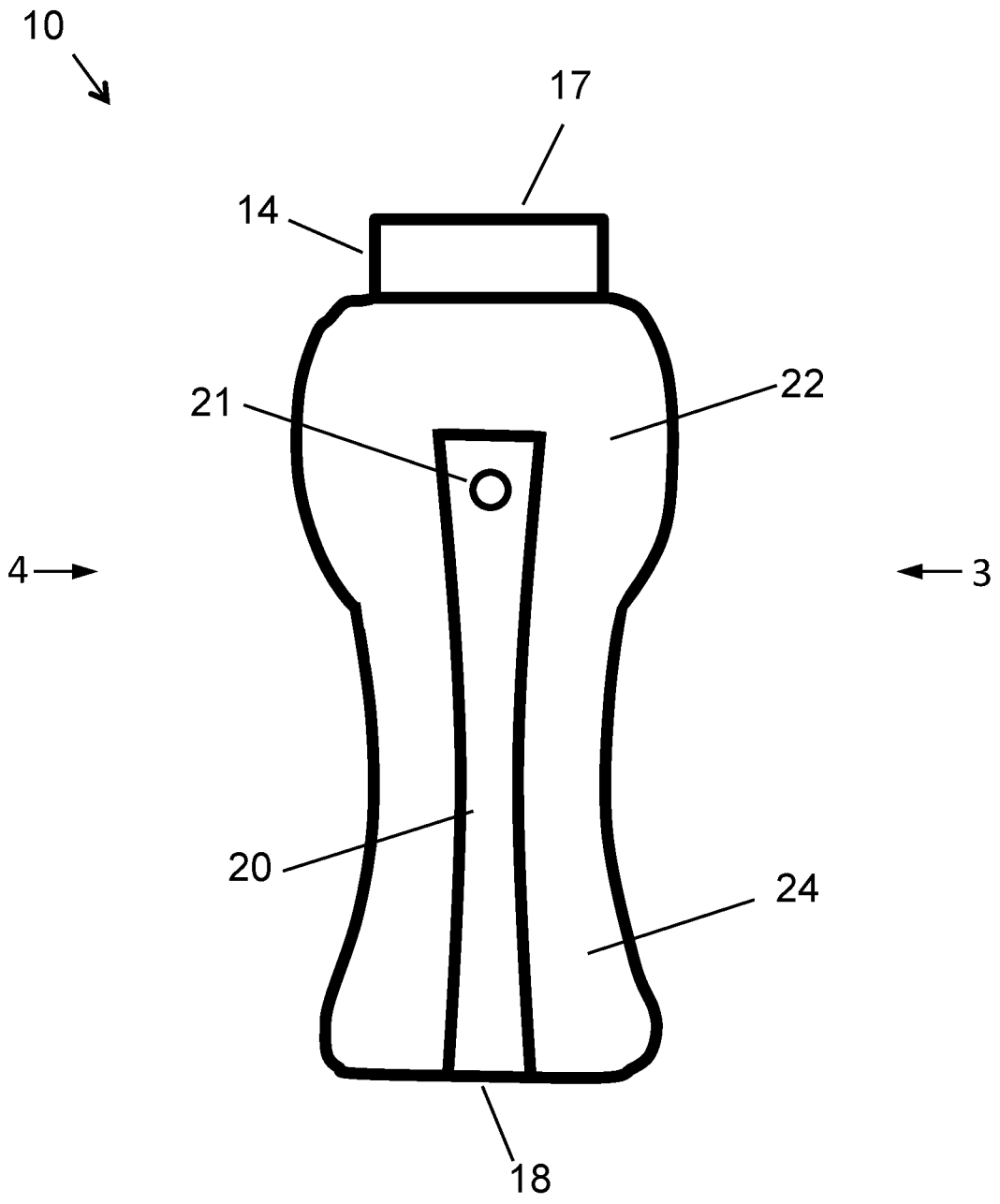
FIG. 4B shows a back view of the first example of a feeding bottle in a vertical position, according to the present invention.

FIG. 4B shows a back view of the first example of a feeding bottle in a vertical position, according to the present invention. The rear spine 20 and vent hole 21 can be seen. Rear spine 20 can be straight or curved.

FIG. 5 shows a bottom view of the first example of a feeding bottle in a horizontal position, according to the present invention. The bottom end (base 18) has three landing pads (support pads 38, 38', 38") spaced-apart 120 degrees in a triangular pattern. Recessed region 40 is located in the center of base 18, in-between the three support pads. Note: the centerline of base 18 (illustrated by the solid cross symbol) does not line up with the centerline of the chest section 22 (illustrated by the dashed cross symbol).

Figure 6A:
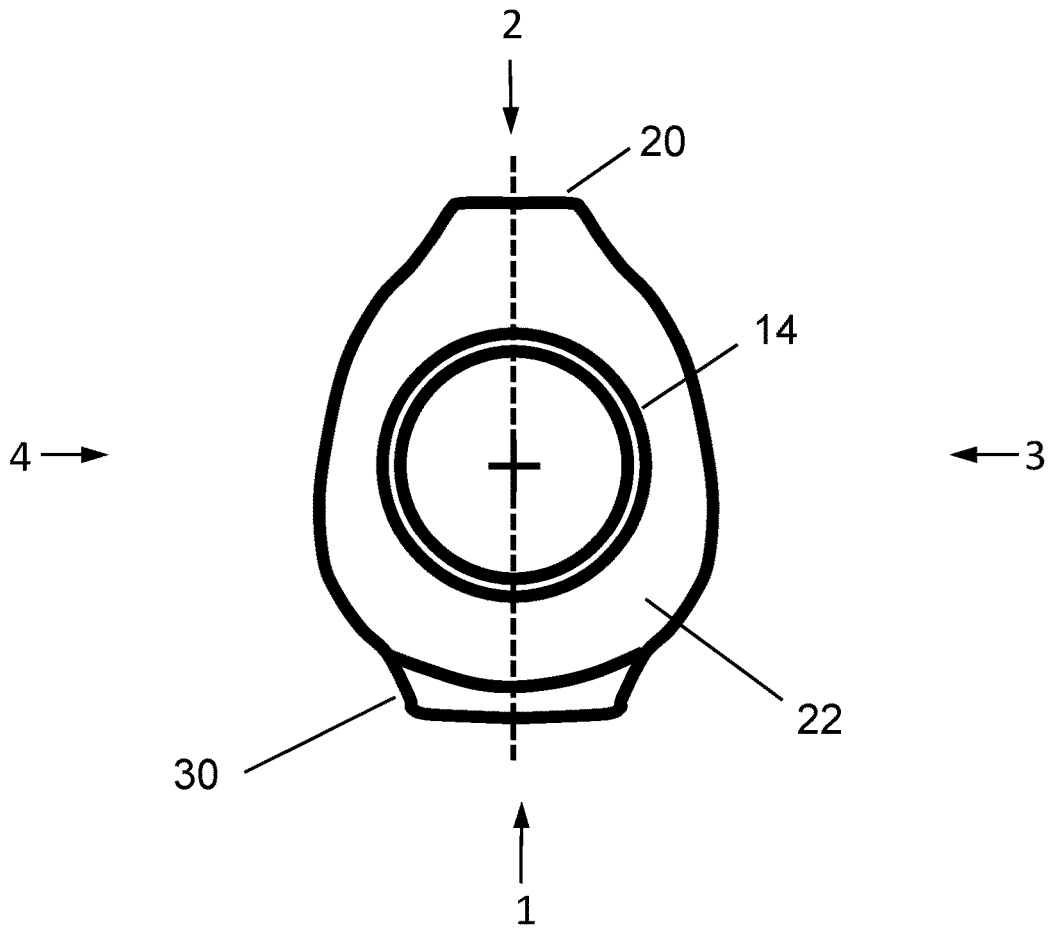
FIG. 6A shows a top end view of the first example of a feeding bottle in a horizontal position, according to the present invention.

FIG. 6A shows a top view of the first example of a feeding bottle in a horizontal position, according to the present invention. Neck 14 is circular. Note that the bottle's shape is asymmetric about the longitudinal axis; the only plane of symmetry is the plane of symmetry between the left and right halves of the bottle, as indicated by the dashed line in FIG. 6A.

Figure 6B:
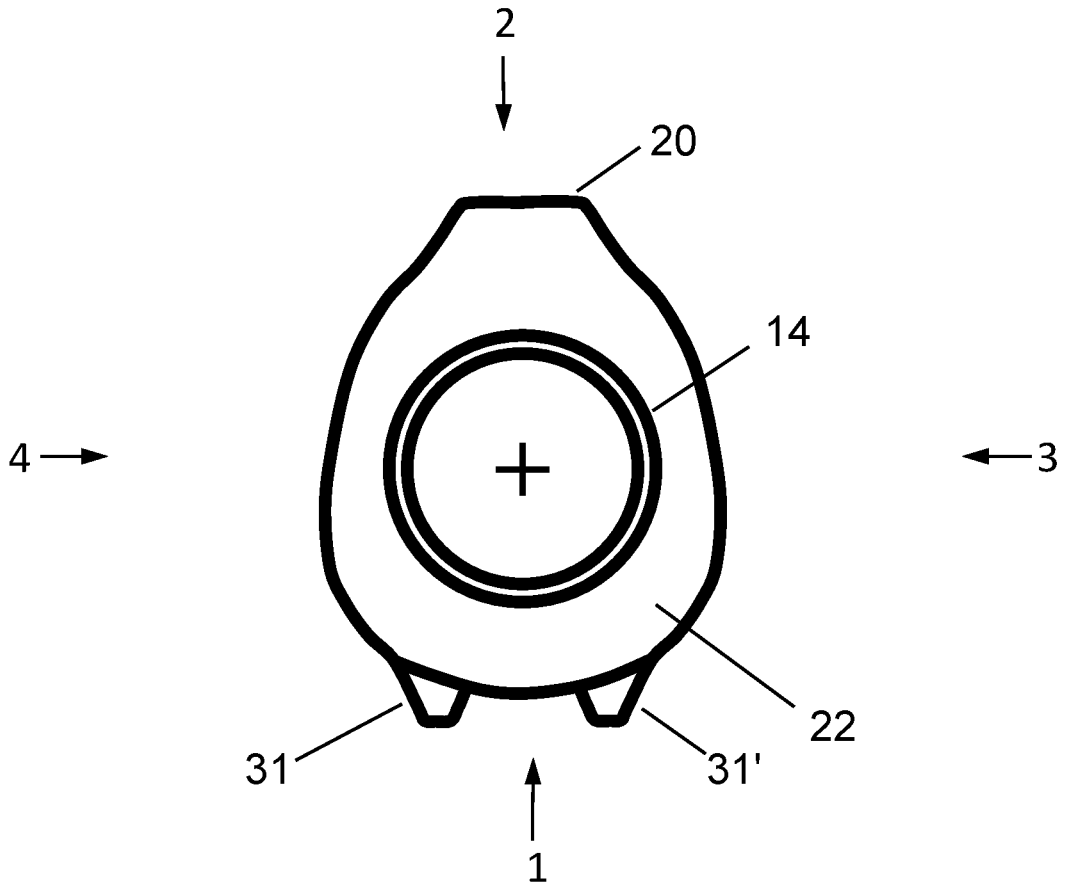
FIG. 6B shows a top end view of another example of a feeding bottle in a horizontal position, according to the present invention.

FIGS. 5 and 6A show the front foot 30 as comprising single, unified protruding bar running sideways across the front side of chest 22. Alternatively, as shown in FIG. 6B, the front foot (30) can comprise two individual protruding bumps 31 and 31'.

In some embodiments of the present invention (e.g., the first example shown in FIGS. 1-6), a variety of mathematical relationships (dimensional limitations) can be placed on these dimensions, relative to a common, reference dimension (i.e., $L_{body}$ or $D_{neck}$). These relationships (rules) include the following equations:

$$L_{COG} \leq \tfrac{1}{3} \times L_{body} \quad \text{Eq. (1)},$$

$$L_{chest} \geq \tfrac{1}{3} \times L_{body} \quad \text{Eq. (2)},$$

$$W_{chest} \geq \tfrac{1}{2} \times L_{body} \quad \text{Eq. (3)},$$

$$L_{handle} \leq \tfrac{2}{3} \times L_{body} \quad \text{Eq. (4)},$$

$$L_{waist} \leq \tfrac{1}{3} \times L_{body} \quad \text{Eq. (5)},$$

$$L_{waist} \leq \tfrac{1}{2} \times L_{handle} \quad \text{Eq. (6)},$$

$$W_{waist} \leq \tfrac{1}{2} \times L_{body} \quad \text{Eq. (7)},$$

$$W_{chest} \geq 1.5 \times W_{waist} \quad \text{Eq. (8)},$$

$$L_{chest} \geq \tfrac{1}{2} \times L_{handle} \quad \text{Eq. (9)},$$

$$W_{chest} \geq 1.7 \times D_{neck} \quad \text{Eq. (10)},$$

$$W_{f.foot} \geq \tfrac{1}{2} \times W_{chest} \quad \text{Eq. (11)},$$

$$W_{waist} \leq \tfrac{1}{2} \times L_{body} \quad \text{Eq. (12)},$$

$$W_{chest} \geq \tfrac{1}{2} \times L_{body} \quad \text{Eq. (13)},$$

$$R_{crook} \leq \tfrac{1}{2} \times L_{body} \quad \text{Eq. (14)}.$$

In one particular embodiment of the present invention, the specified liquid volume is 4 Oz, the length of body 12, $L_{body}$=12 cm, and the neck diameter, $D_{neck}$=3.5 cm. Using these values, applying equations (1-14) gives the following length restrictions:

$$L_{COG} \leq 4 \text{ cm} \quad \text{Eq. (1A)},$$

$$L_{chest} \geq 4 \text{ cm} \quad \text{Eq. (2A)},$$

$$W_{chest} \geq 6 \text{ cm} \quad \text{Eq. (3A)},$$

$$L_{handle} \leq 8 \text{ cm} \quad \text{Eq. (4A)},$$

$$L_{waist} \leq 4 \text{ cm} \quad \text{Eq. (5A)},$$

$$L_{waist} \leq 4 \text{ cm} \quad \text{Eq. (6A)},$$

$$W_{waist} \leq 4 \text{ cm} \quad \text{Eq. (7A)},$$

$W_{chest} \geq 6$ cm Eq. (8A), $L_{chest} \geq 4$ cm Eq. (9A), $W_{chest} \geq 6$ cm Eq. (10A), $W_{f.foot} \geq 3$ cm Eq. (11A), $W_{waist} \leq 4$ cm Eq. (12A), $W_{chest} \geq 6$ cm Eq. (13A), $R_{crook} \leq 4$ cm Eq. (14A).

Some of the equations give similar results for the dimensions, as would be expected, given the interrelationships between certain variables. Note also that the prototype bottle presented later in FIGS. 15-21 has dimensions that follow the rules in Eqs. (1-14) and length restrictions in Eqs. (1A-14A)

Figure 7:
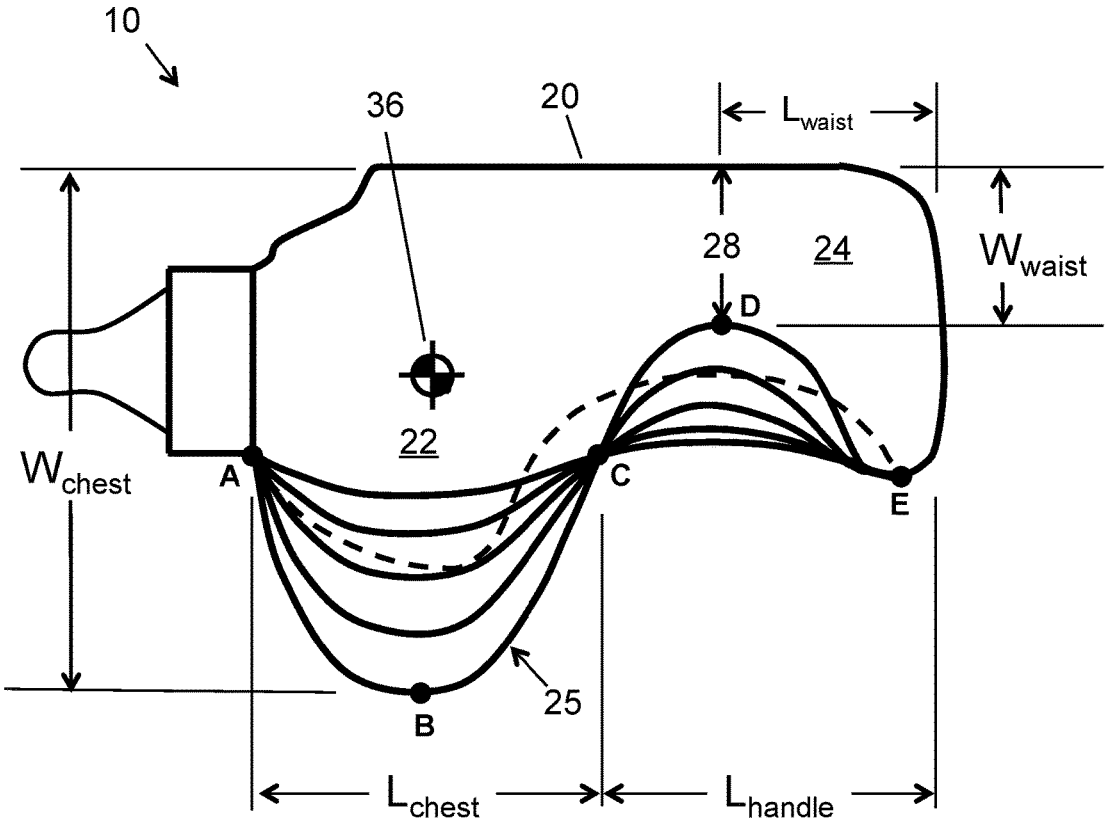
FIG. 7 shows a side view of an example of a feeding bottle in a horizontal position, illustrating a family of different S-shaped curves, according to the present invention.
Figure 8:
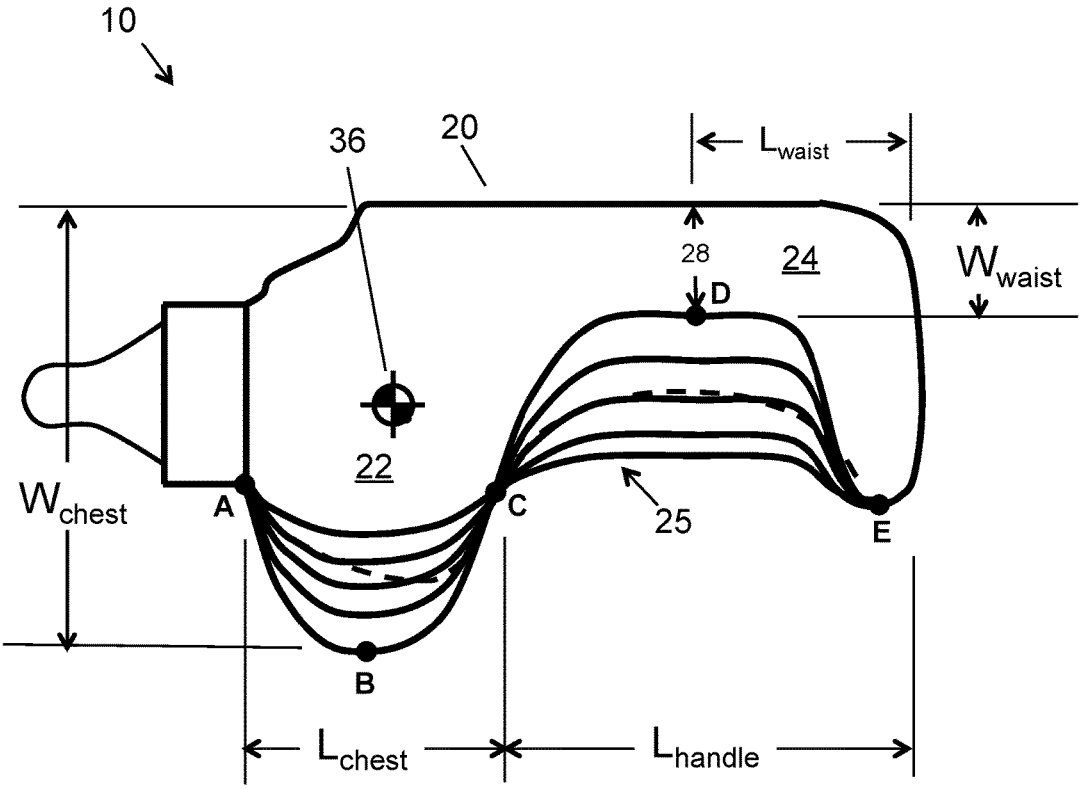
FIG. 8 shows a side view of an example of a feeding bottle in a horizontal position, illustrating a family of different S-shaped curves, according to the present invention.
Figure 9:
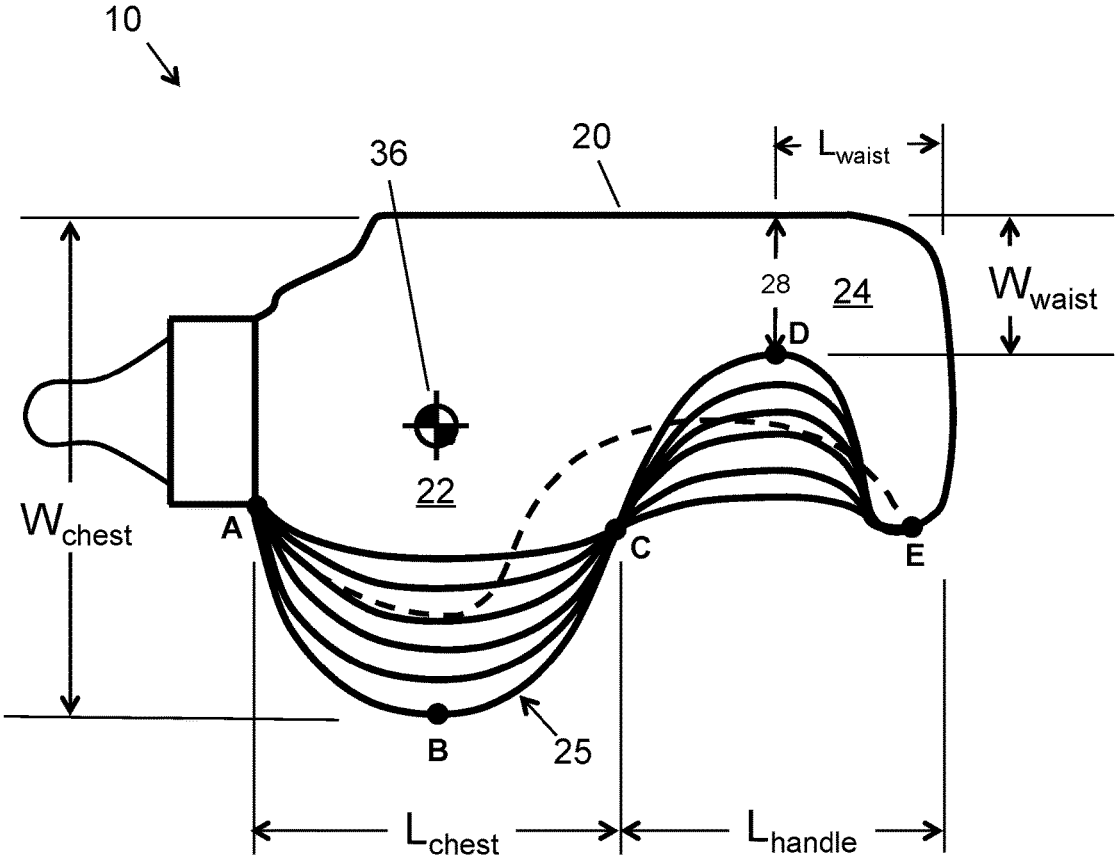
FIG. 9 shows a side view of an example of a feeding bottle in a horizontal position, illustrating a family of different S-shaped curves, according to the present invention.

FIGS. 7, 8, and 9 show a side view of other examples of ergonomic feeding bottles in a horizontal position, illustrating a family of different, but similar, S-shaped curves, according to the present invention. Any of these different, but self-similar S-shaped curves 25 can be used with any bottle of the present invention. They all satisfy the requirement for having an enlarged, oversized, generally spherically/ellipsoidally shaped chest 22 (belly), and a narrow handle section 24 with a thin waist 28, combining to create a top heavy bottle 10 with a center of gravity 36 located within the upper ⅓ of the bottle 10, i.e., $L_{COG} \leq \frac{1}{3} \times L_{body}$ Eq. (1)

For comparison purposes, the S-shaped curve 25 used in FIG. 3 is superimposed as a dashed line onto the families of self-similar curves in FIGS. 7, 8, and 9. The curves in FIG. 7 generally have a larger chest length, $L_{chest}$, compared to the reference curve from FIG. 3, and different widths of chest and waist. The curves in FIG. 8 generally have similar lengths of chest and handle compared to the reference curve from FIG. 3, but have different widths of chest and waist. The curves in FIG. 9 generally have a longer chest length, $L_{chest}$, compared to the reference curve from FIG. 3, and different widths of chest and waist. In all of the three Figures, FIGS. 7, 8, and 9, the back sidewall, 20, comprises a substantially straight wall segment. Note that the same dimensional limitations (i.e., Equations 1-14) can be applied to these three families of curves, in some embodiments of the present invention.

Note also that different combinations of curves within one Figure can be used. For example, in FIG. 7, the deep chest curve section 22 can be combined with a shallow handle curve section 24. Alternatively, the deep chest curve section 22 could be combined with a deep handle curve section 24. Alternatively, a shallow chest curve section 22 could be combined with a deep handle curve section 24. And, a shallow chest curve section 22 could be combined with a shallow handle curve section 24. The same combinations and permutations apply equally well to the families shown in FIGS. 8 and 9.

Prototype Feeding Bottle

A prototype feeding bottle was made from a 3-D SolidWorks CAD model by blow molding of BPA-free polypropylene plastic. The thickness of the sidewall is varies from 1-2 mm, depending on the location. Other BPA-free plastics can be used, as is well known in the art.

Figure 10:
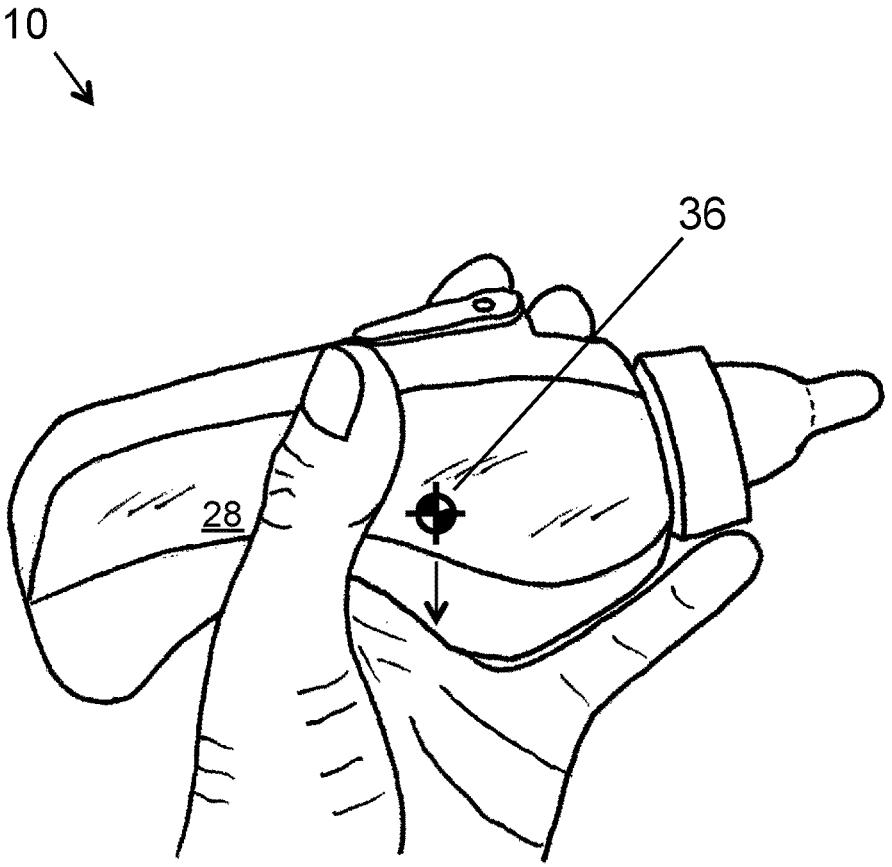
FIG. 10 shows a perspective schematic view of a prototype feeding bottle held in a relaxed position by a left hand using an open grip, according to the present invention.

FIG. 10 shows a perspective schematic view of an actual, full-size 4 OZ prototype feeding bottle held in a comfortable, relaxed position by an open grip left hand, according to the present invention. As can be seen, the oversized chest section holds the bulk of the liquid in a generally spherically-shaped volume, with the center of gravity resting over the palm of the hand. This means that the hand can be relaxed (due to the open grip) and the bottle won't slide or fall off the back of the hand. This aids in reducing the caregiver's hand fatigue, because the bottle rests stably in the open palm without requiring a tight pinch grip.

Figure 11:
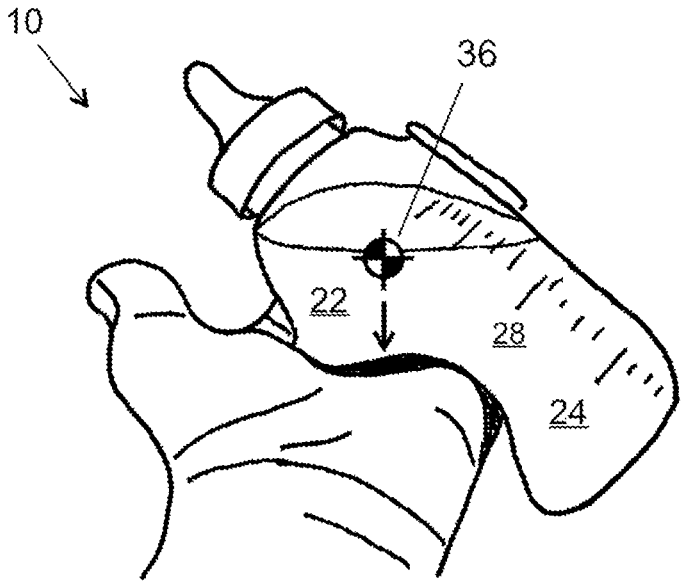
FIG. 11 shows a perspective schematic view of the prototype feeding bottle resting unaided in a stable position on an open palm of the left hand, according to the present invention.

FIG. 11 shows a perspective schematic view of an actual, full-size 4 OZ prototype feeding bottle resting unaided in a stable position on an open palm of the left hand, according to the present invention. This is possible because the center of gravity sits over the open palm of the hand. A standard bottle that has a center of gravity further down the length of the bottle (and no oversized chest volume) would slide off of an open palm (thereby failing the "palm test").

Figure 12:
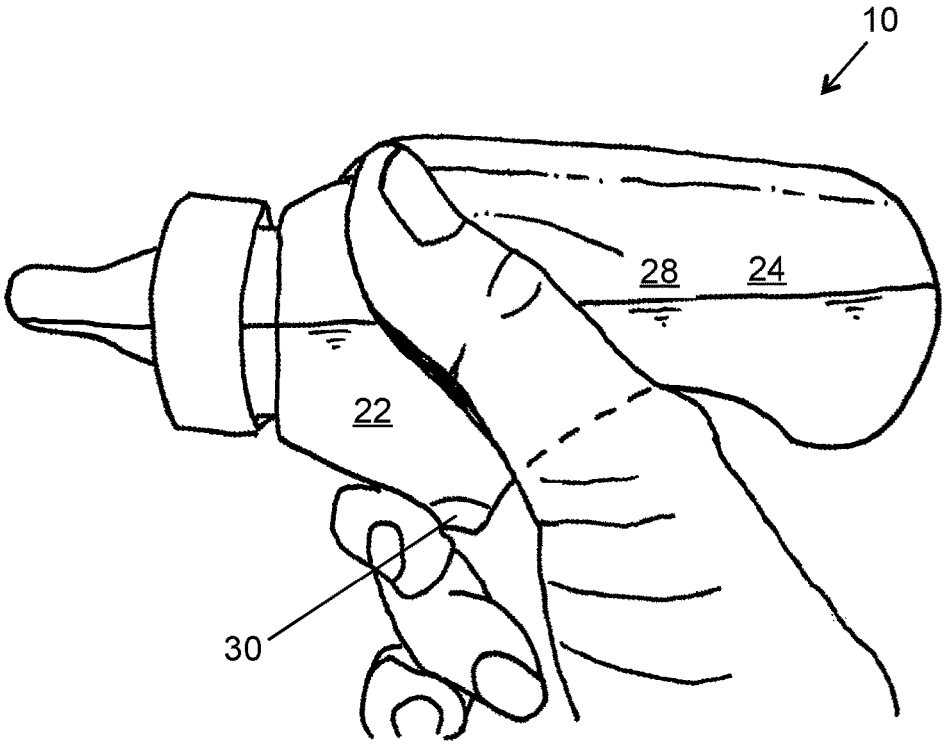
FIG. 12 shows a perspective schematic view of the prototype feeding bottle held in a secure position by a right hand using a tripod grip, according to the present invention.

FIG. 12 shows a perspective schematic view of the prototype feeding bottle held in a secure grip by a right hand using a tripod (pinch/"gun style") grip, according to the present invention. The thumb and first finger rest securely in the recessed nooks (see recesses 46 and 47 in FIGS. 15 and 18). Note: in FIG. 13, the second finger of the left hand is curled around the chest region 22 and the tip of the second finger rests against the front foot 30 as a support/stop.

Figure 13:
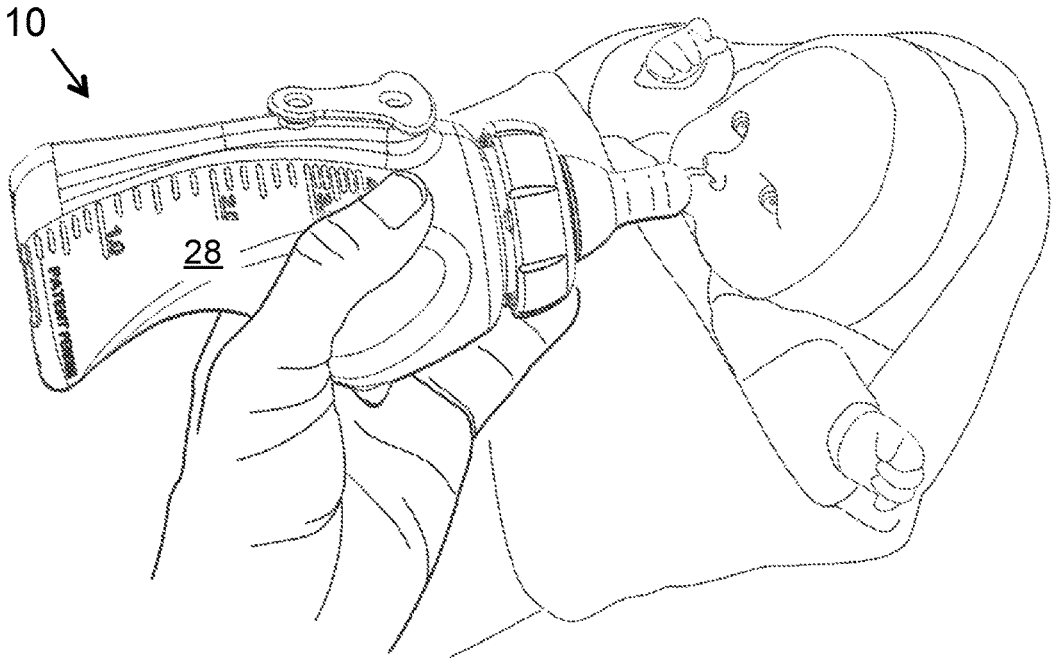
FIG. 13 shows a perspective schematic view of the prototype feeding bottle held in a comfortable position by a left hand using an open grip, according to the present invention.
Figure 14:
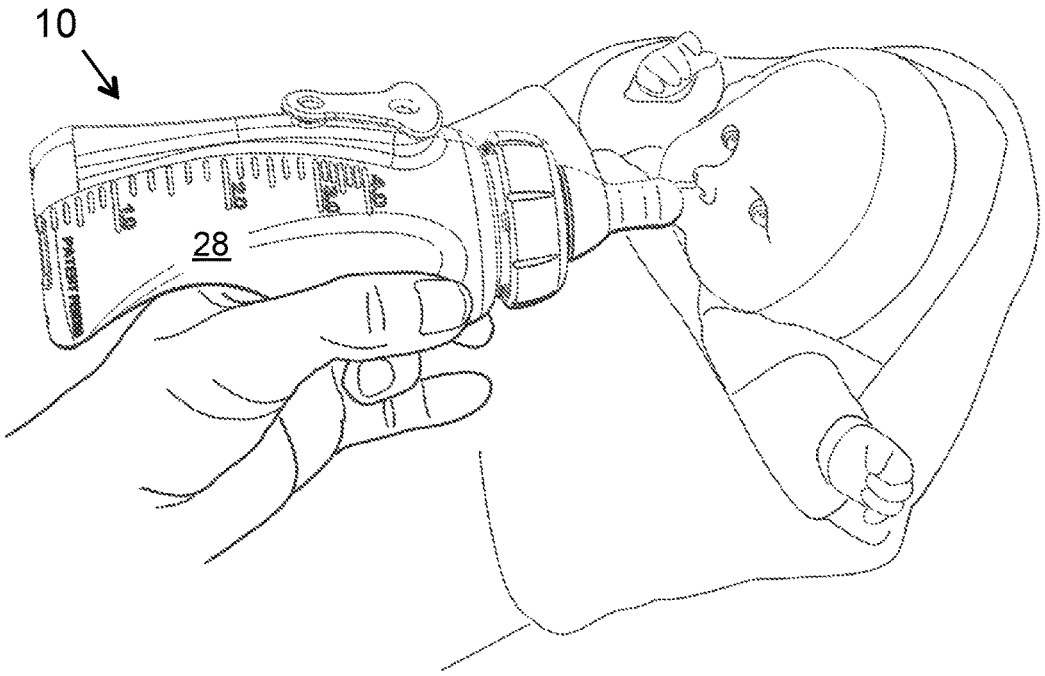
FIG. 14 shows a perspective schematic view of the prototype feeding bottle held in a comfortable position by a left hand using a pinch grip, supported by the $2^{nd}$ and $3^{rd}$ fingers, according to the present invention.

FIGS. 10, 13 and 14 show very well how effective the narrow waist 28 (i.e., crook 26) of handle 24 fits and locks into the crook of the caregiver's supporting hand, which makes holding the ergonomic feeding bottle 10 more comfortable and relaxed, as compared to conventional feeding bottles. These figures also show how effective the oversized chest region (with top heavy center of gravity) is for providing a bottle that rests securely in a palm without requiring a tight grip.

FIG. 13 shows a perspective schematic view of the prototype feeding bottle held in a comfortable position by a left hand using an open grip, according to the present invention.

FIG. 14 shows a perspective schematic view of the prototype feeding bottle held in a comfortable position by a left hand using a pinch grip, supported by the $2^{nd}$ and $3^{rd}$ fingers, according to the present invention.

Figure 15:
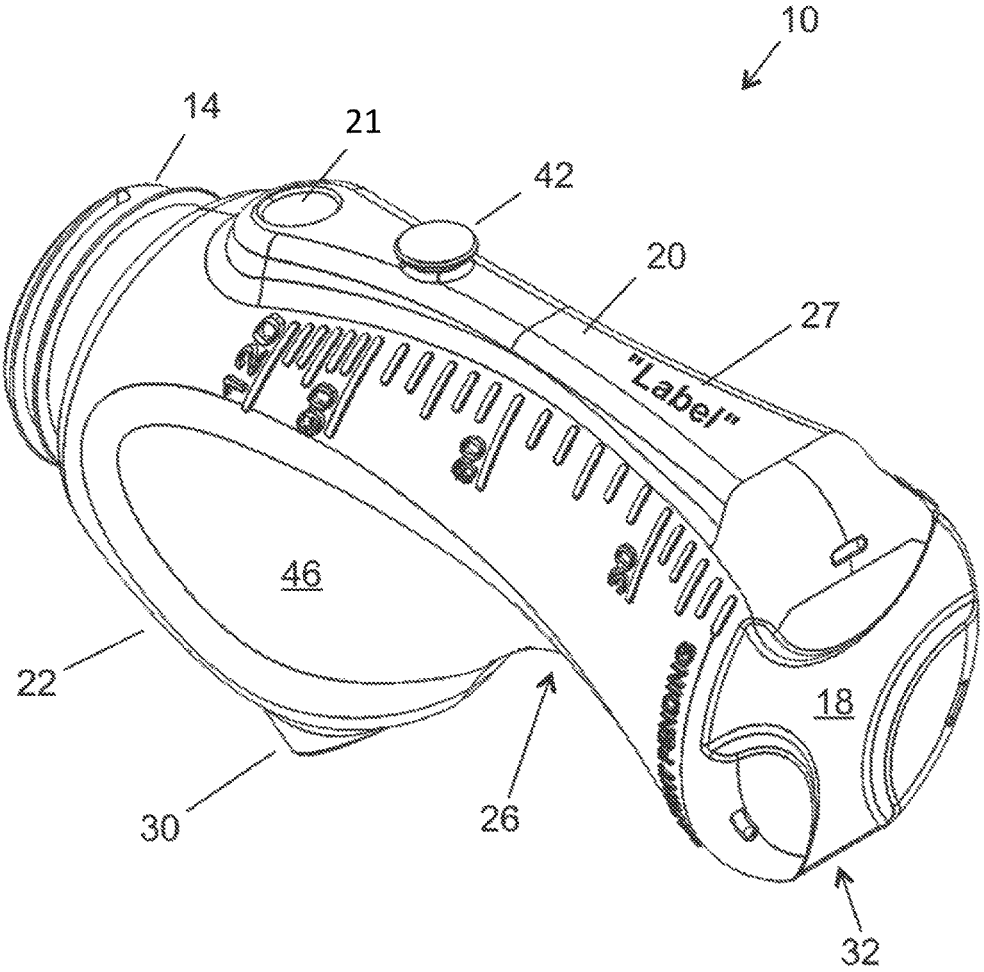
FIG. 15 shows an isometric side/end view of the prototype feeding bottle in a horizontal position, according to the present invention.

FIG. 15 shows an isometric side/end view of the prototype feeding bottle in a horizontal position, according to the present invention. Bottle 10 comprises body 12 and neck 14. Chest 22 comprises a first recessed nook 46 for locating a finger or thumb of the supporting hand (the second recessed nook 47 is hidden on the far side). The concave, recessed curve of crook 26 can be seen. The prototype bottle 10 further comprises anti-roll front foot 30 and rear foot 32 for preventing rolling of the bottle when resting sideways on a table-top. On the back side of the spine 20 is a substantially flat section on the lower half that can receive a hand-written or self-stick label 27 for accepting written information, such as the date or patient's name, type of fluid, etc. Alternatively, the flat section 20 itself can be written directly onto. The forward part of back spine 20 comprises a vent hole 21 for equalizing pressures between the inside and outside of the bottle 10. Vent hole 21 is configured with a recessed well 66 (not shown) for receiving and holding an anti-vacuum valve 50 (not illustrated in this view). Back spine 20 further comprises a raised, mushroom-shaped, attachment button 42 (anchor) for holding a tethered leash connected to the anti-vacuum valve 50; or for connecting to an attachment tab 56 of the anti-vacuum valve 50 (see FIG. 22).

Figure 16:
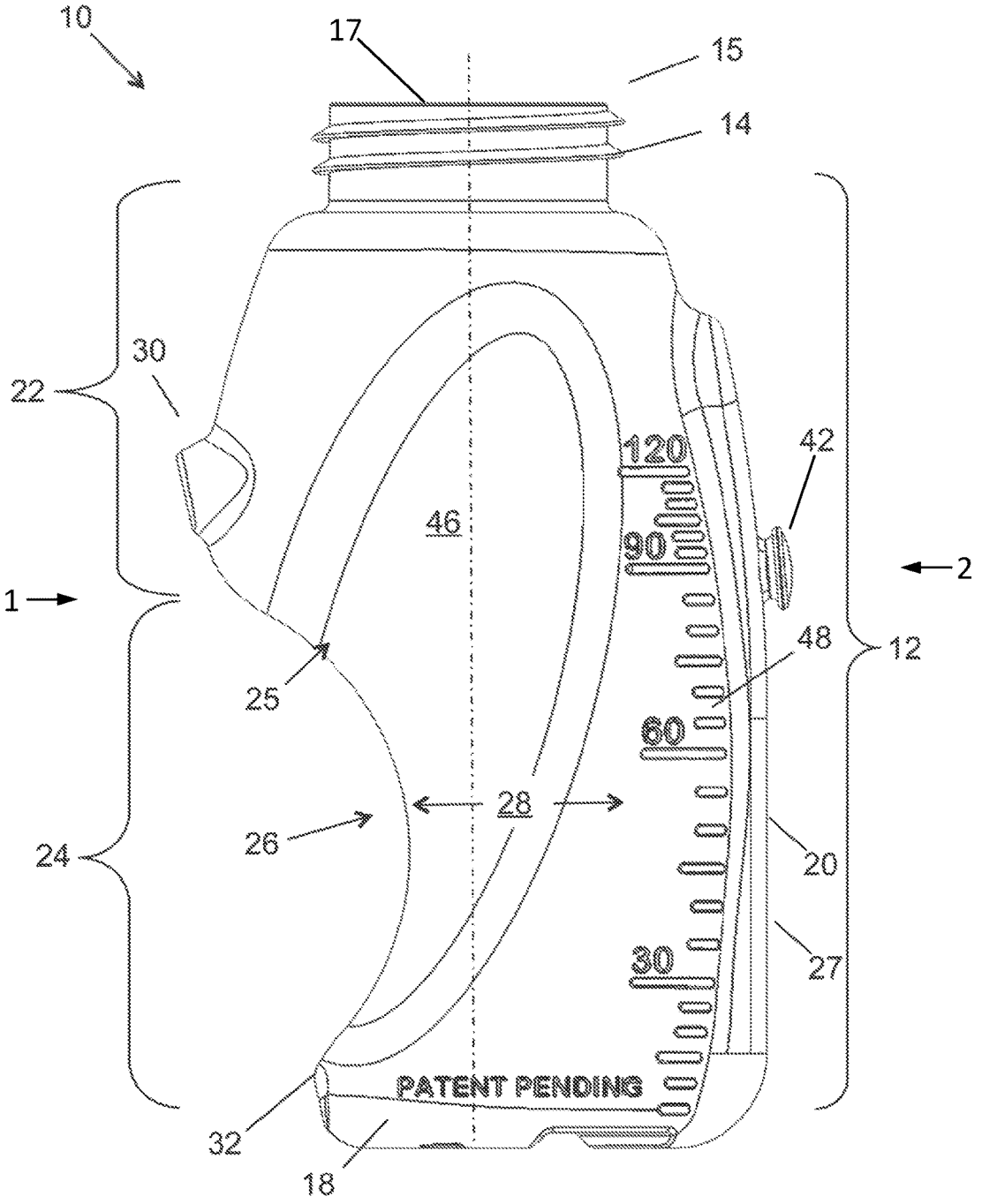
FIG. 16 shows a left-sided view of the prototype feeding bottle in a vertical position, according to the present invention.

FIG. 16 shows a right-sided view of the prototype feeding bottle in a vertical position, according to the present invention. Body 12 comprises forward chest 22 and rear handle 24. The side profile of the raised button 42 on back spine 20 can be seen. Also, in this view, a graduated scale 48 comprising a series of raised and/or colored marks (bumps, lines) indicates the volume of liquid remaining in the bottle 10 (calibrated in ml, from 30, 60, 90, to 120 ml.) when the bottle is resting vertically on a table-top or held in a vertical position. The S-shaped curve 25 defining the outer extent of the oversized, convex chest region 22 and the recessed, concave crook region 26 can be seen. Note that the bottle's shape is asymmetric about its central longitudinal axis; this is because the front side of the bottle comprises the S-shaped curve 25, while the opposing back side of the bottle comprises a substantially flat spine segment 20. Recessed finger nook 46, and front foot 30 and rear foot 32 can be seen in this Figure.

Figure 17:
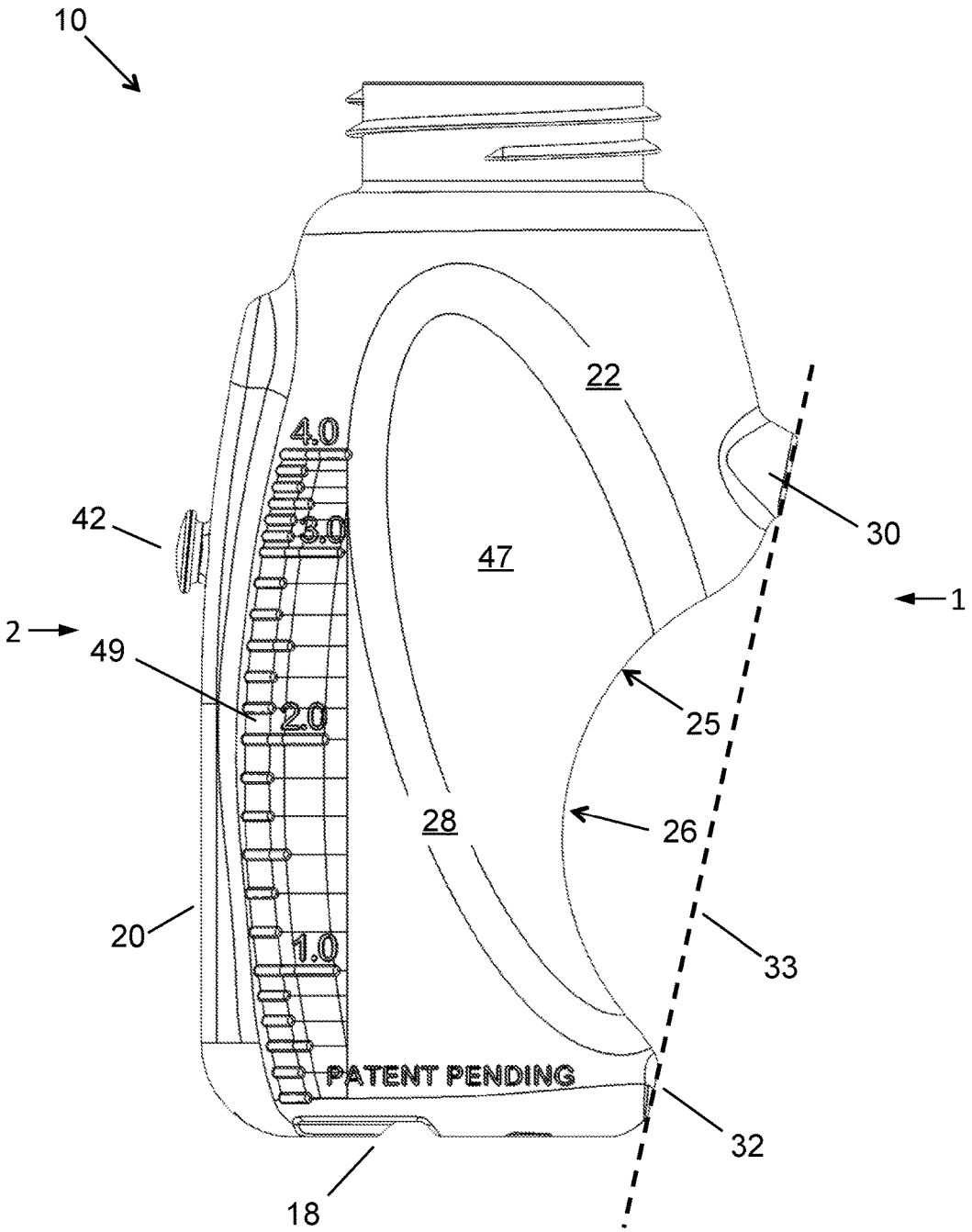
FIG. 17 shows a right-sided view of the prototype feeding bottle in a vertical position, according to the present invention.

FIG. 17 shows a left-sided view of the prototype feeding bottle in a vertical position, according to the present invention. In this view, a graduated scale 49 comprising a series of raised marks (bumps, lines) indicates the volume of liquid remaining in the bottle 10 (calibrated in Oz., from 1, 2, 3, to 4 Oz.) when the bottle is resting vertically on a table top or held in a vertical position. Also, a dashed line 33 has been drawn parallel to the bottom surfaces of the two anti-roll pads (front foot 30 and rear foot 32), indicating that the contacting surfaces of the two anti-roll pads 30 and 32 (i.e., the surfaces of the bottle 10 that contact the surface of a horizontal table-top when the bottle is placed substantially horizontally on a table-top) are parallel and co-planer to each other.

Figure 18:
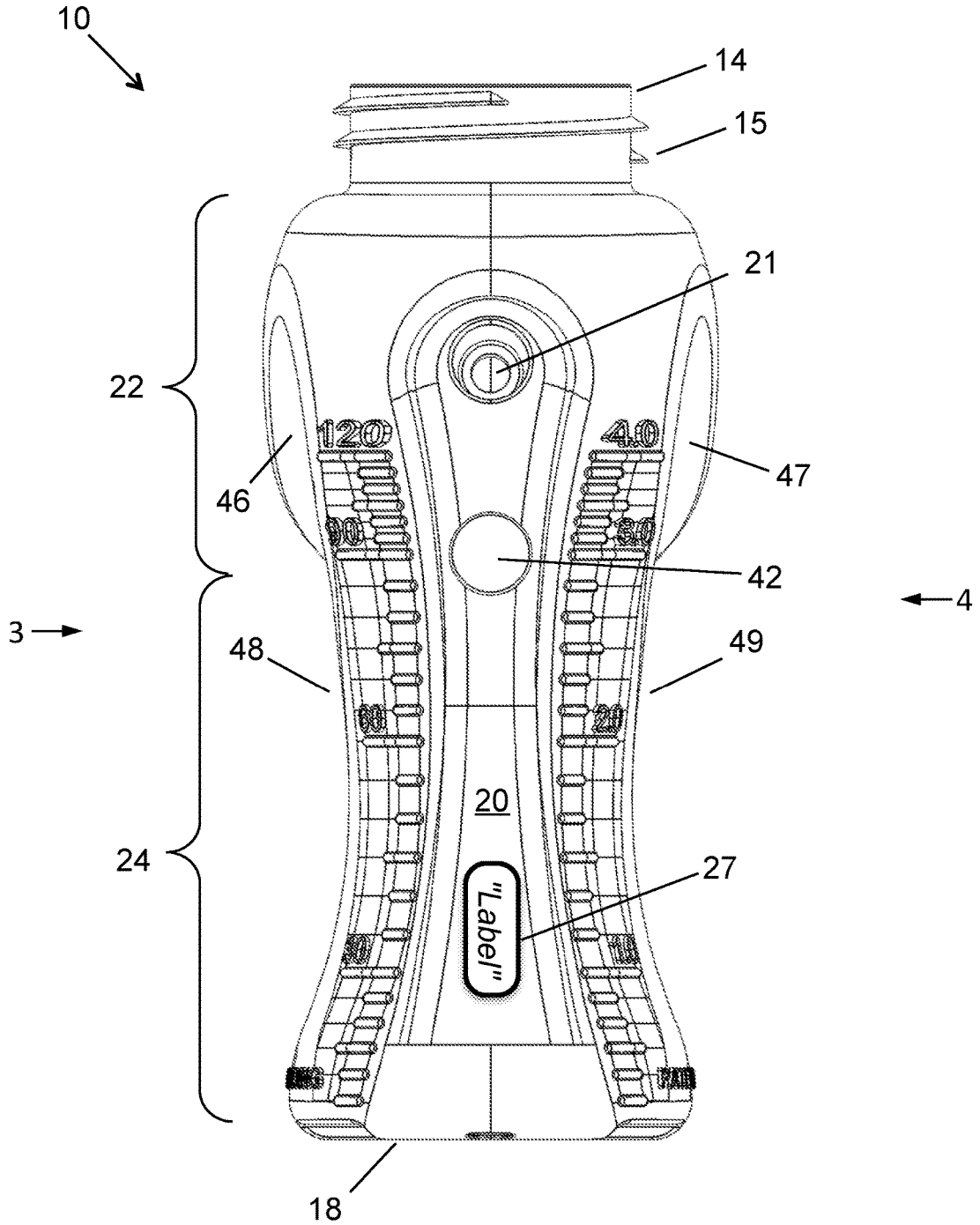
FIG. 18 shows a back-side view of the prototype feeding bottle in a vertical position, according to the present invention.

FIG. 18 shows a back side view of the prototype feeding bottle in a vertical position, according to the present invention. From this view, the anti-vacuum vent hole 21 can be seen, as well as the attachment button 42. Both of the two types of graduated volumetric scales (metric and English units), 48 and 49, are shown. An example of a label 27 ("Label") is shown, printed on a self-sticking label attached to the flat back spine 20. Alternatively, writing can be applied directly onto the back spine 20 with water-proof ink, depending on the type of plastic used for the bottle. Both left and right recessed nooks, 46 and 47, are shown in this view.

Figure 19:
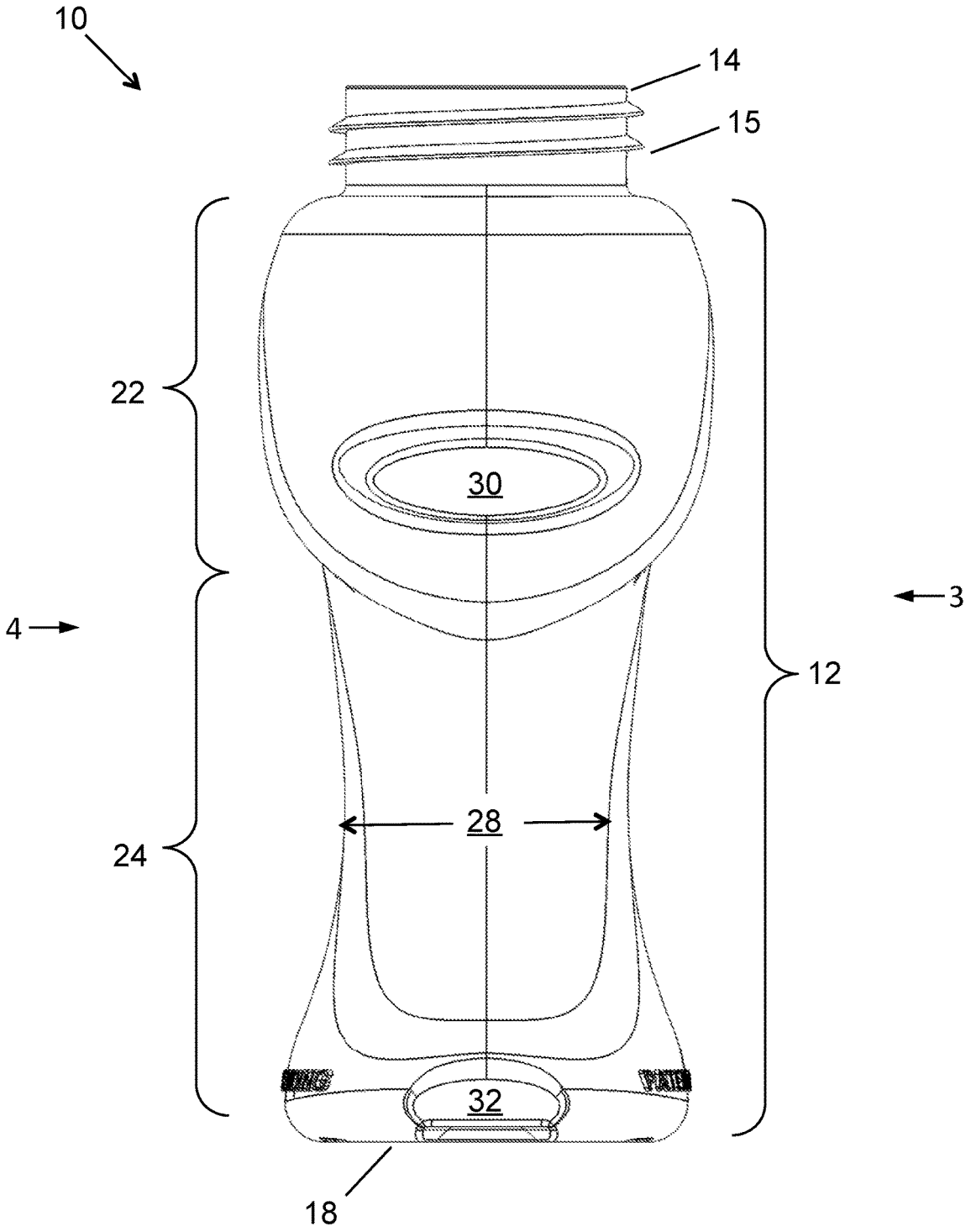
FIG. 19 shows a front side view of the prototype feeding bottle in a vertical position, according to the present invention.

FIG. 19 shows a front side view of the prototype feeding bottle in a vertical position, according to the present invention. Body 12 comprises an oversized chest section 22 and a narrow handle section 24. Front foot 30 and rear foot 32 are shown, which comprise oval-shaped protrusions sticking outwards from the bottle's surface. As can be seen, chest 22 is considerably wider than waist 28.

Figure 20:
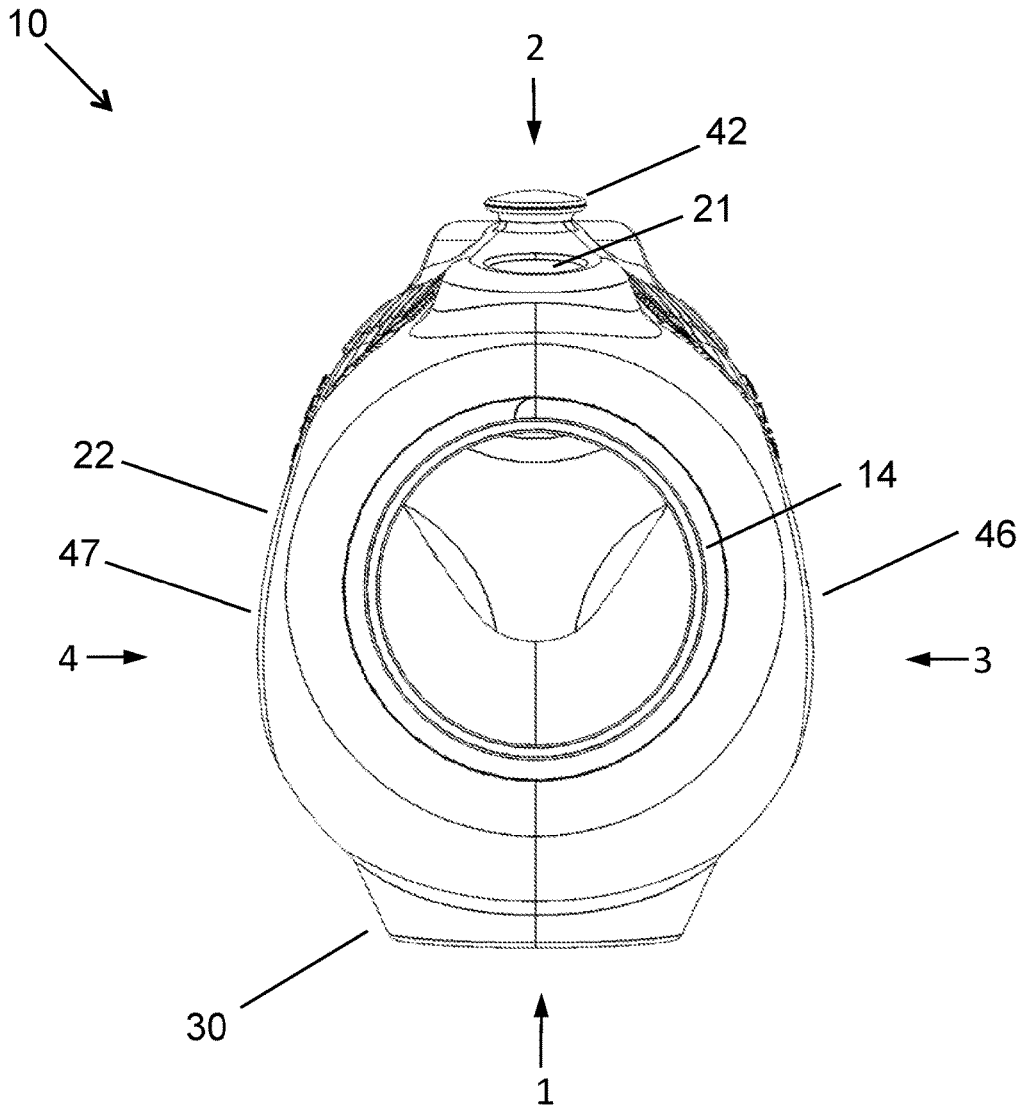
FIG. 20 shows a top end view of the prototype feeding bottle in a horizontal position, according to the present invention.

FIG. 20 shows a top (near) end view of the prototype feeding bottle in a horizontal position, according to the present invention. Vent hole 21 and raised button 42 can be seen, as well as the front foot 30. Front foot 30 is sufficiently wide so as to prevent the bottle 10 from rolling when placed on a horizontal surface, such as a table top, even when filled with liquid. The solid line down the middle indicates the left/right plane of symmetry.

Figure 21:
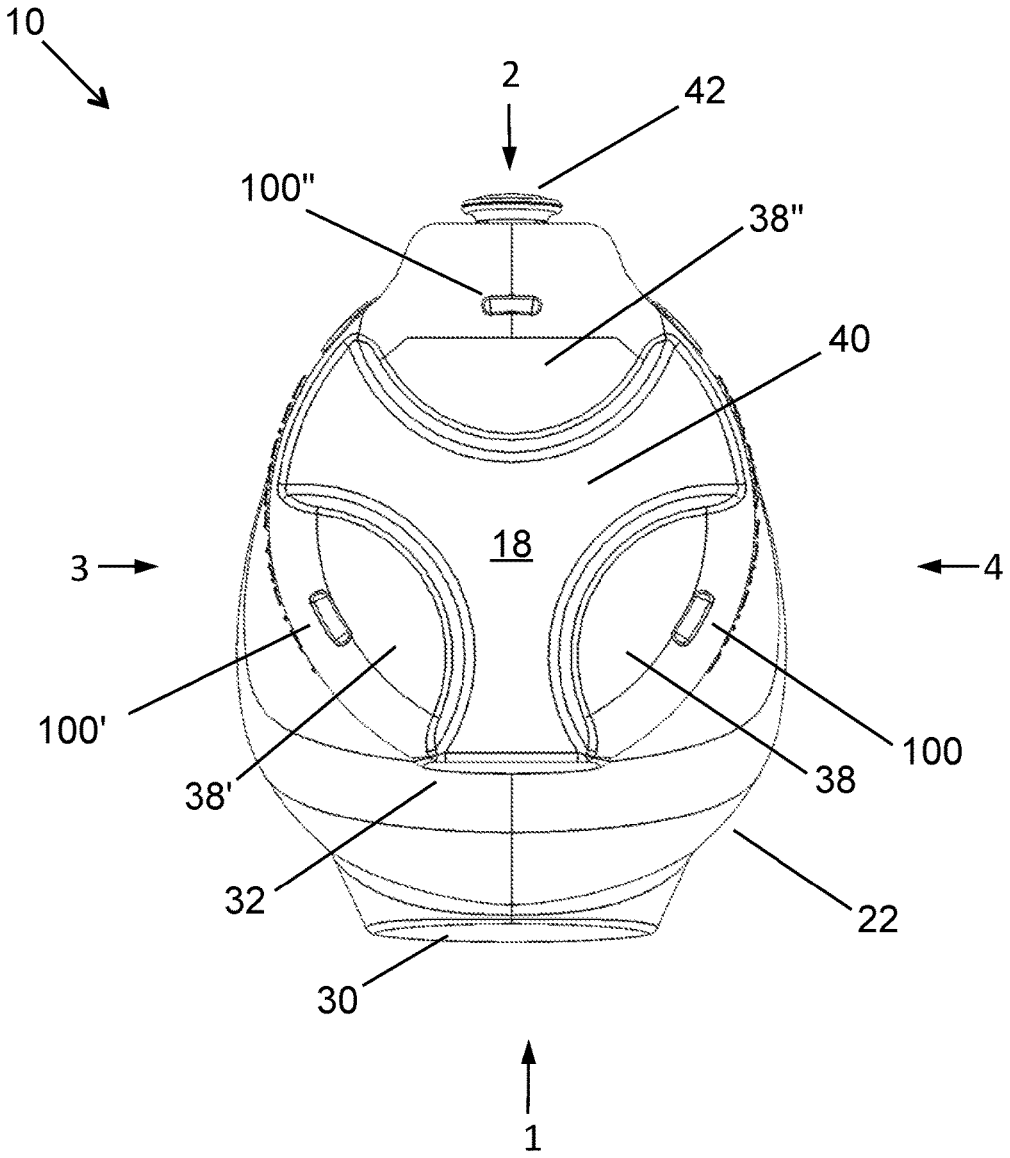
FIG. 21 shows a rear end view of the prototype feeding bottle in a horizontal position, according to the present invention.

FIG. 21 shows a bottom view of the prototype feeding bottle in a horizontal position, according to the present invention. Base 18 comprises a set of three landing pads 38, 38', 38" arranged in a triangular pattern (disposed 120 degrees circumferentially around the base 18) for the purpose of stabilizing the bottle when resting vertically on a table top. Base 18 further comprises a corresponding set of three, small, recessed indentations (grooves) 100, 100', 100", arranged in a triangular pattern (disposed 120 degrees circumferentially around the base 18). Recessed zone 40 is located in-between the three landing pads 38, 38', and 38". Front foot 30, rear foot 32, and button 42 can be seen.

Anti-Vacuum Valve

An anti-vacuum valve, or a simple vent hole, can be used with any feeding bottle of the present invention, for the purpose of eliminating internal vacuum buildup. Typical anti-vacuum valves, such as used in Tommee Tippee® Sippy Cups, are unidirectional valves comprising a thin, slitted membrane that: (1) opens when vacuum (sucking force) is applied to the valve (opening the lips of the slit membrane), and (2) closes when the hydrostatic weight of liquid pressure is applied back to the valve (pushing the lips of the slit membrane back together to make a seal). Unidirectional, anti-vacuum valves are installed in feeding bottles in the appropriate direction so that when the valve opens due to application of a vacuum (sucking) force on the inside of the bottle, that outside air at atmospheric pressure flows into the bottle. This action keeps the internal pressure of the bottle at or nearly at atmospheric pressure. Hence, the action of the anti-vacuum valve is to prevent the undesirable buildup of vacuum pressure caused by withdrawal of liquid through the nipple during feeding. Likewise, when the bottle is turned over and liquid contacts the valve, a unidirectional valve closes to prevent dripping back out through the vent hole.

Because baby infants nutritive suck when feeding by mouth at an average frequency of approximately 1 Hz (cycle/second), it is desirable in some embodiments for the "response time" of an anti-vacuum valve to be less than or equal to 0.4 seconds. Such a quick response time permits the valve to be open (during a 1 second sucking cycle) for a sufficient amount of time (i.e., 0.6 seconds) to allow a sufficient volume of outside air to flow through the valve and increase the internal pressure back to atmospheric pressure. Related to this, it is desirable in some embodiments (where pre-mature infants only have a weak sucking force) for the "opening pressure" (pressure needed to open the membrane slit to allow flow) to be in the range of 1-10 mm Hg. For older, more mature infants, the opening pressure can be appropriately larger.

FIGS. 22-24F show examples of suitable anti-vacuum valves, according to the present invention.

Figure 22:
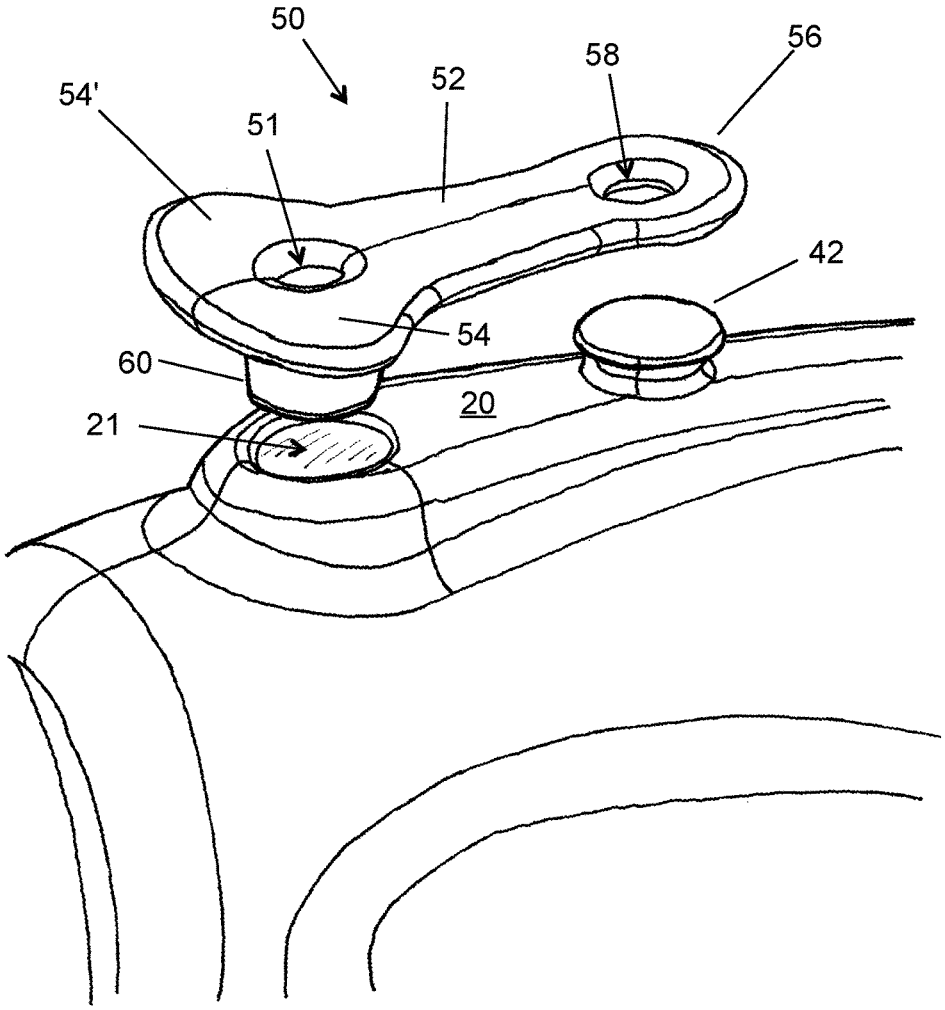
FIG. 22 shows an exploded assembly isometric view of the prototype feeding bottle in a horizontal position and the anti-vacuum valve part floating above the bottle, according to the present invention.

FIG. 22 shows an exploded assembly isometric view of the prototype feeding bottle in a horizontal position and an anti-vacuum valve floating above the bottle, according to the present invention. Anti-vacuum (AV) valve 50 comprises a single-piece, elastic part 50 (e.g., made of silicone) comprising a membrane valve body 60, intake hole 51, integral tabs (wings) 54 & 54', integral connecting member 52, and integral attachment tab 56 (tether) with attachment thru-hole 58. When installing the valve, valve body 60 fits (inserts) snugly (friction fit) into vent hole 21 in back spine 20 of bottle 10, and the hole 58 of attachment tab 56 stretches a sufficient amount so that the hole 58 fits snugly over anchor attachment button 42. This tethered configuration allows the valve 50 to be easily removable from bottle 10 for washing and drying by removal of attachment tab 56 from attachment button 42. Removing valve 50 also comprises pulling on the extended tabs 54 and/or 54' to remove (pull out) the valve body 60 from inside of vent hole 21. Alternatively (not illustrated) a cord, chain, string, strap, or cable can be used as a tether to attach/connect the anti-vacuum valve 50 to bottle 10 (e.g., by attaching valve 50 to attachment button 42 with said cord, string, etc.). Valve 50 can be any solid color or transparent.

Figure 23:
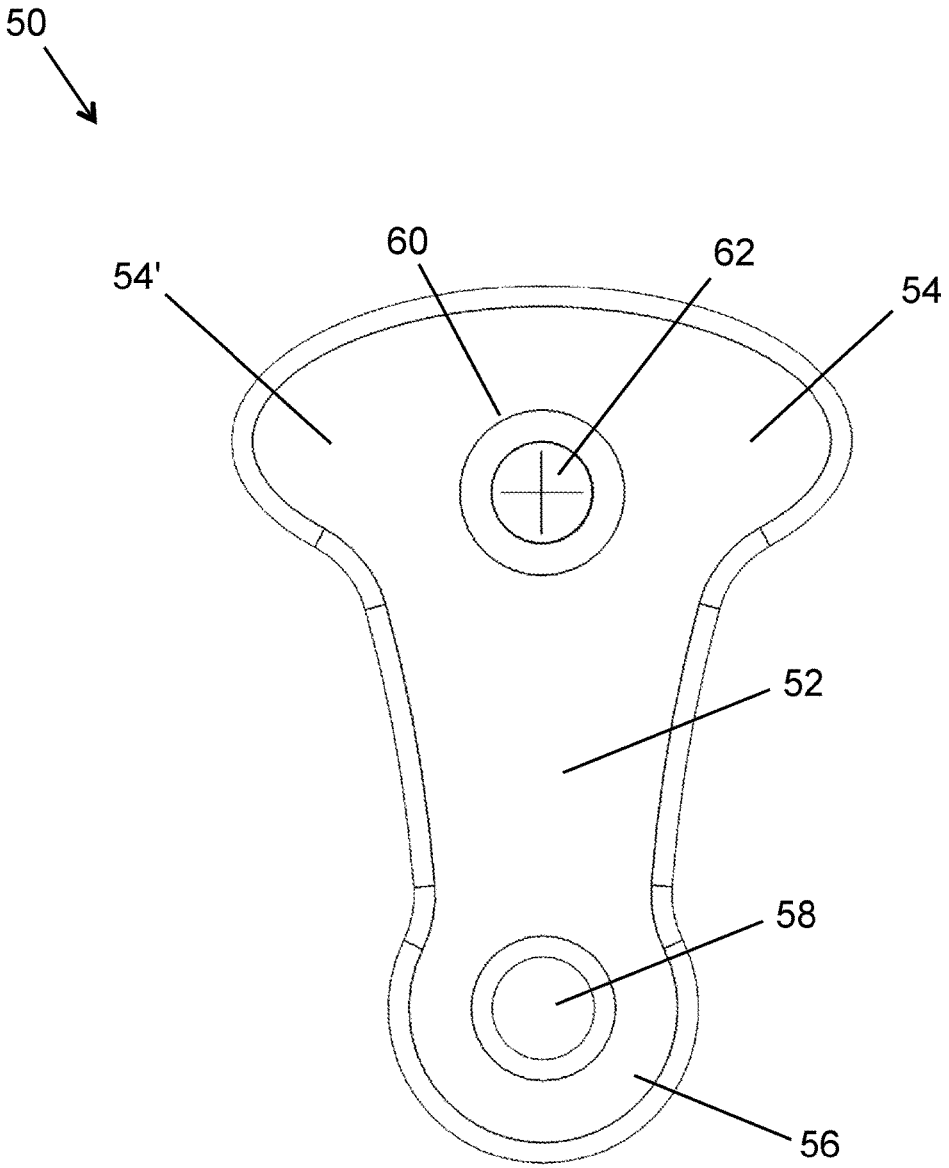
FIG. 23 shows a plan view of an example of an anti-vacuum valve, according to the present invention.

FIG. 23 shows a plan (top) view of an example of an anti-vacuum valve 50, according to the present invention. This view illustrates the underside of the valve 50. Valve 50 comprises the membrane valve body 60 with a cross-cut (slit in the form of a cross) elastic slit membrane valve 62. The entire AV valve 50 is typically molded from a single elastic material, e.g., silicone, which can be colored or left transparent. The slit membrane is approximately 4 mm in diameter, and approximately 0.2-0.3 mm thick. Different patterns for slitting the membrane can be used, for example, a single slit, or a Y-shaped slit, as needed to achieve the required valve response time and opening pressure characteristics. Other types of simple valves may be used in place of a slit membrane valve, such as a duck-billed membrane valve, with acceptable performance.

Figure 24A:
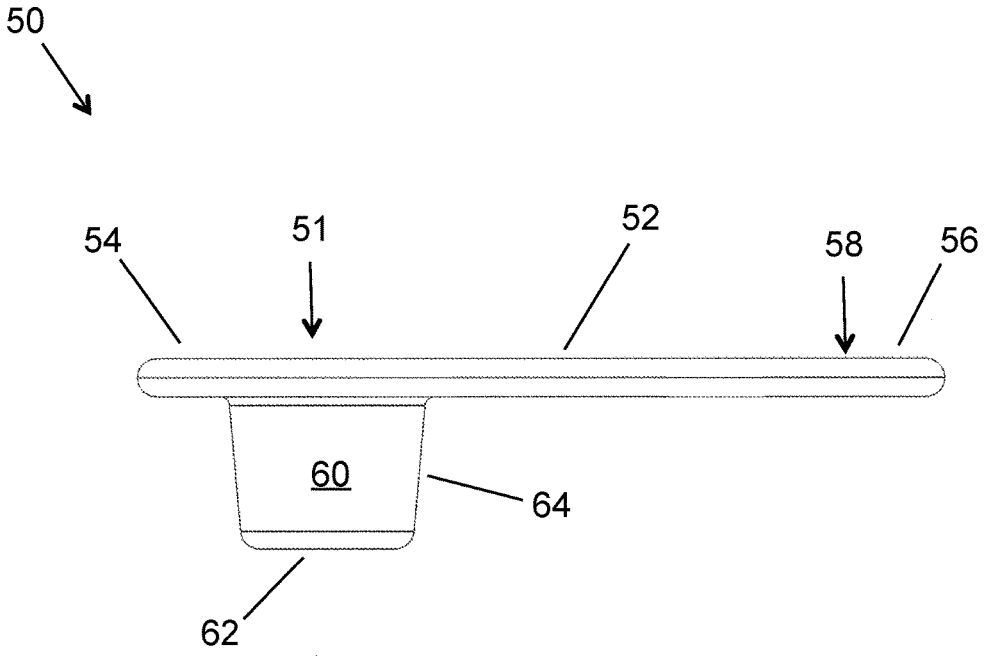
FIG. 24A shows an elevation (side) view of an example of an anti-vacuum valve, according to the present invention.

FIG. 24A shows an elevation (side) view of an example of an anti-vacuum valve, according to the present invention. Membrane valve body 60 comprises a cylindrically shaped sidewall 64 that is tapered at a shallow angle to aid in inserting valve body 60 into vent hole 21. The shallow taper angle can be approximately 5 degrees, with a range of 3 to 7 degrees. Valve body 60 also comprises slit membrane 62, which can comprise a straight-cut, "Y"-cut, or a cross-cut slit.

Figure 24B:
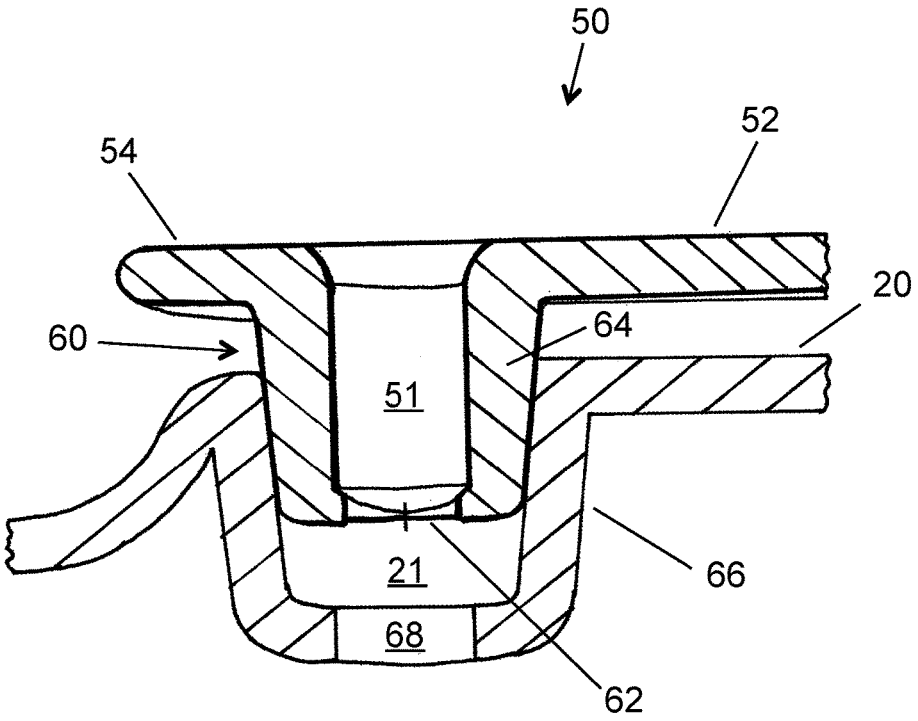
FIG. 24B shows a side cross-section view of the prototype feeding bottle in a horizontal position and the anti-vacuum valve part partially inserted into the receiving hole in the bottle, according to the present invention.

FIG. 24B shows a side cross-section view of the prototype feeding bottle in a horizontal position and the anti-vacuum valve body 60 partially inserted into the receiving (vent) hole 21 in the bottle's back sidewall 20, according to the present invention. This figure illustrates only partial insertion. Depending on the exact dimensions, in some embodiments the valve body 60 can be inserted completely into the vent hole's well 21, with the convex slit membrane 62 landing flush on the opening (aperture) 68 at the bottom of the cylindrically-shaped recessed well 66. The diameter of opening 68 is approximately the same as the diameter of the slit membrane 62 (e.g., 4 mm). Alternatively, opening 68 can be smaller (e.g., 2 mm) or larger (e.g., 6 mm) than the diameter of slit membrane 62. If opening 68 becomes too small (e.g., significantly less than 1 mm), the flow of air might be restricted too much (as well as flattening membrane 62 if valve 50 is pushed down to opening 68).

Figure 24C:
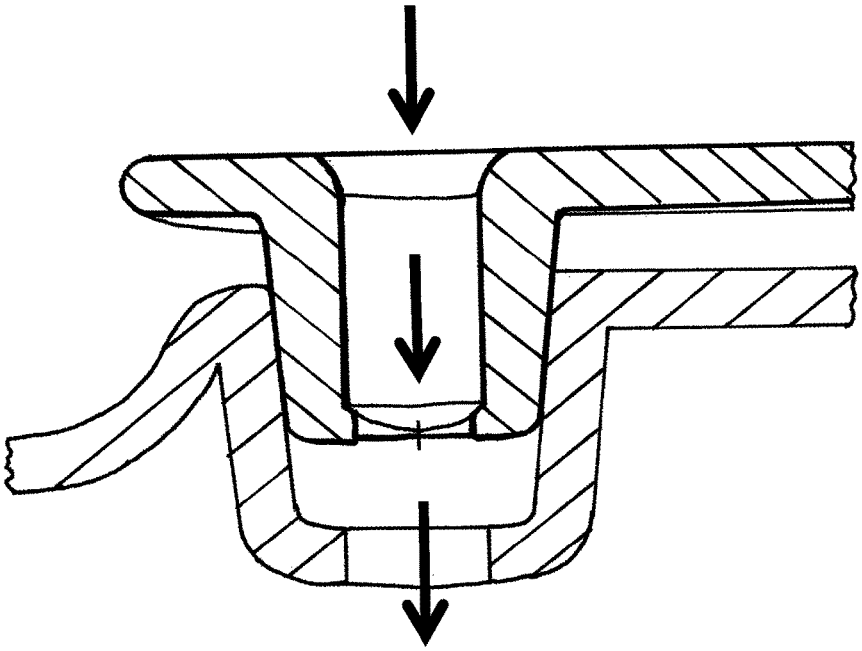
FIG. 24C shows a side cross-section view of the prototype feeding bottle in a horizontal position and the anti-vacuum valve part partially inserted into the receiving hole in the bottle, with arrows indicating the direction of airflow, according to the present invention.

FIG. 24C shows a side cross-section view of the prototype feeding bottle in a horizontal position and the anti-vacuum valve part partially inserted into the receiving hole in the bottle, with arrows indicating the direction of airflow inwards during a sucking action, according to the present invention.

Figure 24D:
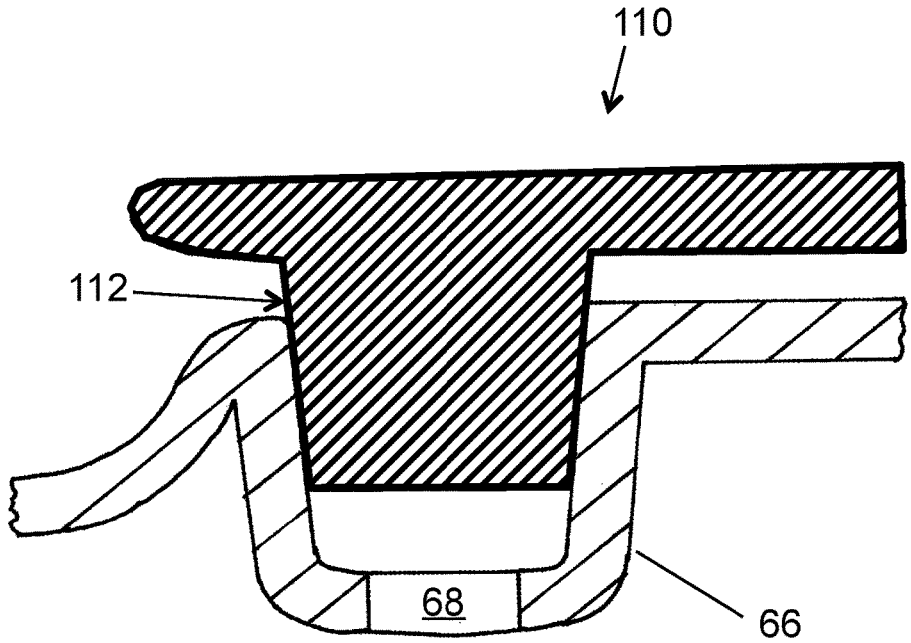
FIG. 24D shows a side cross-section view of the prototype feeding bottle in a horizontal position and a cap for plugging the vent hole, according to the present invention.

FIG. 24D shows a side cross-section view of the prototype feeding bottle in a horizontal position and a solid cap for plugging the vent hole, according to the present invention. Solid cap 110 has the same external dimensions as the AV valve 50 previously shown. In this case, however, the central well (51) is filled-in with a solid material, causing cap 110 to have a solid plug 112. Cap 110 can be optionally used in place of an AV valve. Consequently, plug 112 would be removed from vent hole 21 during feeding to allow for 100% unrestricted airflow (Note: cap 110 could still be attached to button 42 via its tether connecting member 52 (not shown)).

Figure 24E:
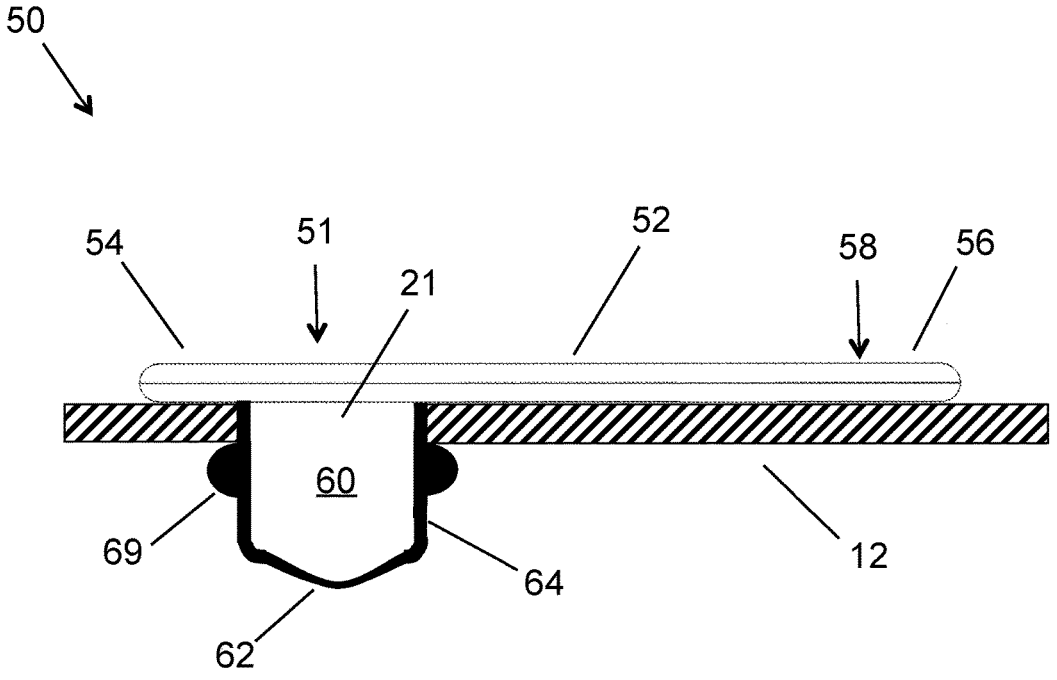
FIG. 24E shows an elevation (side) view of an example of an anti-vacuum valve with a semi-circular circumferential seal ring, according to the present invention.

FIG. 24E shows an elevation (side) cross-section view of an example of an alternate anti-vacuum valve, according to the present invention. Membrane valve body 60 comprises a cylindrically shaped, straight sidewall 64, and a convex slit membrane 62. The curvature of membrane 62 is chosen such that the valve 60 is unidirectional, i.e., such that it closes when liquid is present on the inside of the bottle 10 (when the pressure inside of the bottle is greater than the pressure outside of the bottle); and such that the valve 60 opens when a vacuum is applied inside the bottle 10 (when the pressure outside of the bottle is greater than the pressure inside of the bottle). Sidewall 64 of valve body 60 comprises one (or more) continuous, circumferential seal ring(s) 69, which aids in creating a liquid-tight seal to bottle 10 when inserted and compressed (snapped) into vent hole 21. In this example, the seal ring 69 has a semi-circular cross-sectional shape.

Figure 24F:
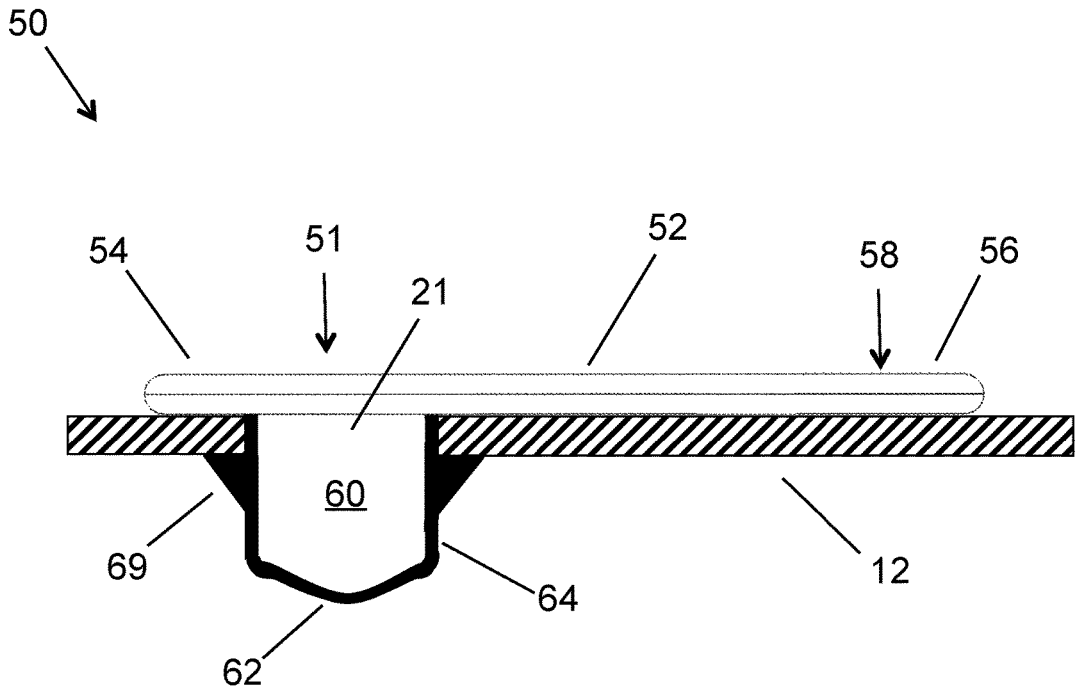
FIG. 24F shows an elevation (side) view of another example of an anti-vacuum valve with a triangular shaped circumferential seal ring, according to the present invention.

FIG. 24F shows an elevation (side) cross-section view of an example of an alternate anti-vacuum valve, according to the present invention. Membrane valve body 60 comprises a cylindrically shaped, straight sidewall 64, and a curved slit membrane 62. The convexity of membrane 62 is chosen such that the valve 60 is unidirectional. Sidewall 64 of valve body 60 comprises one (or more) continuous, circumferential seal ring(s) 69, which aids in creating a liquid-tight seal to bottle 10 when inserted and compressed (snapped) into vent hole 21. In this example, the seal ring 69 has a triangular cross-sectional shape.

Alternatively, the receiving well 66 of vent hole 21 can be un-tapered (straight cylindrically shaped walls 66).

Positioning Markers

The feeding bottles of the present invention can optionally comprise visual and/or tactile positioning markers. The purpose of visual and/or tactile positioning markers is to indicate to (guide) the person holding the feeding bottle about how to incline it in relation to the horizontal, so that the free surface of the liquid contained in the bottle passes through this mark and simultaneously passes substantially through the outlet orifice 7 of the nipple 6, thereby causing the hydrostatic pressure at the outlet to be substantially zero (i.e., 0 HP). The aforementioned markers, as such, allow the caregiver to know, at every instant and regardless of the filling rate of the feeding bottle, what inclination to give to the feeding bottle so that the infant can feed in the best conditions (i.e. substantially zero hydrostatic pressure with no dripping). The markers can be disposed symmetrically on both the left and right sides of the bottle.

The 0HP visual positioning markers can be placed anywhere on the body 12, neck 14, nipple crown 8, or nipple 6 of bottle 10, or combinations thereof. Detailed descriptions of some of these options is included in the recently-issued U.S. Pat. No. 8,863,969 to C. Lau, and to currently-pending application Ser. No. 14/479,311 to C. Lau, filed Sep. 6, 2014, both of which are incorporated by reference herein.

As is often the case with full-term babies, their lips mostly surround the nipple (from nipple tip to nipple base), and their lips can contact the face of the nipple crown (i.e., tightening ring). When the nipple is completely occluded by the infant's lips, this prevents viewing of the liquid level inside of the nipple during feeding; thus making it more difficult to determine if the free surface of the liquid actually passes through the outlet orifice of the nipple (which would achieve substantially zero hydrostatic pressure). However, if the nipple crown were transparent, or substantially transparent, then a user can visualize the actual (true) liquid level (free surface) in the neck region of the bottle underneath the nipple crown.

Accordingly, in a preferred embodiment of the present invention, the nipple crown 8 (i.e., tightening ring) is transparent, or substantially transparent. With a transparent nipple crown, the caregiver can see the level of liquid actually reaching the baby's lips.

The term "substantially transparent" is defined herein as meaning: "an object that is sufficiently clear so that a person can see through the object and correctly identify the level of a liquid surface inside or behind the object". The term "substantially transparent" includes being completely transparent (optically clear).

Empirically, we have discovered that the hydrostatic pressure can be made substantially zero by tilting the bottle to adjust the liquid level in at least one of the following ways, i.e., so that: (1) the liquid level lines up with the lower edge of the upper lip of the baby, or (2) the liquid level lines up with the corner of the baby's lips. The task of performing such alignments is made much easier when the nipple crown is transparent or substantially transparent; and this is particularly so when the baby's lips completely occlude visual observation of the nipple. This alignment task is also made easier when using a transparent, wide-based nipple design because we can readily see and easily adjust the level of the liquid surface precisely to the corner of the baby's lips.

"Zone Markers" are one or more visual and/or tactile positioning markers disposed on the right and/or left hand sidewall of body 12, near neck 14, and located offset slightly towards the front side of the bottle (i.e., towards the front foot 30). These compact ("compact" because they take up little space on the bottle) markers comprise either a tactile or visual (or combination of both) type of positioning marker. Tactile positioning markers can comprise one or more raised (or lowered) protrusion(s), intrusion(s), depression(s), groove(s) bump(s), bars(s), circle(s), filled dot(s), line(s), or geometric symbol(s) whose position can be felt with a fingertip (e.g., in the style of Braille-style bumps). Visual positioning markers can comprise one or more line(s), circle(s), dot(s), or geometric symbol(s) that are printed or colored in a different color or different shade of color (darker or lighter, including black) than the surrounding material, and whose position can be seen. A tactile marker can also be colored to make it a visual marker, too. In some embodiments, the feeding bottle can comprise tactile positioning markers at some locations, and visual positioning markers at other positions.

FIG. 25A shows a right-sided view of the prototype feeding bottle in a vertical position, with a first example of zero hydrostatic pressure (0 HP) Zone Markers 70, according to the present invention. In this example, marker 70 comprises a series of raised colored lines forming a pattern of rectangles. An identical Zone Marker 70 can be disposed on the opposite side of the bottle (not shown).

Figure 25B:
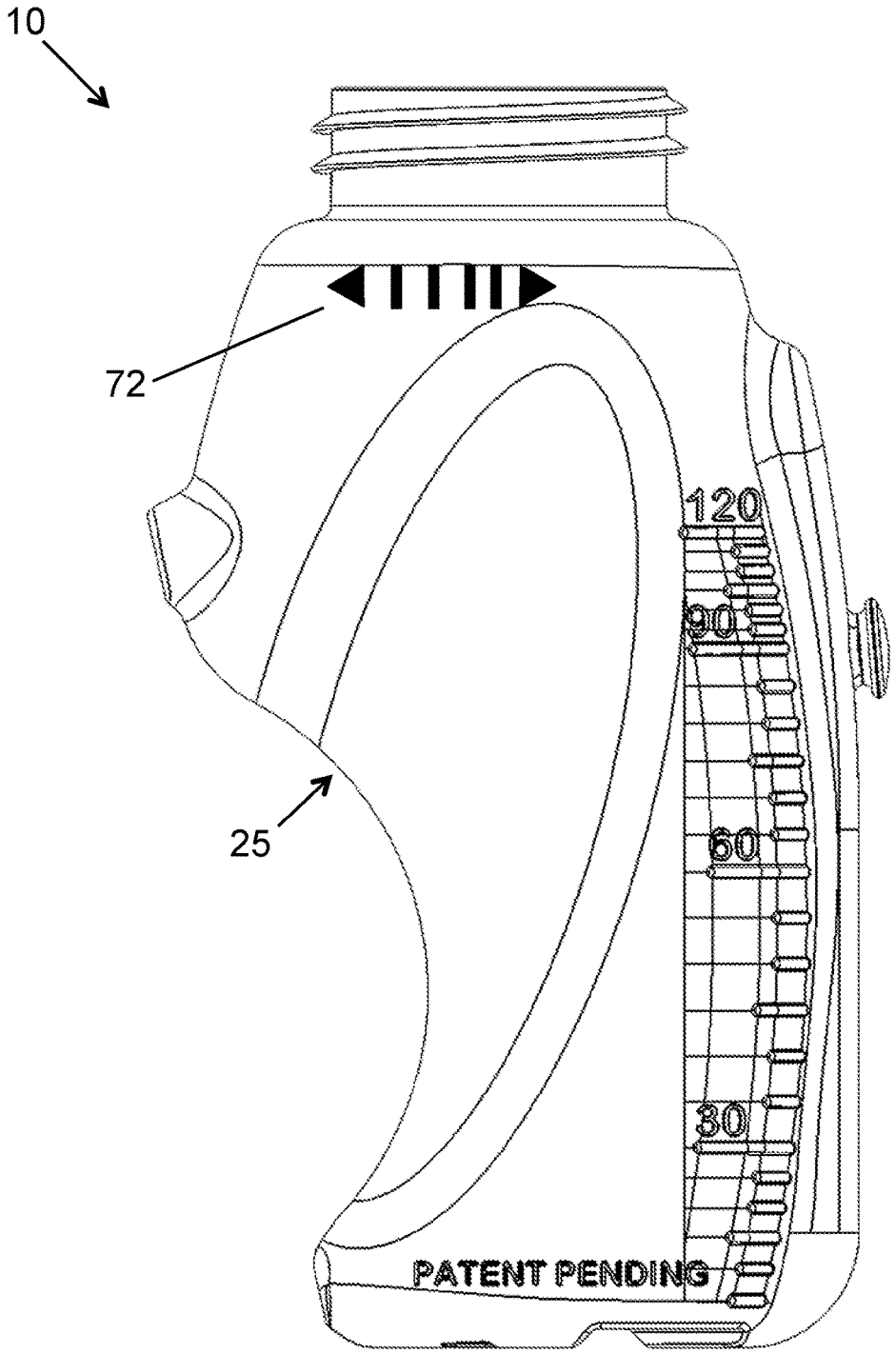

FIG. 25B shows a right-sided view of the prototype feeding bottle in a vertical position, with another example of 0 HP Zone Markers, according to the present invention. In this example, marker 72 comprises a series of raised, colored parallel line segments, bounded by a pair of raised triangles. An identical Zone Marker 72 can be disposed on the opposite side of the bottle (not shown).

Figure 25C:
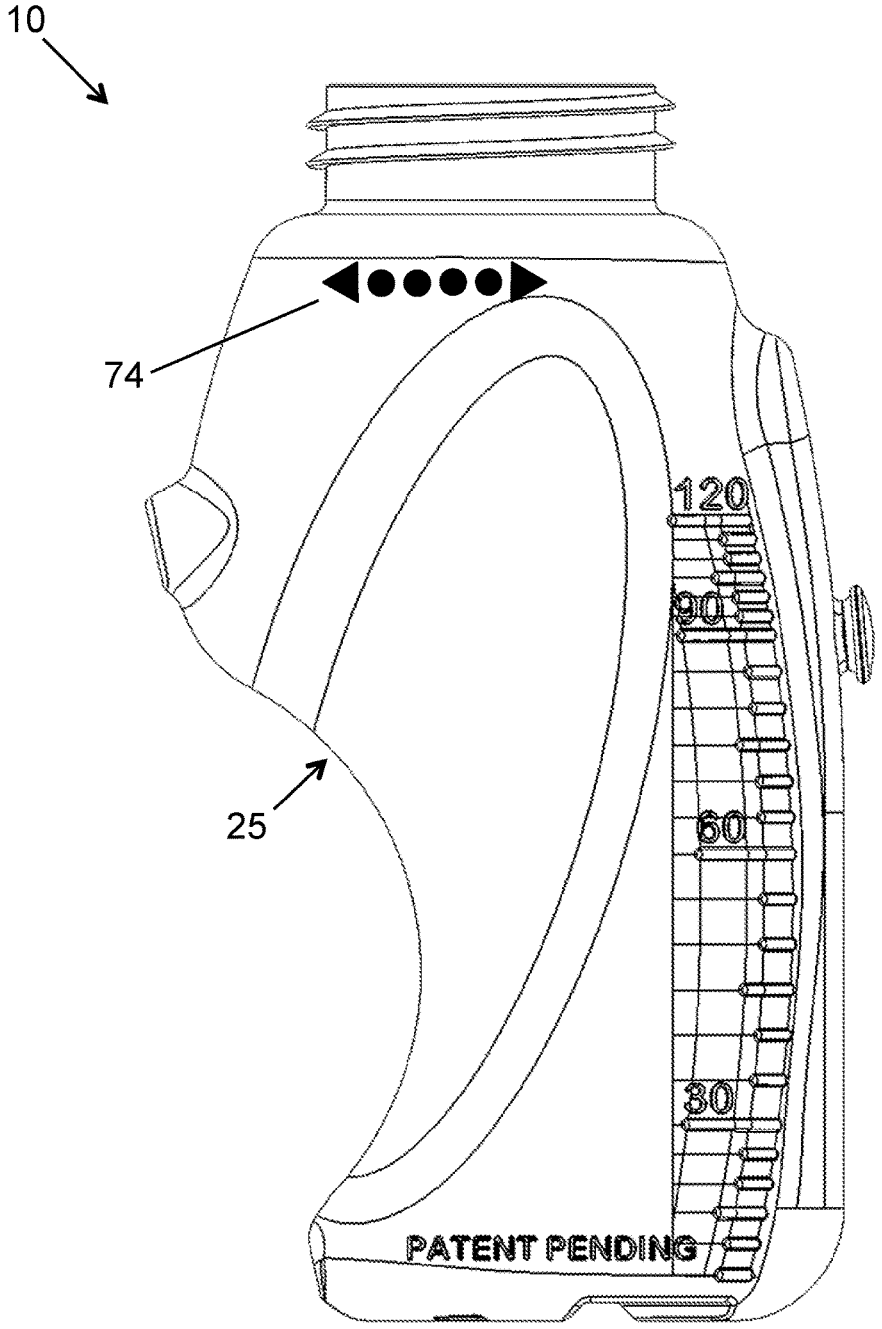

FIG. 25C shows a right-sided view of the prototype feeding bottle in a vertical position, with another example of 0 HP Zone Markers, according to the present invention. In this example, marker 74 comprises a series of raised colored dots arranged in a line, bounded by a pair of raised triangles. An identical Zone Marker 74 can be disposed on the opposite side of the bottle (not shown).

FIG. 26 shows a side view of the prototype feeding bottle in a horizontal position, illustrating examples of four different zero hydrostatic pressure raised (tactile) or printed (visual) line markers that wrap around the bottle, according to the present invention. Line marker 80 corresponds to 4 Oz liquid volume (maximum amount in this example, 100% full). Line marker 82 corresponds to 3 Oz liquid volume (75% full). Line marker 84 corresponds to 2 Oz liquid volume (50% full), and line marker 86 corresponds to 1 Oz liquid volume (25% full). In addition, zone marker 74 has been added to FIG. 26 to illustrate the relationship between the 0 HP Zone Markers 74 and the 0 HP line markers 80, 82, 84, 86. The 0 HP line markers can be continuous solid lines, on continuous dashed lines, or continuous dotted lines, or combinations thereof.

FIG. 27A shows a side view of the prototype feeding bottle in a horizontal position, illustrating an example of a zero hydrostatic pressure line marker 86 that wraps around the bottle, corresponding to 1 Oz of liquid (25% full), according to the present invention. Bottle 10 has been correctly tilted (inclined) at an angle, θ, (approximately −5°) with respect to the horizontal, so that the liquid level (1 Oz.) lines up with the visual positioning marker line 86 that wraps around the bottle's sidewalls. At this specific angle, for a 1 Oz volume, there is substantially zero hydrostatic pressure at the nipple's outlet, because there is no liquid residing above the level of the nipple's outlet orifice 7.

FIG. 27B shows a side view of the prototype feeding bottle in a horizontal position, illustrating an example of a zero hydrostatic pressure line marker 80 that wraps around the bottle, corresponding to 4 Oz of liquid (100% full), according to the present invention. Bottle 10 has been correctly tilted (inclined) at an angle, θ, (approximately)+7° with respect to the horizontal, so that the liquid level (4 Oz.) lines up with the visual positioning marker line 80 that wraps around the bottle's sidewalls. At this specific angle, for a 4 Oz volume, there is substantially zero hydrostatic pressure at the nipple's outlet, because there is no liquid residing above the level of the nipple's outlet orifice 7.

Cap

Feeding bottles of the present invention can optionally comprise a cap for covering and protecting the nipple. The cap can be transparent or substantially transparent.

FIG. 28 shows a cross-section side assembly view of the prototype feeding bottle in a horizontal position, with the anti-vacuum valve part inserted into the receiving hole, and with a nipple held by a nipple crown ring, and with a protective, fluted cap 90 covering the nipple and nipple crown ring, according to the present invention.

FIG. 29 shows an isometric, solid-shaded side/end view of the prototype feeding bottle in a horizontal position, with the anti-vacuum valve part inserted into the receiving hole, and with a nipple held by a nipple crown ring, and with a protective, fluted cap 90 covering the nipple and nipple crown ring, according to the present invention.

FIG. 30 shows an enlarged, isometric, solid-shaded side/end view of the prototype feeding bottle in a horizontal position, with the anti-vacuum valve part inserted into the receiving hole, and with a nipple held by a nipple crown ring, and with a protective, fluted cap 90 covering the nipple and nipple crown ring, according to the present invention.

FIG. 31 shows a front elevation view of the prototype feeding bottle in a reversed/upside-down vertical position, with the fluted cap 90 acting as a drying stand holding the neck 14 of the bottle 10 in an upside-down position; and with the nipple/crown ring assembly (6, 8) resting on the top (i.e., bottom/rear end 18) of the bottle 10, for purposes of drying after washing, according to the present invention. The narrow closed end 92 of cap 90 has an outer diameter that just matches (slightly undersized) the inside diameter of neck 14. This allows the end 92 to be inserted into neck 14 and the entire assembly placed upside-down to drain water during drying. Cap 90 comprises a total of eight deep flutes 96 (drainage grooves) that serve to drain away wash-water dripping down from the inside of bottle 10 when assembled in the drying position as illustrated in FIG. 31. The wide, open end 94 of cap 90 comprises a flared end 94 that serves to increase the diameter of the base of cap 90 for improving the stability of the assembly when supporting the upside-down bottle drying assembly. Nipple crown ring 8 comprises three or more small bumps 98, 98', 98" that key into matching grooves/depressions in base 18 (see grooves 100, 100', 100" in FIGS. 21, 32 and 33). The three bumps and grooves are spaced 120 degrees apart circumferentially. Cap 90 can be transparent or substantially transparent, or colored any color. Nipple crown ring 8 can further comprise eight recessed drainage grooves (flutes) 97 for promoting water drainage during drying.

Alternatively, fluted cap 90 can comprise 1, 2, 3, 4, 5, 6, 7, 8, 9, 10, 11 or 12 individual flutes (grooves), arranged uniformly symmetrically around the circumference of cap 90.

FIG. 32 shows a bottom (rear) end view of the prototype feeding bottle in a horizontal position, according to the present invention. Nipple crown ring 8 comprises three bumps 98, 98', 98" that key into matching grooves 100, 100', 100" in base 18. The three bumps and grooves are spaced 120 degrees apart circumferentially.

FIG. 33 shows an isometric view of an example of a nipple crown ring for use with the prototype feeding bottle, according to the present invention. Nipple crown ring 8 comprises three bumps 98, 98', 98" that key into matching grooves 100, 100', 100" in base 18. The three bumps and grooves are spaced 120 degrees apart circumferentially. Nipple crown ring 8 comprises eight recessed drainage grooves (flutes) 97 for promoting water drainage during drying.

FIG. 34 shows a side view of the prototype feeding bottle, with indications for cross-section cuts, according to the present invention.

FIG. 35 shows a bottom (rear) end view of the prototype feeding bottle in a horizontal position, with an indication for a cross-section cut according to the present invention.

FIG. 36 shows a cross-section A-A bottom (rear) end view of the prototype feeding bottle in a horizontal position, according to the present invention. The cross-section is nearly circular (spherical).

FIG. 37 shows a cross-section B-B bottom (rear) end view of the prototype feeding bottle in a horizontal position, according to the present invention. Left and right recessed nooks 46 and 47, respectively, can be seen. The cross-section is irregular, more closely rectangular or oval than circular. The entire cross-sectional area 250 of the bottle is cross-hatched with large-spacing cross-hatching, which is defined by the exterior perimeter line 199.

FIG. 38 shows a cross-section C-C bottom (rear) end view of the prototype feeding bottle in a horizontal position, according to the present invention. The centerline of the cross-section (solid cross) is displaced significantly from the centerline of the circular neck 14 (dashed line cross).

FIG. 39 shows a cross-section C-C bottom (rear) end view of the prototype feeding bottle in a horizontal position, according to the present invention, where the entire cross-sectional area 140 of the bottle is cross-hatched at the location of Section C-C. This area can be compared with the entire cross-sectional area of the outer boundary of the oversized chest section 22. Here, we see that the cross-sectional area of the bottle at the level of the chest section, including the front foot 30 (i.e., Sec. B-B) is more than 3 times greater than the cross-sectional area of the bottle at the level of the waist 28 (i.e., Sec. C-C). This is very different than what is found in conventional feeding bottles with straight sidewalls, which have essentially the same cross-sectional area throughout the various levels of the bottle from top to bottom. Note: one consequence of this non-linearity in volume going from top to bottom is that the spacing (divisions) between marker lines in the volumetric scales 48 and 49 are also non-uniform going from top to bottom.

FIG. 40 shows a cross-section D-D back side view of the prototype feeding bottle in a horizontal position, according to the present invention. It can be seen that, in this view, that the width of chest 22 is about 2.5 times greater than the width of waist 28.

FIG. 41 shows a cross-section E-E left side view of the prototype feeding bottle in a horizontal position, according to the present invention. The molded recessed well 66 for holding an anti-vacuum valve can be seen, along with the protruding anchor button 42.

Additional Notes

Additional recessed dimples can be added, as needed, to accommodate specific hand grips and finger positions. For example, 1, 2, 3, or 4 finger dimples/grooves can be added to the chest section to more precisely fit a caregiver's hand.

A wide-based nipple may be used, which would require a correspondingly wide-based neck.

In some embodiments, at least 50% of the base 18 is flat. The front foot 30 can also act as a finger rest (e.g., for the $2^{nd}$ finger), when using a pistol-style hand grip.

In some embodiments, the closed bottom end (base 18) can be replaced with a second, open neck. Such a dual-neck design can accommodate a $2^{nd}$ nipple mounted on the second neck. This results from the recognition that when the bottle is turned around, that the flared end 19 of the base 18, when combined with the thin waist 28 in crook 26, makes for an ideal and easy shape for a mature infant to hold onto.

FIG. 42 shows a horizontal, cross-section view of an example of a feeding bottle, where the bottle's shape is axisymmetric around its longitudinal central axis, according to the present invention. In this case, there is no substantially-straight back sidewall 20 (spine), and all of the sidewalls comprise the same S-shaped curve 25. Such axisymmetric bottles can optionally have anti-roll front and rear feet (30, 32), and optionally an anti-vacuum valve (50 or solid cap 110 covering a vent hole 21.

FIG. 43 shows a cross-section view of an example of an articulating nipple system, according to the present invention. Articulating nipple system 201 comprises a modified nipple 6 snap-fit to a spherical ball 200 via connecting barbed flange 206, which comprises a cylindrical wall segment 206 with a barbed end 214. Barbed end 214 snap fits into an annular recessed volume that is defined by the space in-between an inner cylindrical wall segment 212 and an outer cylindrical wall segment 208 of nipple 6. Nipple crown ring 14 has been modified with the addition of semi-spherical flange 202 (socket), which tightly holds spherical ball connecting member 200. Ball 200 has a hollow bore 210 through with the fluid flows. Ball 200 and spherical flange 202 from a fluidically-tight ball and socket joint that permits rotation (articulation) of attached nipple 6 with respect to nipple crown 14 when connecting ball 200 is rotated. Shoulder 204 of nipple 6 can have a portion that extends radially outwards to form a rib or lip 216 that protrudes outwards beyond the extent of outer cylindrical wall 208. Rib or lip 216 can be gripped with a finger and pulled on to break the seal with the inner flange 206 when removing the nipple 6 from connector ball 200. Note that the infant's lips only go as far as the edge of rib 216.

FIG. 44 shows a cross-section view of the previous example of an articulating nipple system, according to the present invention. This view shows the rotatable nipple 6 in two different positions, i.e., the neutral position at $\beta=0°$, and at a rotated position at $\beta=20°$ (drawn in light gray lines). Depending on the height of spherical flange 202 versus the location of the lowest point on the outer cylindrical wall segment 208, the maximum amount of rotation of nipple 6 can be as great as +/−70°.

What is claimed is:

1. A feeding bottle comprising a top end and a closed bottom end, front and back sides, and right and left sides, an elongated body, a central longitudinal axis, an open neck, a substantially-straight back sidewall and an "S"-shaped curved front sidewall; wherein the curved front sidewall comprises two sections:

(1) a convex chest section near the top end, and (2) a concave handle section near the bottom end, comprising a concave crook and a thin waist; and further wherein the bottle has a single plane of symmetry located between the right and left hand sides of the bottle; and further comprising a center of gravity (without any liquid) that is located within the top ⅓ of the body.

2. A feeding bottle comprising a top end and a closed bottom end, front and back sides, and right and left sides, an elongated body, a central longitudinal axis, an open neck, a substantially-straight back sidewall and an "S"-shaped curved front sidewall; wherein the curved front sidewall comprises two sections:

(1) a convex chest section near the top end, and (2) a concave handle section near the bottom end, comprising a concave crook and a thin waist; and further wherein the bottle has a single plane of symmetry located between the right and left hand sides of the bottle; and further comprising a center of gravity (without any liquid) that is located within the top ⅓ of the body; and further comprising the following dimensional limitations:

$$L_{COG} \leq \tfrac{1}{3} \times L_{body} \quad \text{Eq. (1)},$$

$$L_{chest} \geq \tfrac{1}{3} \times L_{body} \quad \text{Eq. (2)},$$

$$W_{chest} \geq \tfrac{1}{2} \times L_{body} \quad \text{Eq. (3)},$$

$$L_{handle} \leq \tfrac{2}{3} \times L_{body} \quad \text{Eq. (4)},$$

$$L_{waist} \leq \tfrac{1}{3} \times L_{body} \quad \text{Eq. (5)},$$

$$L_{waist} \leq \tfrac{1}{2} \times L_{handle} \quad \text{Eq. (6)},$$

$$W_{waist} \leq \tfrac{1}{2} \times L_{body} \quad \text{Eq. (7)},$$

$$W_{chest} \geq 1.5 \times W_{waist} \quad \text{Eq. (8)},$$

$$L_{chest} \geq \tfrac{1}{2} \times L_{handle} \quad \text{Eq. (9)},$$

$$W_{chest} \geq 1.7 \times D_{neck} \quad \text{Eq. (10)},$$

$$W_{f\,foot} \geq \tfrac{1}{2} \times W_{chest} \quad \text{Eq. (11)},$$

$$W_{waist} \leq \tfrac{1}{2} \times L_{body} \quad \text{Eq. (12)},$$

$$W_{chest} \geq \tfrac{1}{2} \times L_{body} \quad \text{Eq. (13)},$$

$$R_{crook} \leq \tfrac{1}{2} \times L_{body} \quad \text{Eq. (14)}.$$

3. The feeding bottle of claim 2, further comprising a pair of finger recesses comprising a pair of lateral, recessed indentations on an opposite left and right side of the bottle, located in the front ½ of the bottle in the chest section.

4. The feeding bottle of claim 2, further comprising a vent hole disposed through the back sidewall, near the neck.

5. The feeding bottle of claim 4, further comprising an anti-vacuum valve inserted into the vent hole.

6. The feeding bottle of claim 5, wherein the anti-vacuum valve comprises a cross-cut slit membrane with a response time of less than or equal to 0.4 seconds and an opening pressure range of from 1 to 10 mm Hg.

7. The feeding bottle of claim 6, wherein the anti-vacuum valve comprises an attachment tab with an attachment hole for attaching the valve to an attachment anchor protruding from the body of the bottle.

8. The feeding bottle of claim 2, further comprising a nipple mounted to the neck with a nipple crown ring that is transparent or substantially transparent.

9. The feeding bottle of claim 2, further comprising a nipple and a nipple crown; wherein the neck, the nipple, and the nipple crown are angled at a negative angle, $\beta<0$, with respect to the bottle's longitudinal central axis.

10. A feeding bottle comprising a top end and a closed bottom end, front and back sides, and right and left sides, an elongated body, a central longitudinal axis, an open neck, a substantially-straight back sidewall and an "S"-shaped curved front sidewall; wherein the curved front sidewall comprises two sections:

(1) a convex chest section near the top end, and (2) a concave handle section near the bottom end, comprising a concave crook and a thin waist; and further wherein the bottle has a single plane of symmetry located between the right and left hand sides of the bottle; and wherein the cross-sectional area of the bottle at the level of the chest section is at least 3 times greater than the cross-sectional area of the bottle at the level of the waist.

* * * * *